US012397949B1

(12) United States Patent
Yisha et al.

(10) Patent No.: US 12,397,949 B1
(45) Date of Patent: Aug. 26, 2025

(54) PILL FEED APPARATUS FOR PACKAGING MACHINE

(71) Applicant: Innovative Technology, Inc., Ashland, OH (US)

(72) Inventors: Richard W. Yisha, Medina, OH (US); Kevin Paul Yeo, Ashland, OH (US)

(73) Assignee: ACCU-CHART PLUS HEALTH CARE SYSTEMS, INC., St. Petersburg, FL (US)

( * ) Notice: Subject to any disclaimer, the term of this patent is extended or adjusted under 35 U.S.C. 154(b) by 143 days.

(21) Appl. No.: 18/213,617

(22) Filed: Jun. 23, 2023

Related U.S. Application Data

(60) Provisional application No. 63/398,280, filed on Aug. 16, 2022, provisional application No. 63/357,676, filed on Jul. 1, 2022.

(51) Int. Cl.
*B65B 35/08* (2006.01)
*B65B 35/26* (2006.01)
*B65B 65/02* (2006.01)

(52) U.S. Cl.
CPC ..... *B65B 35/08* (2013.01); *B65B 35/26* (2013.01); *B65B 65/02* (2013.01)

(58) Field of Classification Search
CPC ..... B65B 5/103; B65B 35/08; A61J 7/02
See application file for complete search history.

(56) References Cited

U.S. PATENT DOCUMENTS 1,579,247 A * 4/1926 Rohlfing ..... B21F 3/04 72/142
2,225,957 A * 12/1940 Korff ..... F16H 1/32 475/263
2,801,025 A * 7/1957 Cookson ..... B65B 5/103 221/68
4,693,057 A * 9/1987 Rittinger ..... B65B 35/08 53/247
5,086,945 A * 2/1992 Corella ..... B65B 5/103 221/265
7,392,640 B2 * 7/2008 Vasquali ..... B65B 5/103 53/247
2002/0092275 A1 * 7/2002 Kim ..... B65B 5/103 53/493

(Continued)

*Primary Examiner* — Daniel Jeremy Leeds
(74) *Attorney, Agent, or Firm* — Ralph E. Jocke; WALKER & JOCKE

(57) ABSTRACT

A pill feed apparatus (30) is configured to be utilized in connection with a unit dose packaging machine (10) or other device. The exemplary apparatus includes a plurality of feeder discs (104, 150, 174) that include a plurality of pill engaging apertures (120, 152, 176) that are sized for holding pills of different respective pill configurations. The respective feeder discs are rotatably movable within a base interior area (238) that is bounded by a base ring (42). A cover (66) is in supporting connection with a plurality of deformable brushes (234, 240, 242, 244, 246, 248) that are configured to engage pills that move with a feeder disc. Rotation of a feeder disc causes pills positioned within the interior area to be moved into sequential engagement with the brushes such that a single pill is caused to be engaged with each respective aperture. Pills are delivered individually and in a controlled manner from the apertures for inclusion in packages.

34 Claims, 82 Drawing Sheets

(56) References Cited

U.S. PATENT DOCUMENTS

| | | | | |
|---|---|---|---|---|
| 2006/0021316 | A1* | 2/2006 | Harkcom | A01D 34/664<br>56/255 |
| 2009/0087257 | A1* | 4/2009 | Harkcom | A01D 75/182<br>403/359.1 |
| 2011/0030314 | A1* | 2/2011 | Baroncini | B65B 35/08<br>53/254 |
| 2013/0008131 | A1* | 1/2013 | Baroncini | B65B 59/04<br>53/235 |
| 2013/0284755 | A1* | 10/2013 | Yuyama | B65D 83/04<br>221/277 |
| 2015/0217930 | A1* | 8/2015 | Holmes | G07F 11/32<br>221/1 |

* cited by examiner

FIG 10
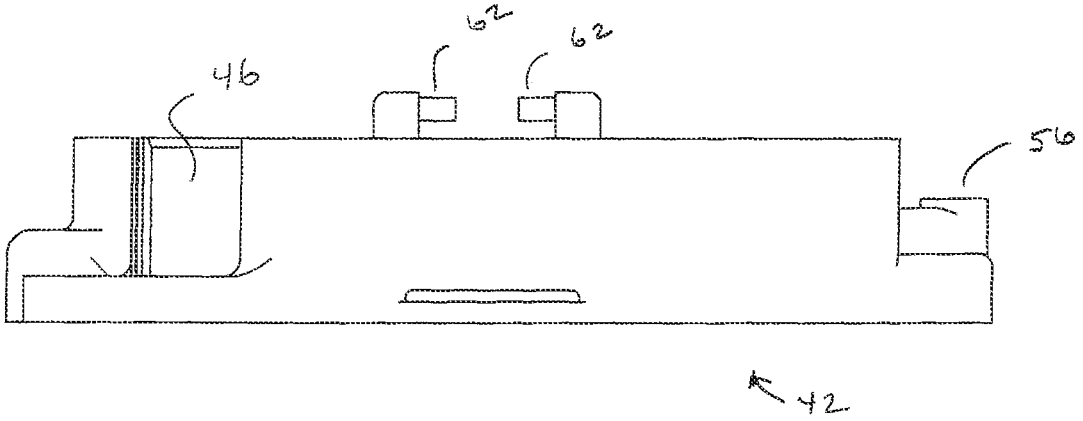
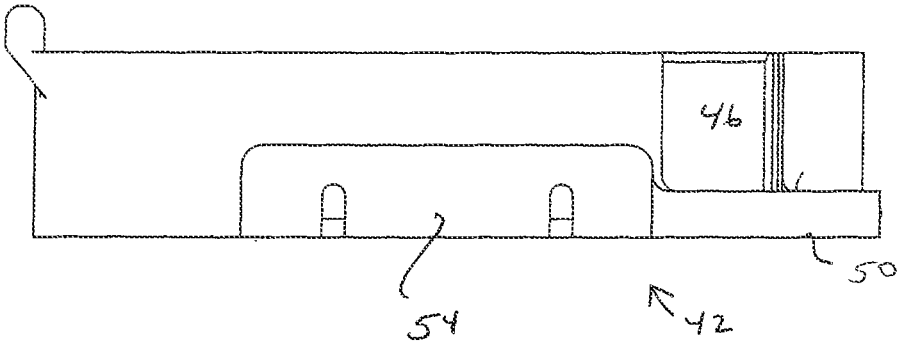
FIG 11

FIG 14
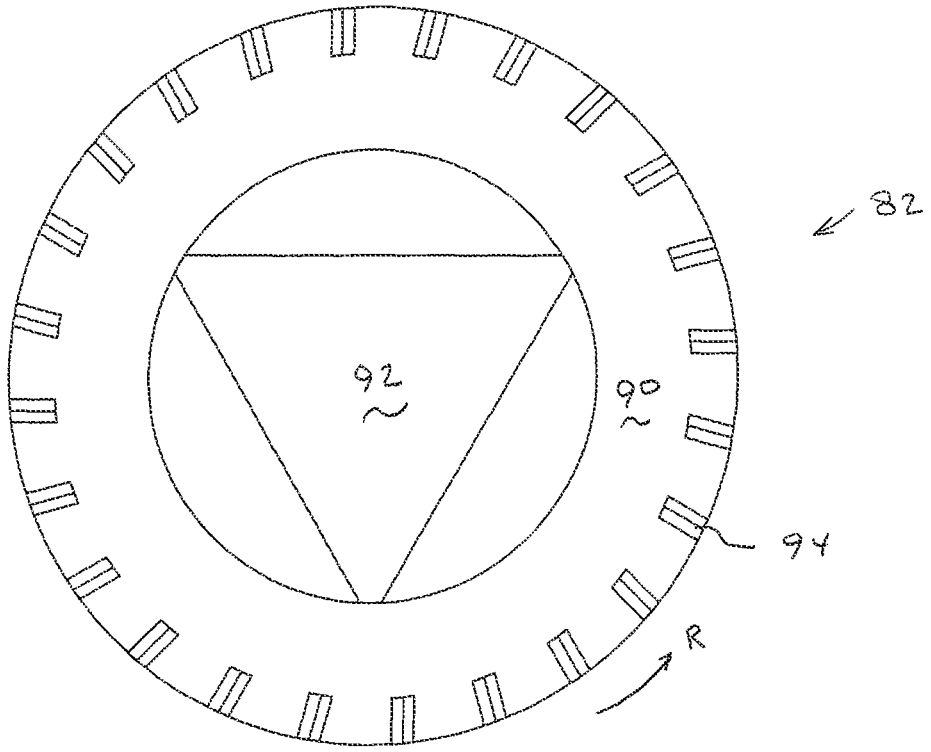
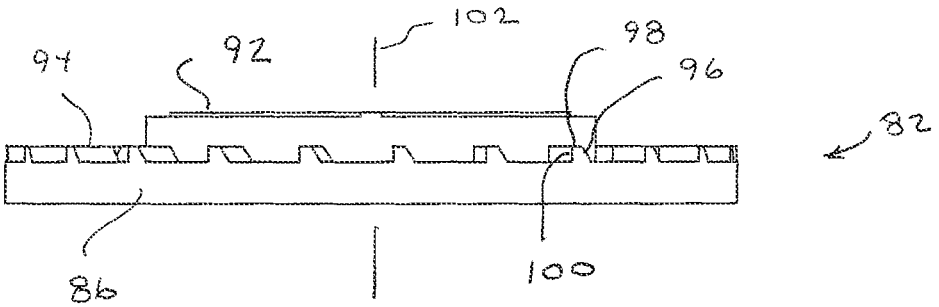
FIG 15

FIG 19
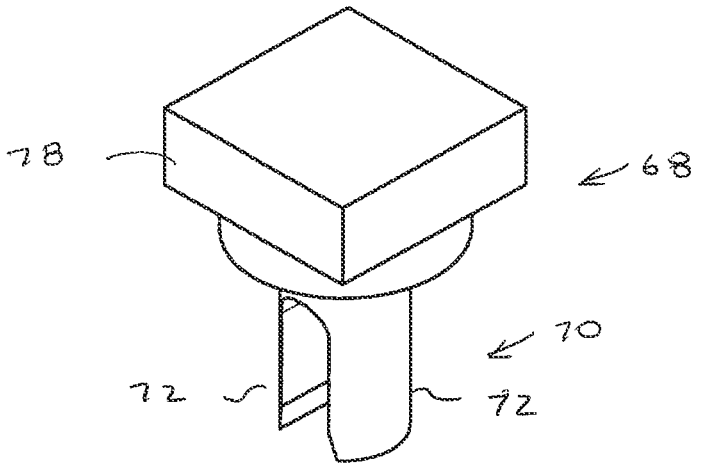
FIG 20
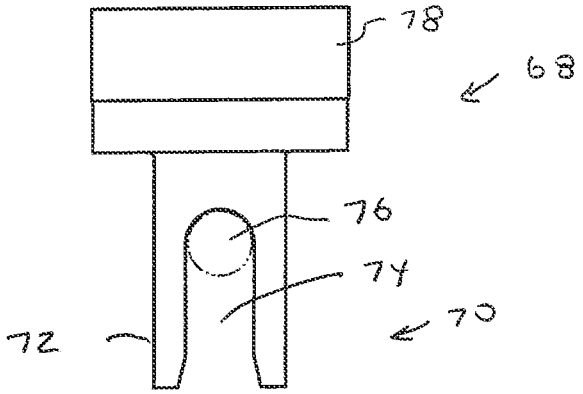
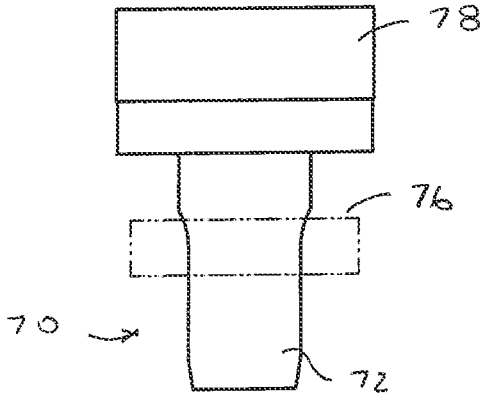
FIG 21

FIG 23
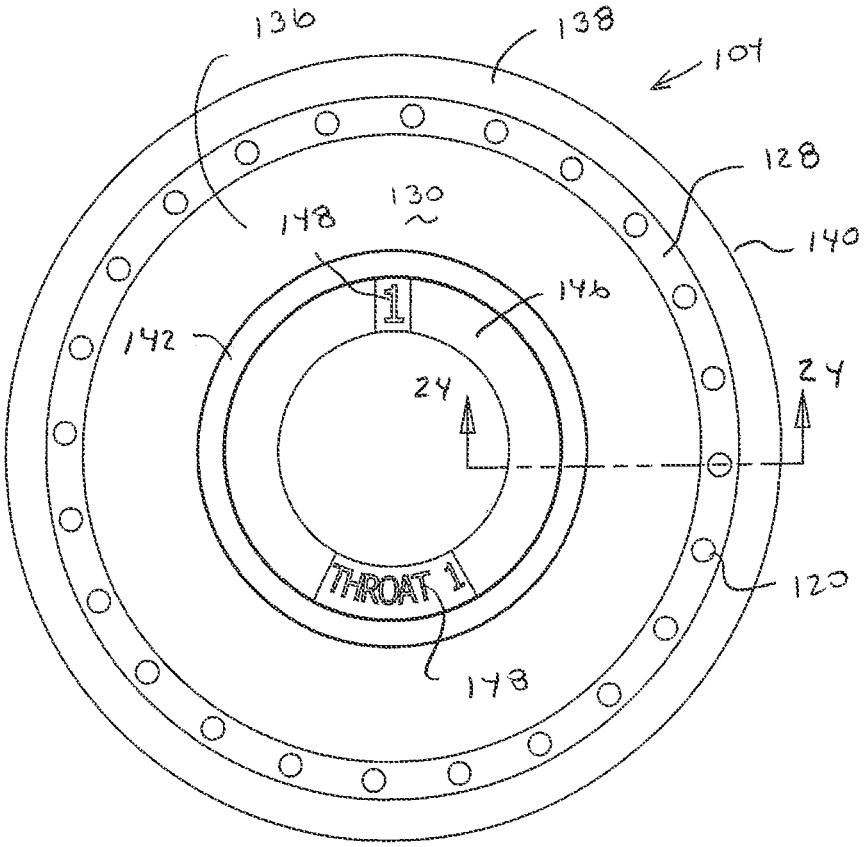
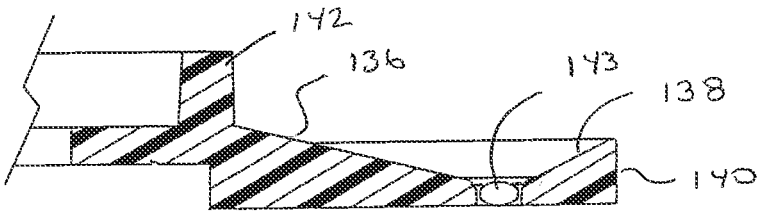
FIG 24

FIG 25
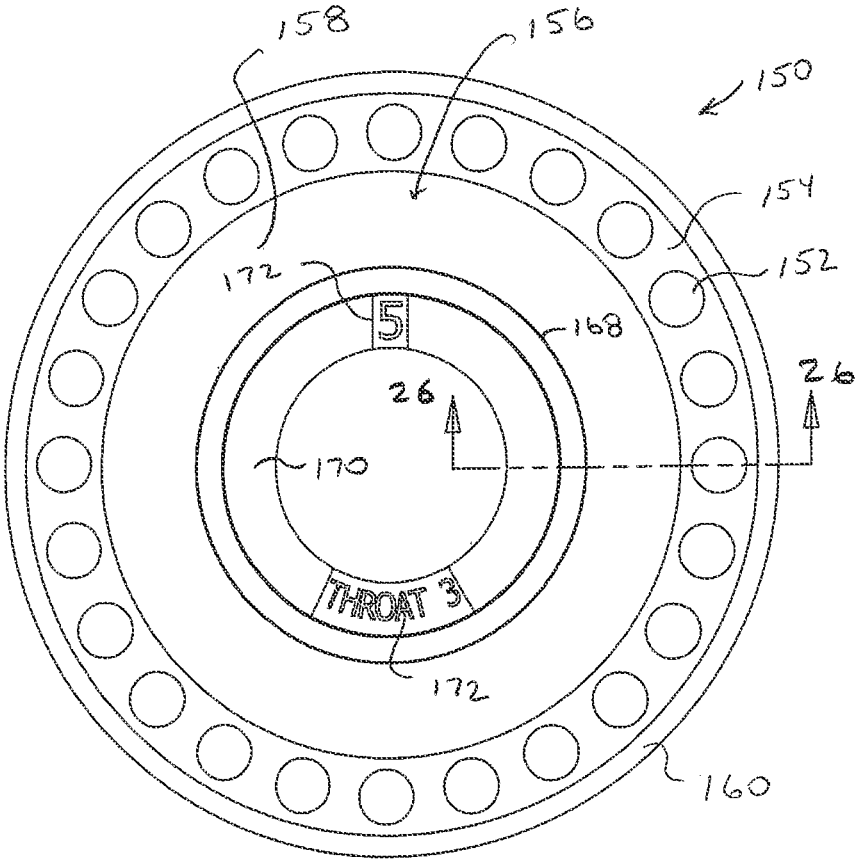
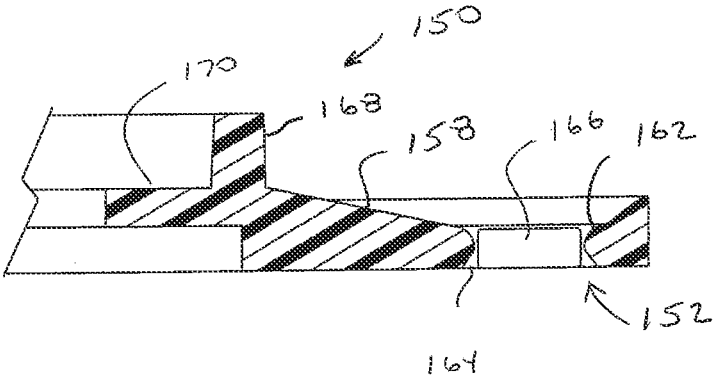
FIG 26

FIG 27
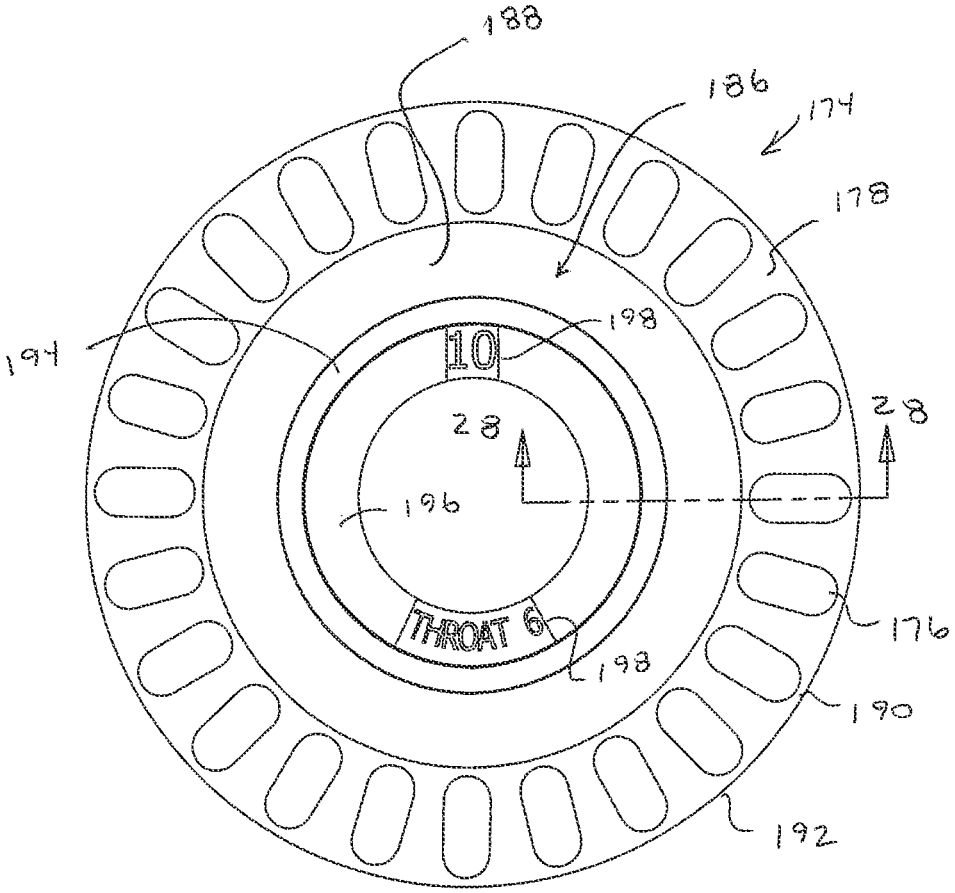
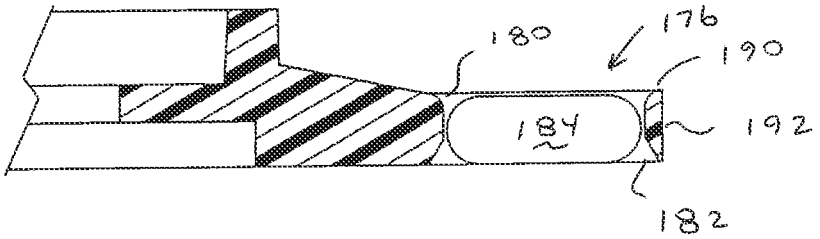
FIG 28

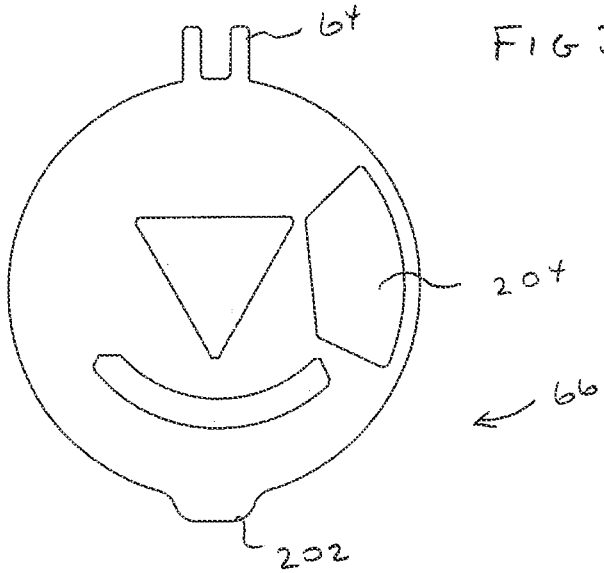
FIG 30
FIG 31
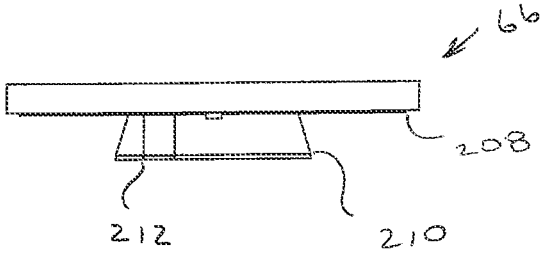
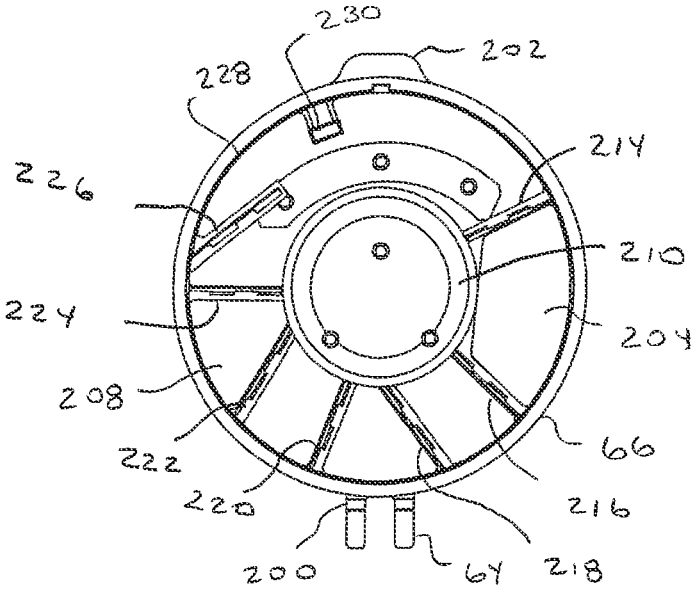
FIG 32

FIG 34
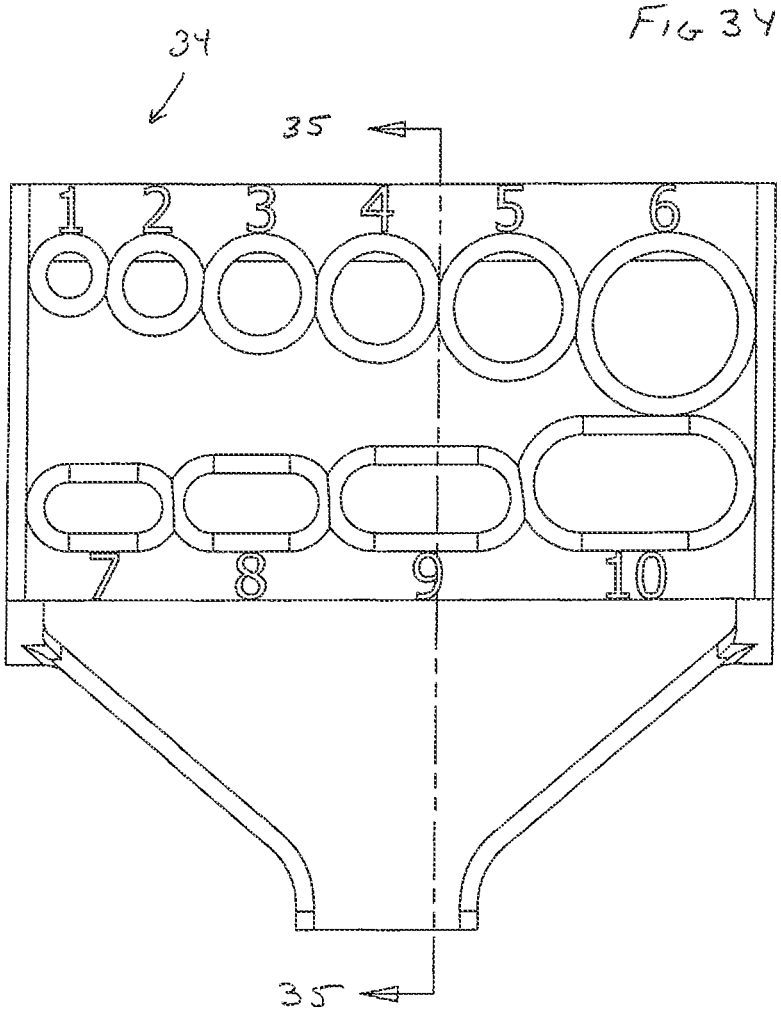
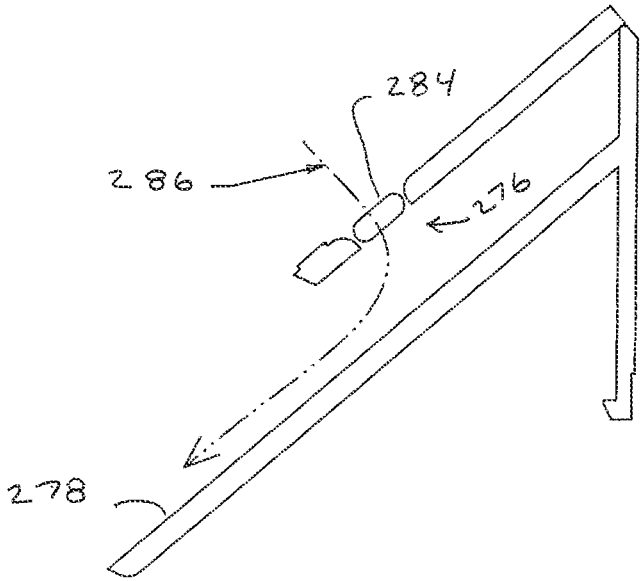
FIG 35

FIG 44
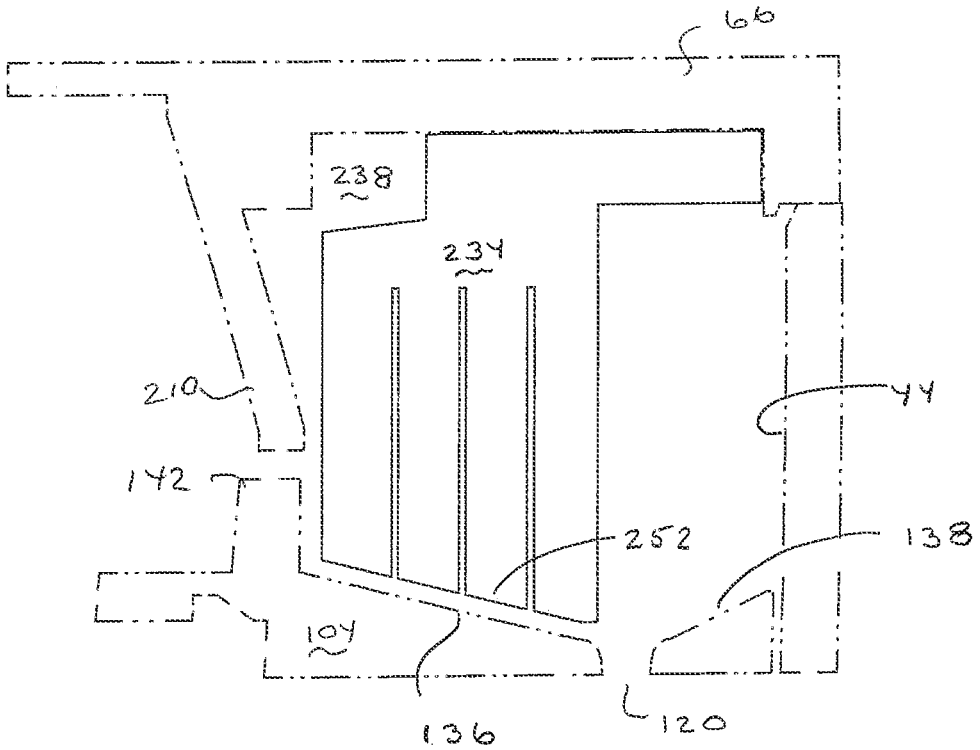
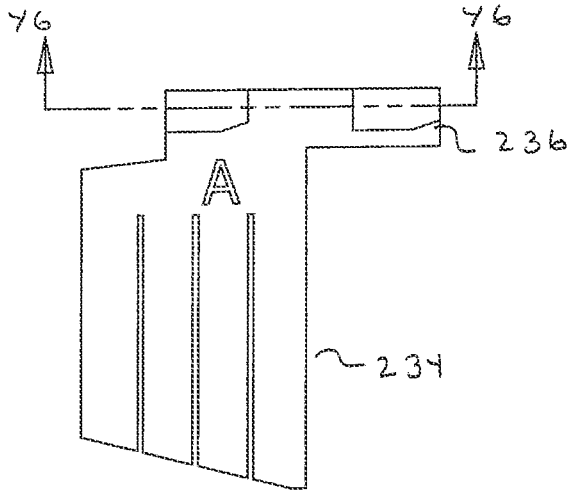
FIG 45
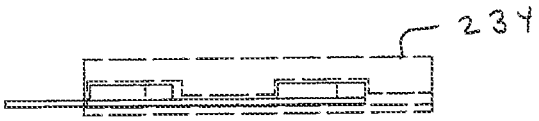
FIG 46

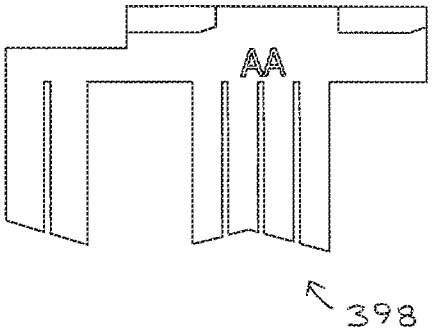
FIG 92
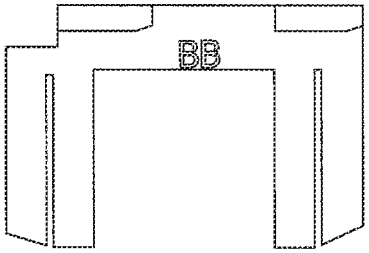
FIG 93
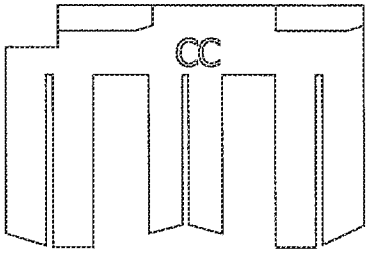
FIG 94
FIG 95
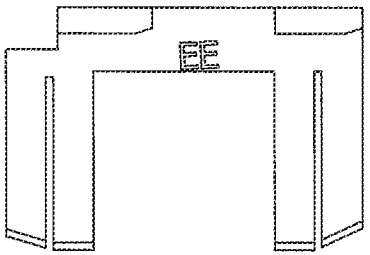
FIG 96
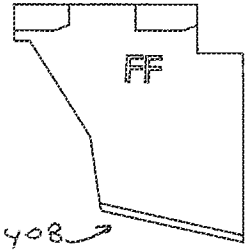
FIG 97
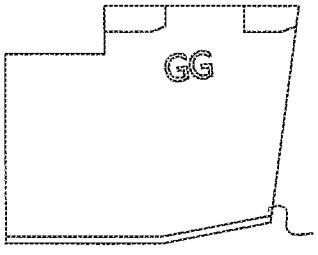
FIG 98

FIG 109
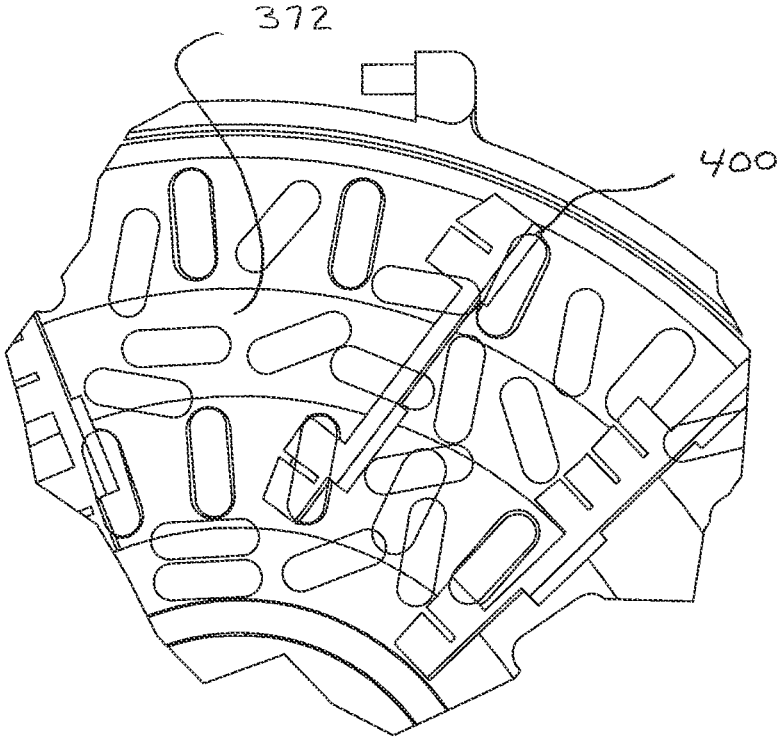
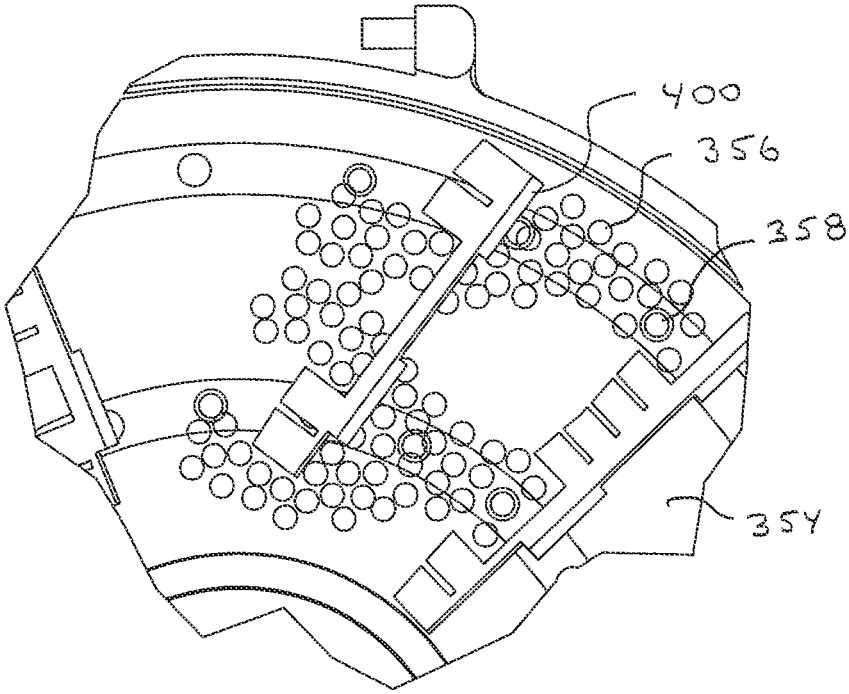
FIG 110

FIG 116
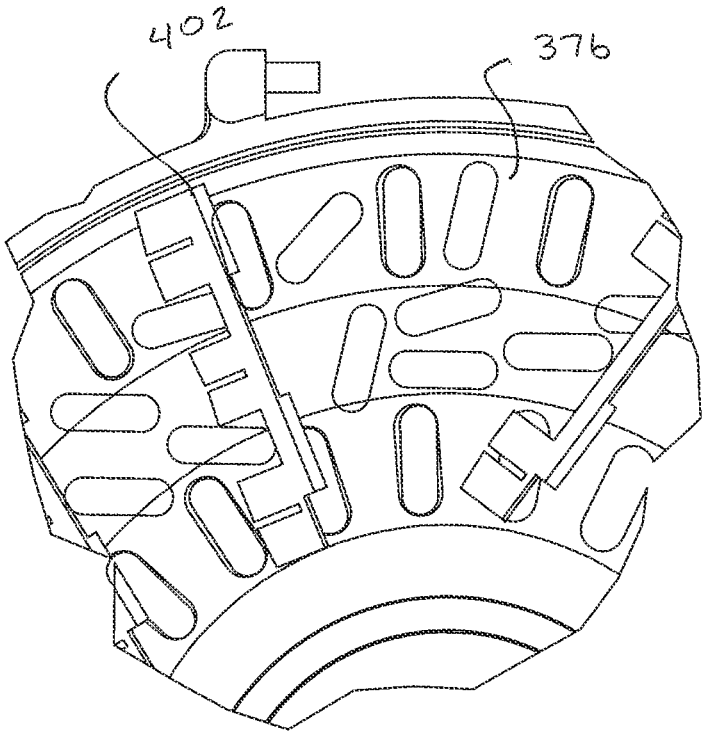
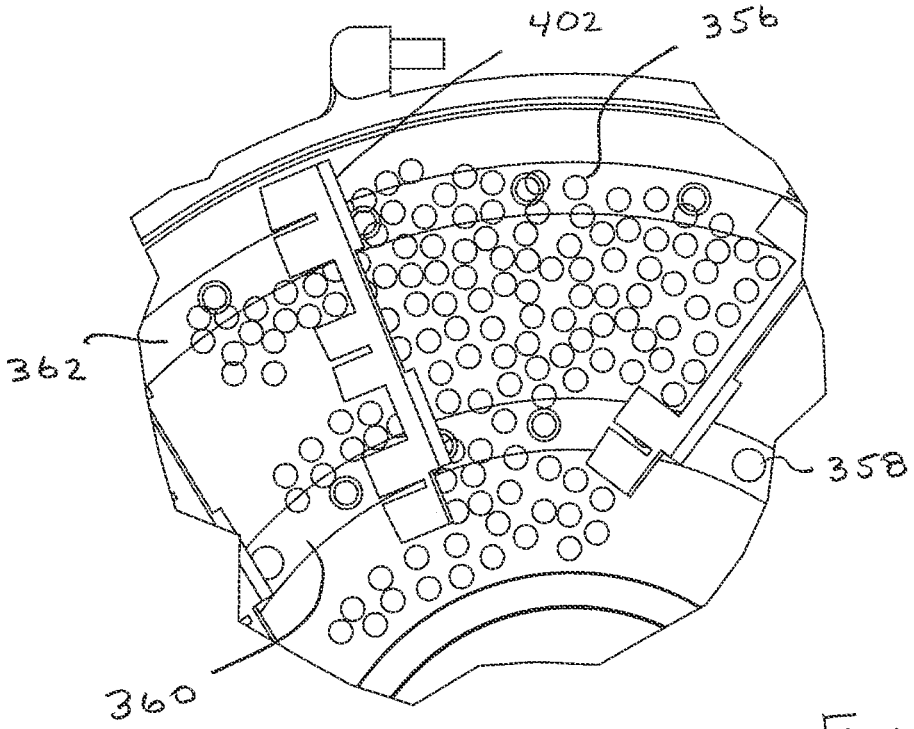
FIG 115

FIG 151
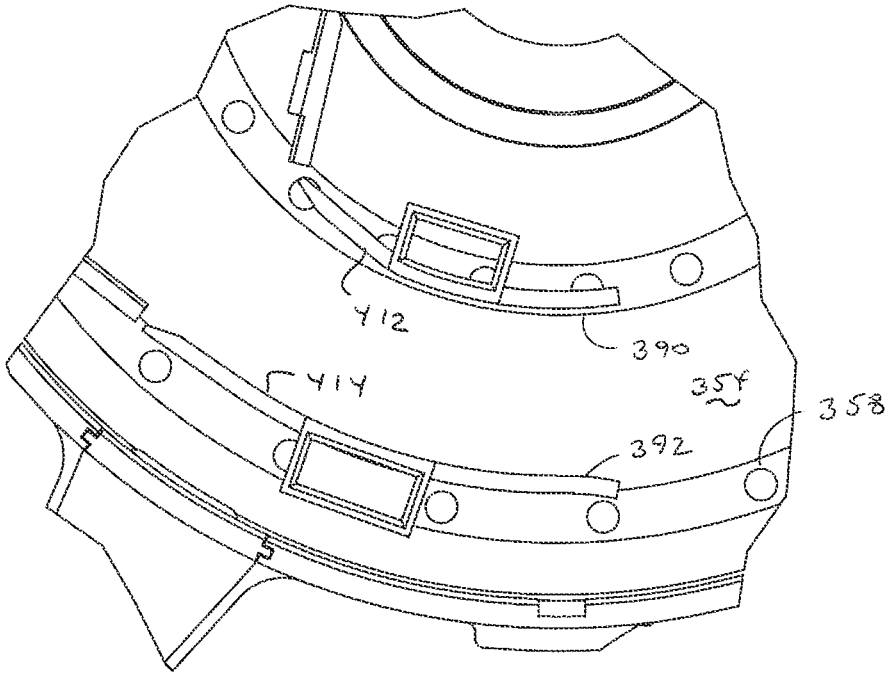
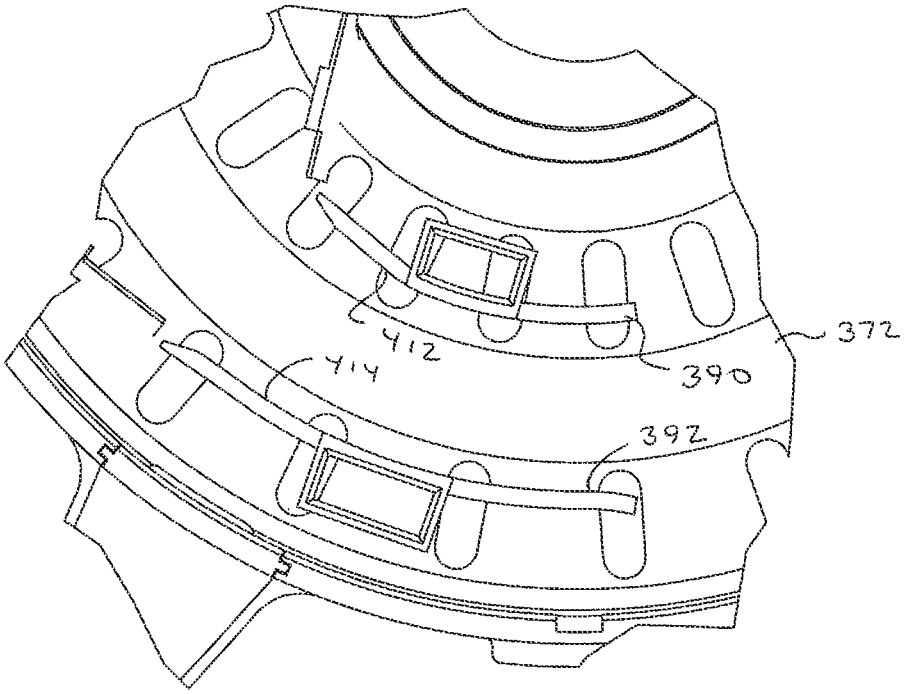
FIG 152

FIG 153
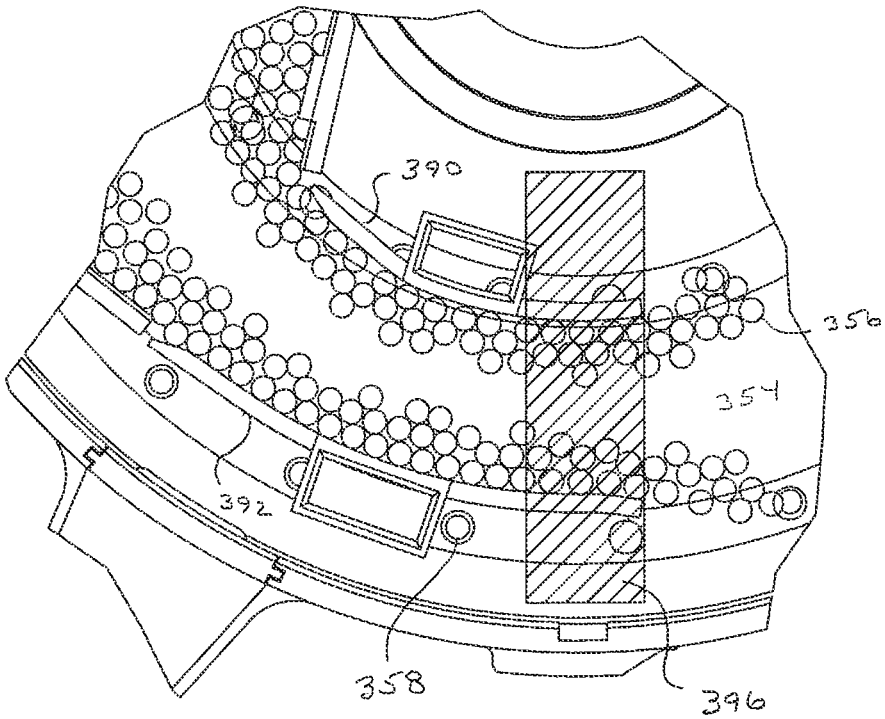
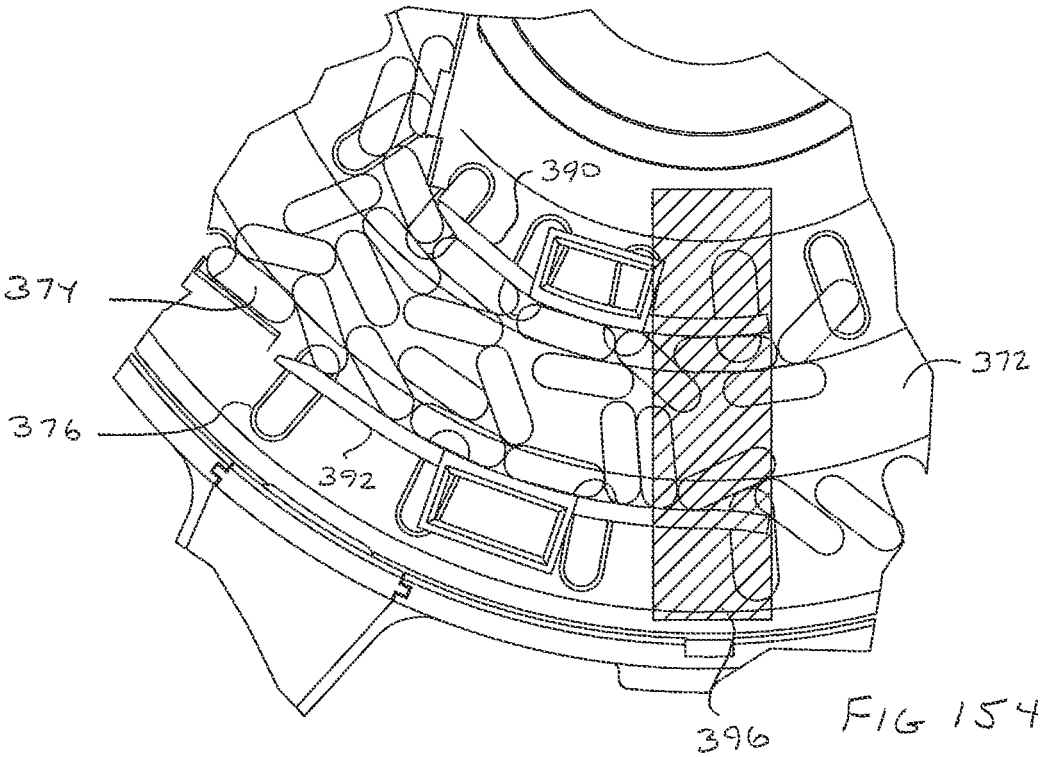
FIG 154

PILL FEED APPARATUS FOR PACKAGING MACHINE

TECHNICAL FIELD

Exemplary arrangements relate to packaging equipment. Exemplary arrangements specifically relate to an apparatus that is operative to separate and deliver pills or similar articles one at a time for packaging.

BACKGROUND

Solid medications such as pills of various shapes, capsules and caplets (all of which are referred to herein as pills) are commonly placed in unit dose packaging. This is done to protect the pills from contaminants until the medication is to be taken by the patient. Such packaging is also provided so that the packaging can be labeled with information about the medication.

To successfully place pills in unit dose packaging, the pills must be separated and delivered one at a time in a coordinated manner to a mechanism that encapsulates each pill within a unit dose package. In some exemplary arrangements pills are required to be moved and positioned by a human operator to place the pills into individual receptacles from which they can be extracted for packaging. An example of such a packaging machine is shown in U.S. Pat. No. 4,493,178, the disclosure of which is incorporated herein by reference in its entirety. Machines which operate using these principles are commercially available from Euclid Medical Products of Apple Creek, Ohio.

Unit dose packaging machines and other pill handling apparatus may benefit from improvements.

SUMMARY

Exemplary arrangements provide an apparatus that receives a batch comprising a plurality of loose pills and which operates to separate each pill from the others, and positions it in a respective receptacle which is alternatively referred to herein as a pill engaging aperture. The receptacles are moved in a coordinated manner so that each pill is delivered from the respective receptacle in which it is positioned into a mechanism that incorporates the pill into a unit dose package.

The exemplary arrangements are configured to operate with pills of numerous different sizes and shapes (for purposes of this disclosure different sizes of pills and different shapes of pills will each be referred to as different configurations). Further some exemplary arrangements are configured to be installed on existing unit dose medication packaging machines to eliminate the need for a human operator to move and position individual pills.

Additional features of exemplary arrangements will be made apparent in the following Detailed Description and the attached drawings.

BRIEF DESCRIPTION OF DRAWINGS

FIG. 10 is a back view of the base ring.

FIG. 11 is a side view of the base ring.

FIG. 14 is a top plan view of the drive platter.

FIG. 15 is a side view of the drive platter.

FIG. 19 is a top right perspective view of the exemplary drive pin.

FIG. 20 is a front view of the drive pin with a drive post which rotationally moves the drive pin shown in phantom.

FIG. 21 is a right side view of the drive pin and drive post.

FIG. 23 is a top view of the feeder disc shown in FIG. 22.

FIG. 24 is a cross-sectional view of the feeder disc taken along line 24-24 in FIG. 23.

FIG. 25 is a top plan view of another feeder disc which is configured to separate and deliver pills having a larger diameter than the feeder disc shown in FIGS. 22-24.

FIG. 26 is a cross-sectional view taken along line 26-26 in FIG. 25.

FIG. 27 is a top plan view of another feeder disc which is configured to separate and deliver pills having an elongated capsule configuration.

FIG. 28 is a cross-sectional view taken along line 28-28 in FIG. 27.

FIG. 30 is a top view of the inserter.

FIG. 31 is a front view of the inserter.

FIG. 32 is a bottom view of the inserter.

FIG. 34 is a front view of the exemplary pill sizer.

FIG. 35 is a cross-sectional view taken along lines 35-35 in FIG. 34.

FIG. 44 is a cross-sectional view along each of lines 44-44 in FIG. 43 and with the inserter and the feeder disc shown in phantom.

FIG. 45 is a front view of brush A and the mount portion thereof.

FIG. 46 is a cross-sectional view taken along line 46-46 in FIG. 45.

FIG. 92 is a front plan view of an exemplary brush used with the dual pill feed apparatus referred to for convenience herein as brush AA.

FIG. 93 is a front plan view of an exemplary brush used in the dual pill feed apparatus referred to for convenience herein as brush BB.

FIG. 94 is a front plan view of an exemplary brush used in the dual pill feed apparatus referred to for convenience herein as brush CC.

FIG. 95 is a front plan view of an exemplary brush used in the dual pill feed apparatus referred to for convenience herein as brush DD.

FIG. 96 is a front plan view of an exemplary brush used in the dual pill feed apparatus referred to for convenience herein as brush EE.

FIG. 97 is a front plan view of an exemplary brush used in the dual pill feed apparatus referred to for convenience herein as brush FF.

FIG. 98 is a front plan view of an exemplary brush used in the dual pill feed apparatus referred to for convenience herein as brush GG.

FIG. 109 is a top transparent view of the exemplary dual pill feed apparatus and brush BB configured for engaging pills in the configuration of capsules.

FIG. 110 is a top transparent view of the exemplary dual pill feed apparatus and brush BB configured for engaging circular pills.

FIG. 115 is a top transparent view of brush CC engaged with circular pills.

FIG. 116 is a top transparent view of brush CC engaged with pills having the configuration of capsules.

FIG. 120 is a cross-sectional view taken along lines 120-120 in FIG. 119.

FIG. 121 is a top transparent view of the dual pill feed mechanism with circular pills in engagement with brush DD.

FIG. 122 is a top transparent view of the dual pill feed mechanism with pills having the configuration of capsules in engagement with brush DD.

FIG. 123 is a top transparent view of the exemplary dual pill feed apparatus.

FIG. 124 is a cross-sectional view taken along line 124-124 in FIG. 123.

FIG. 125 is a front view of brush EE including the mount portion thereof.

FIG. 126 is a cross-sectional view taken along line 126-126 in FIG. 125.

FIG. 127 is a top transparent view of the exemplary dual pill feed apparatus showing brush EE in engagement with circular pills.

FIG. 128 is a top transparent view of the exemplary dual pill feed apparatus showing brush EE in engagement with pills that are configured as capsules.

FIG. 129 is a top transparent view of the exemplary dual pill feed apparatus.

FIG. 130 is a cross-sectional view taken along line 130-130 in FIG. 129.

FIG. 131 is a front view of brush FF including the mount portion thereof.

Figure 131:
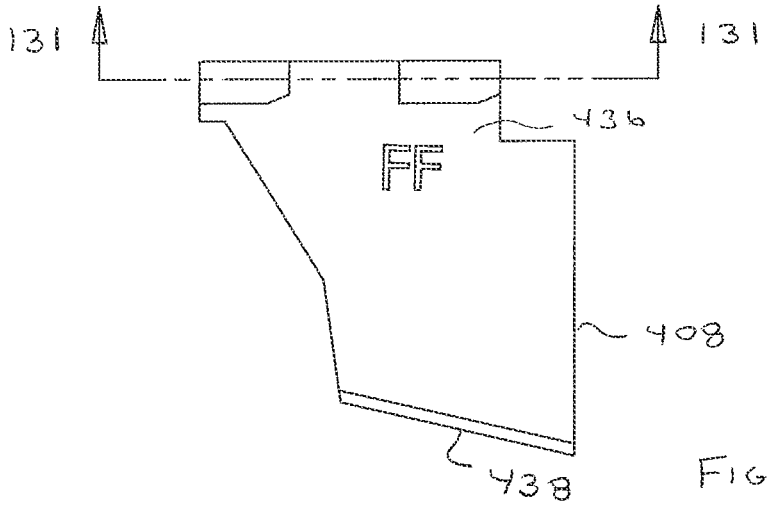
Figure 132:
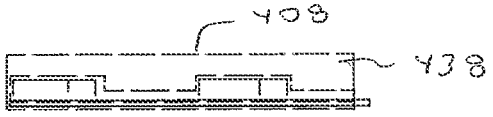

FIG. 132 is a cross-sectional view taken along line 132-132 in FIG. 131.

Figure 133:
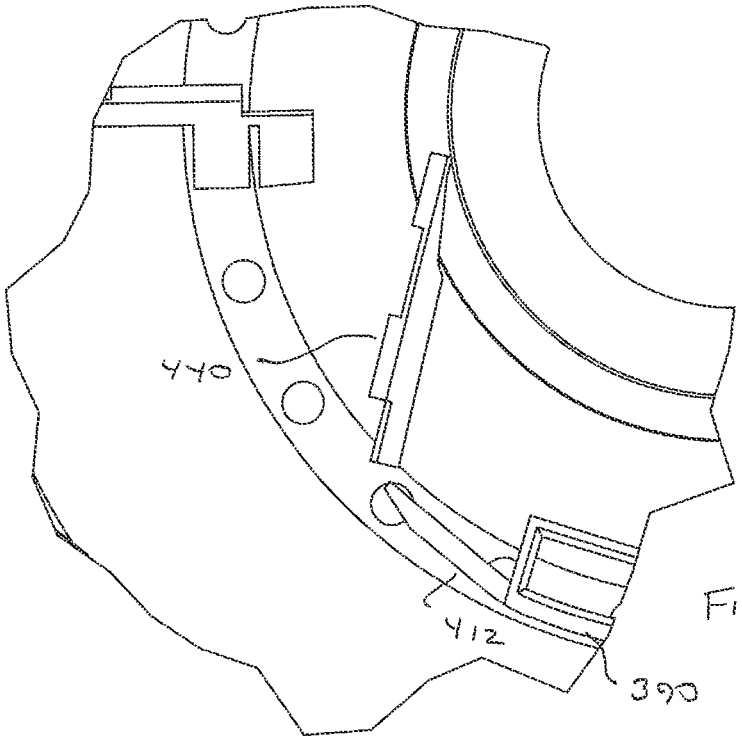

FIG. 133 is a top transparent view of the exemplary dual pill feed apparatus with brush FF extending in overlying relation of a feeder disc configured for feeding circular pills.

Figure 134:
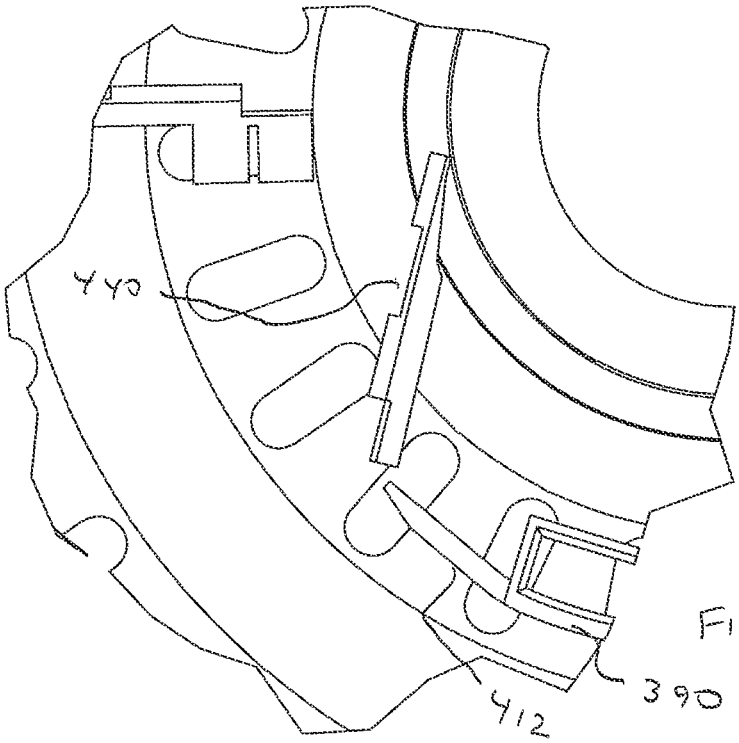

FIG. 134 is a top transparent view similar to FIG. 133 with brush FF extending in overlying relation of a feeder disc configured for feeding pills having a capsule configuration.

Figure 135:
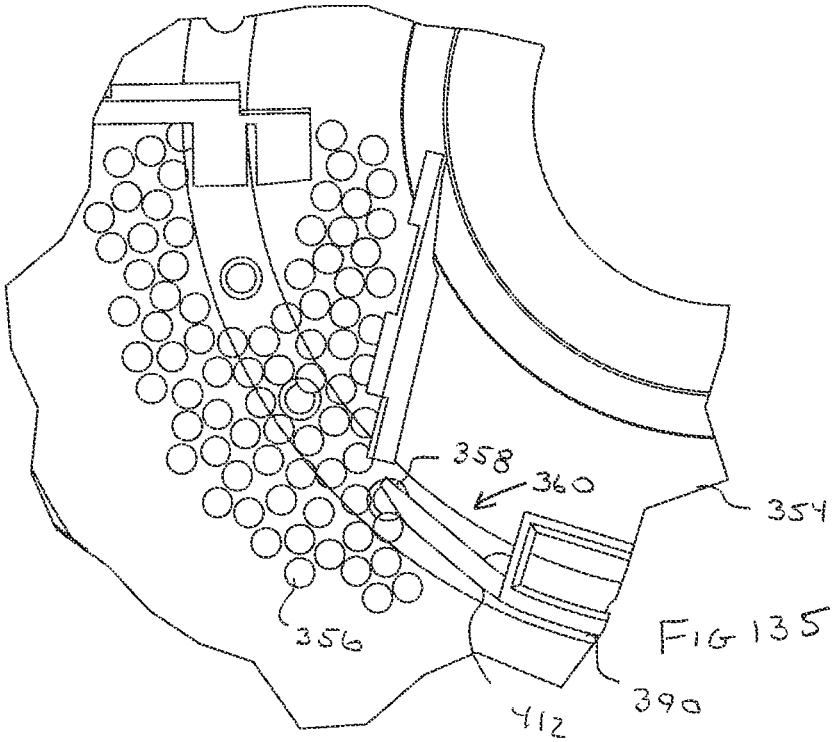

FIG. 135 is a view similar to FIG. 133 showing brush FF in engagement with circular pills.

Figure 136:
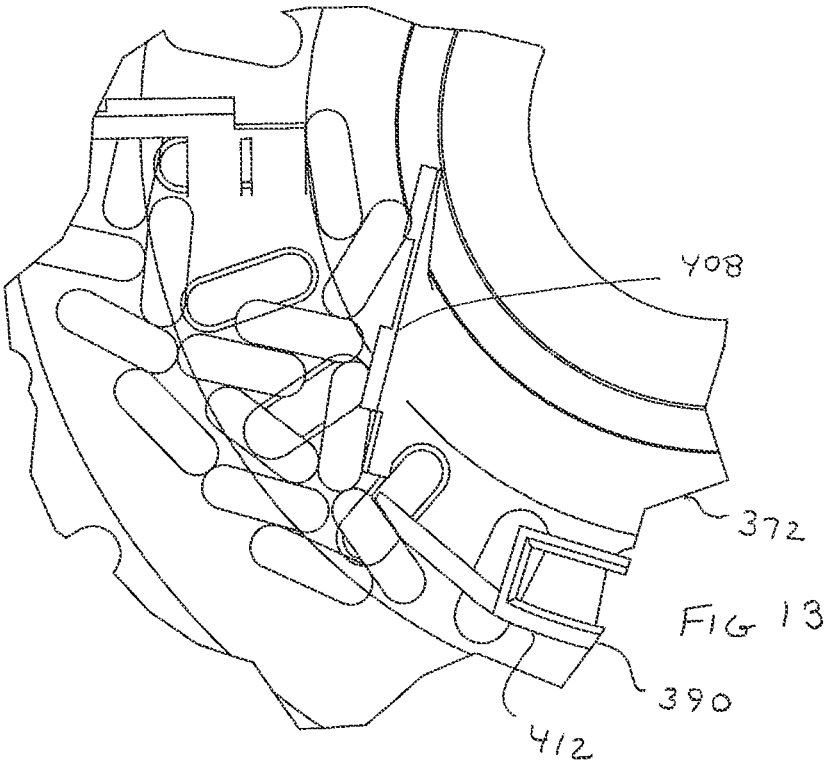

FIG. 136 is a view similar to FIG. 134 showing brush FF in engagement with pills having the configuration of capsules.

Figure 137:
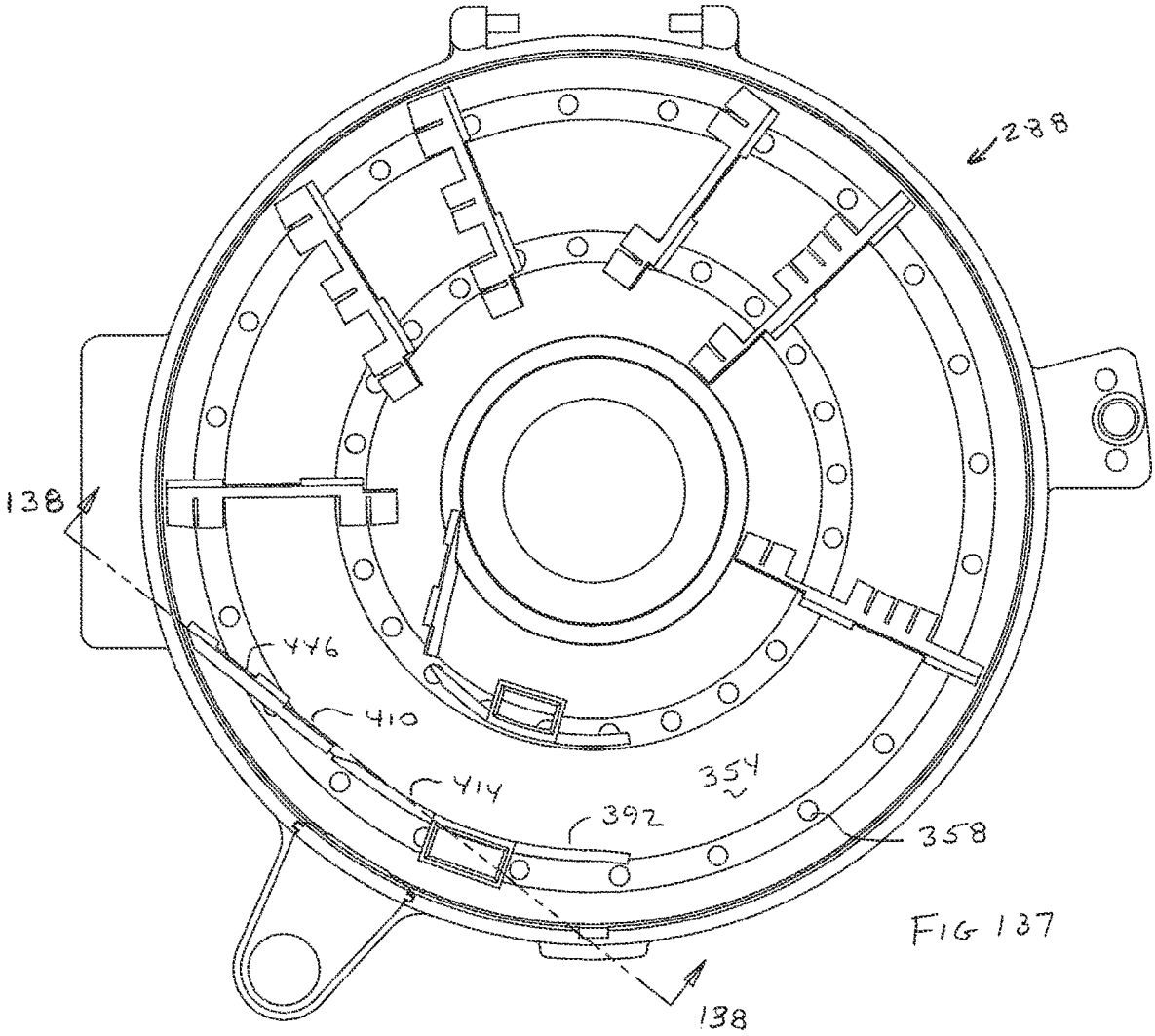

FIG. 137 is a top transparent view of the exemplary dual pill feed apparatus.

Figure 138:
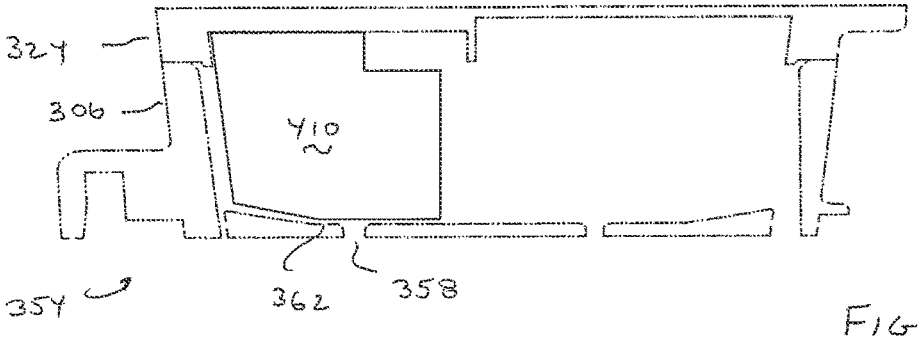

FIG. 138 is a cross-sectional view taken along line 138-138 in FIG. 137.

Figure 139:
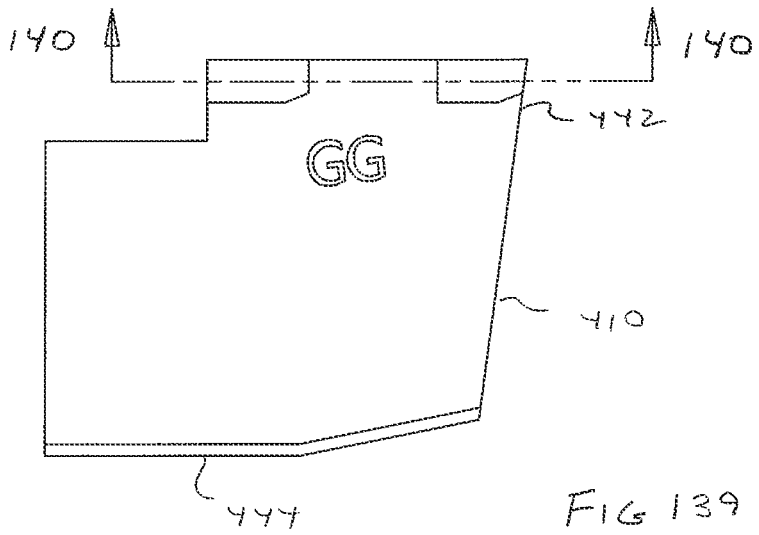

FIG. 139 is a front view of brush GG including the mount portion thereof.

Figure 140:
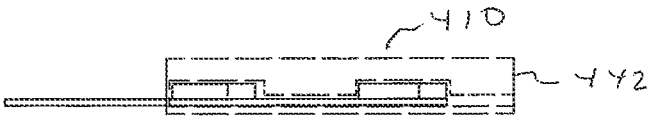

FIG. 140 is a cross-sectional view taken along line 140-140 in FIG. 139.

Figure 141:
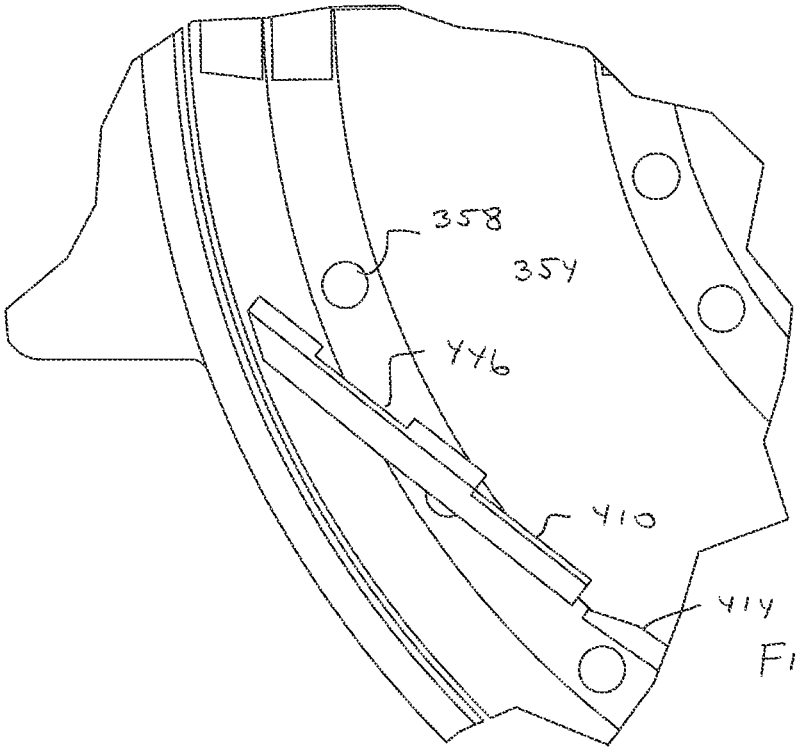

FIG. 141 is a top transparent view showing brush GG in overlying relation of a feeder disc configured for feeding circular pills.

Figure 142:
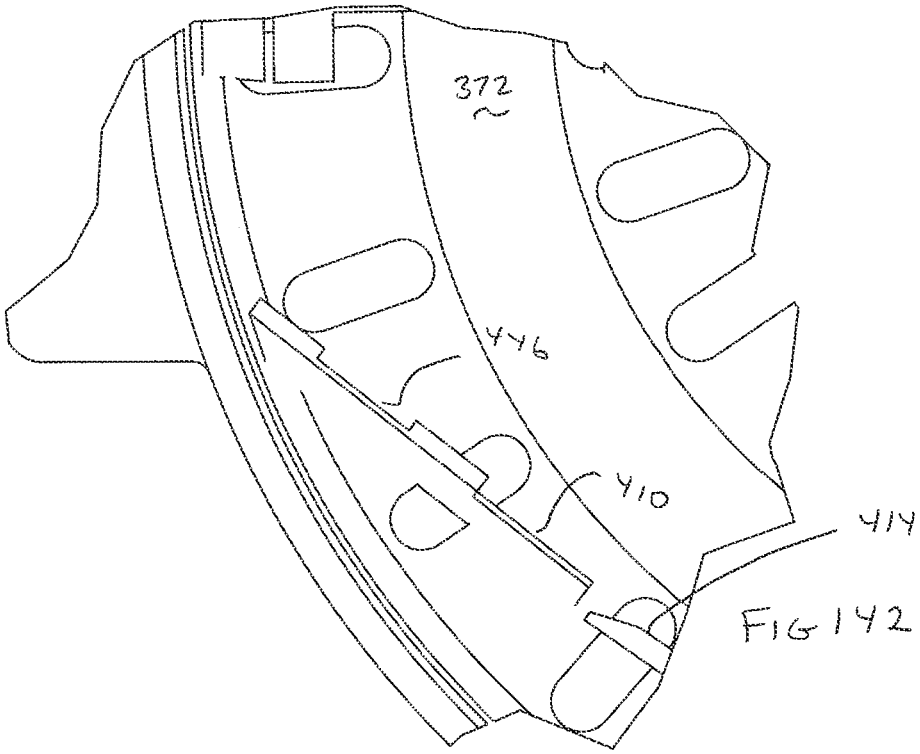

FIG. 142 is a top transparent view showing brush GG in overlying relation of a feeder disc configured for feeding pills having the configuration of capsules.

Figure 143:
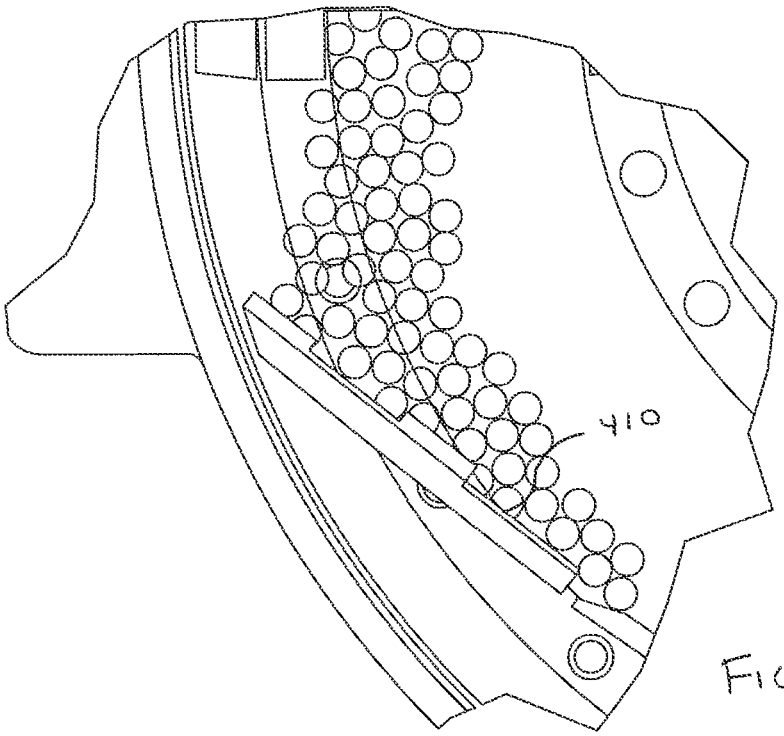

FIG. 143 is a top transparent view similar to FIG. 141 showing brush GG in engagement with circular pills.

Figure 144:
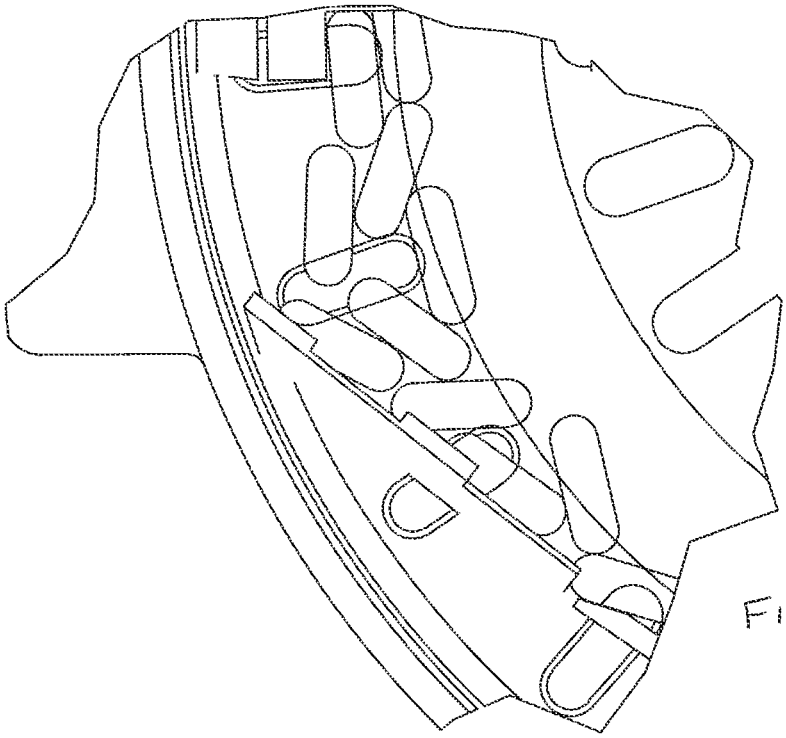

FIG. 144 is a view similar to FIG. 142 showing brush GG in engagement with pills having the configuration of capsules.

Figure 145:
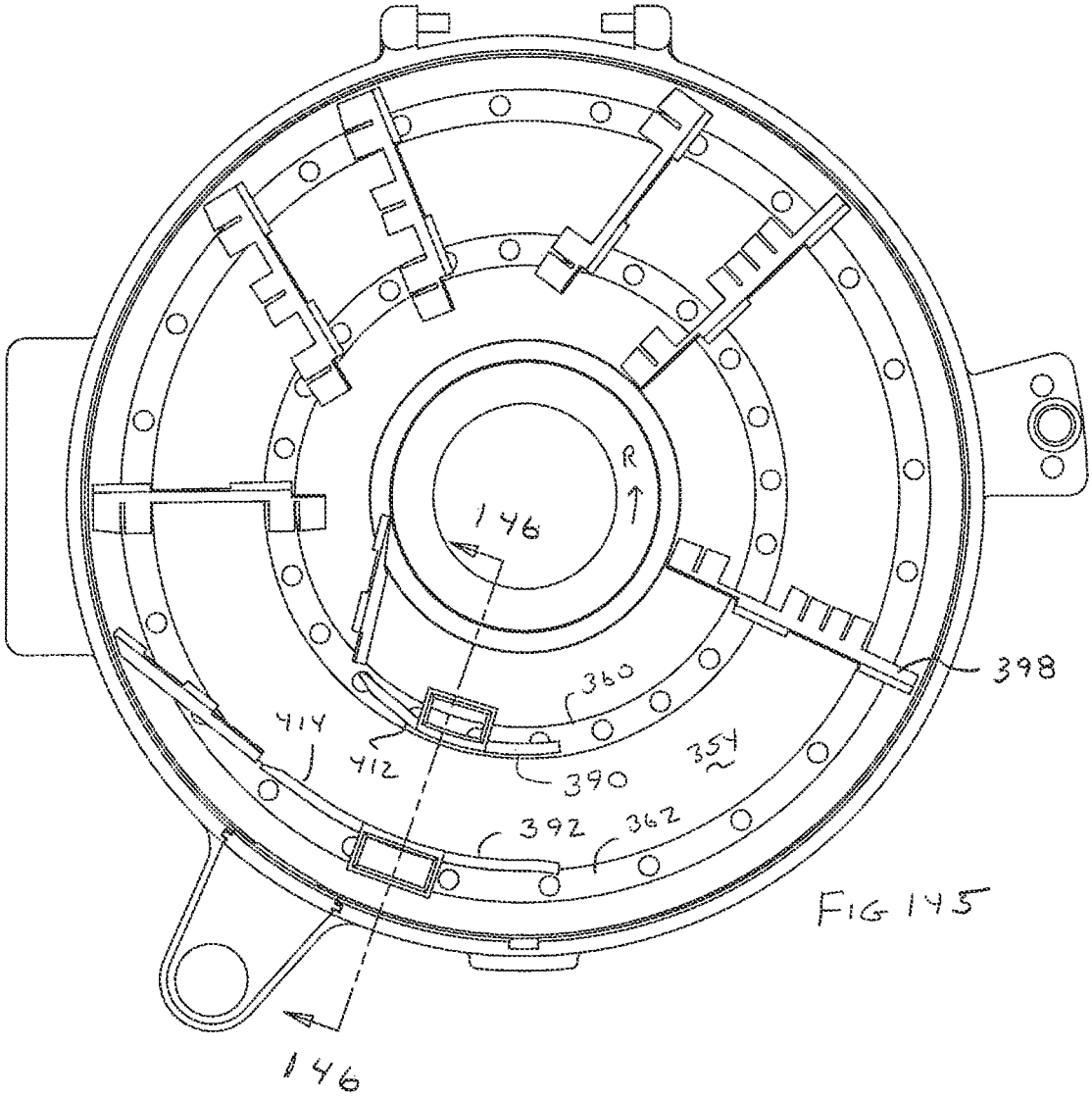

FIG. 145 is a top transparent view of the exemplary dual pill feed apparatus.

Figure 146:
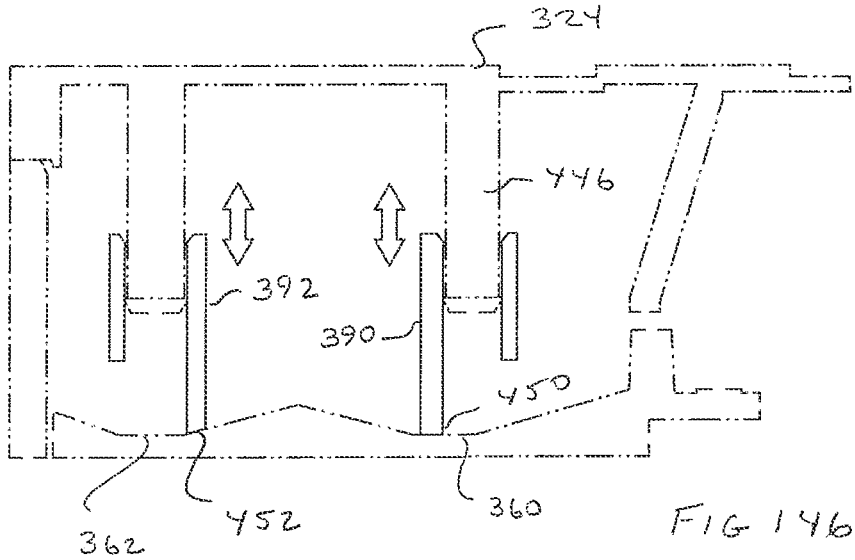

FIG. 146 is a cross-sectional view taken along line 146-146 in FIG. 145 and showing the inner diverter and the outer diverter in cross-section.

Figure 147:
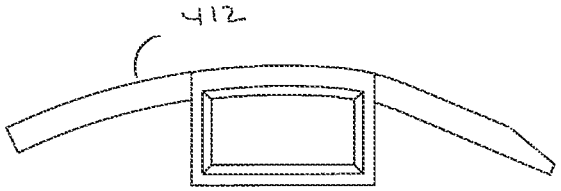

FIG. 147 is a top view of the exemplary inner diverter.

Figure 148:
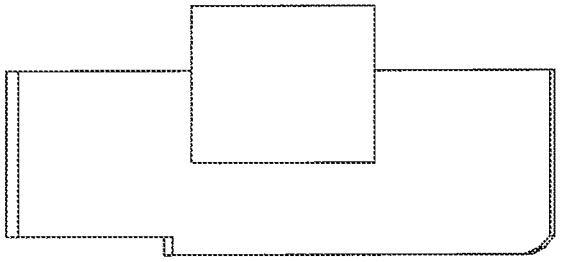

FIG. 148 is a side view of the exemplary inner diverter.

Figure 149:
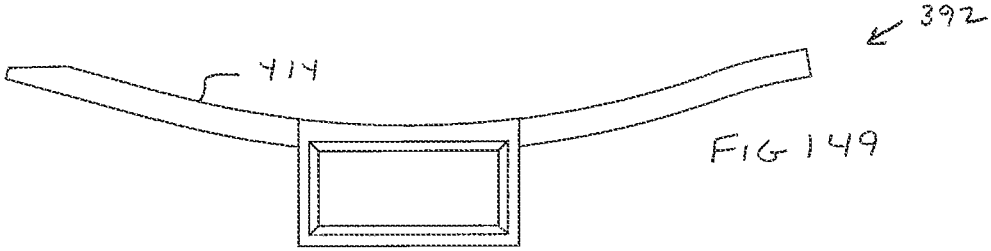

FIG. 149 is a top view of the exemplary outer diverter.

Figure 150:
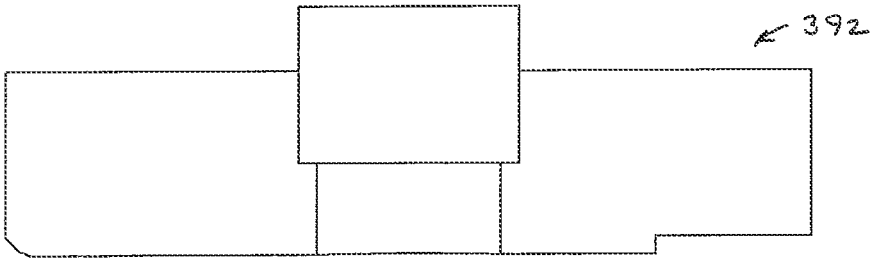

FIG. 150 is a side view of the exemplary outer diverter.

FIG. 151 is a top transparent view of the inner and outer diverters in overlying relation of a dual feeder disc configured for feeding circular pills.

FIG. 152 is a view similar to FIG. 151 showing the inner and outer diverters in overlying relation of a dual feeder disc configured for feeding pills in the configuration of capsules.

FIG. 153 is a top transparent view showing the inner and outer diverters in engagement with circular pills.

FIG. 154 is a top transparent view showing the inner and outer diverters in engagement with pills having the configuration of capsules.

DETAILED DESCRIPTION

Figure 1:
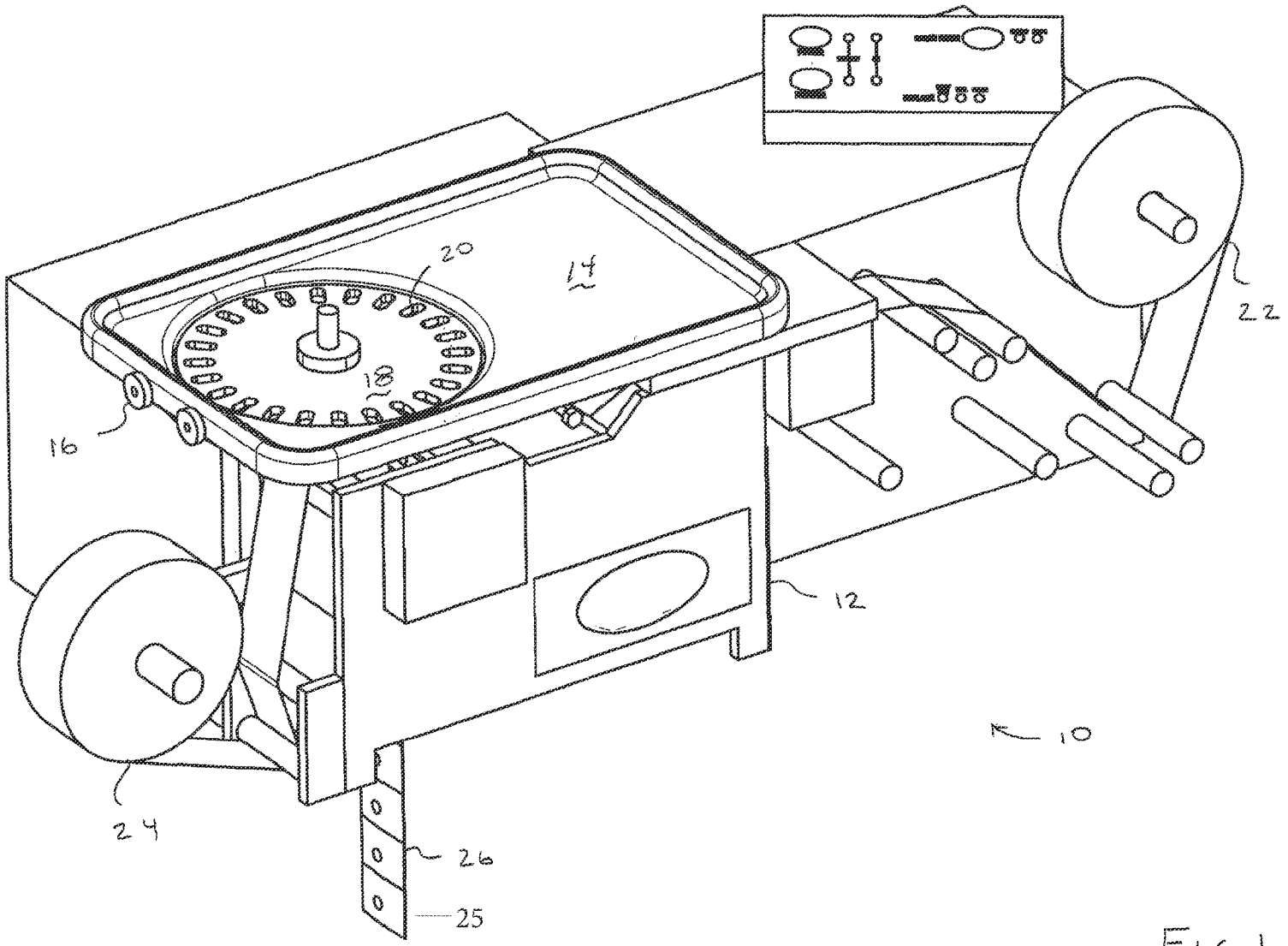
FIG 1 (PRIOR ART)
FIG. 1 is a front left perspective view of a prior art unit dose packaging machine for solid medications.
Figure 2:
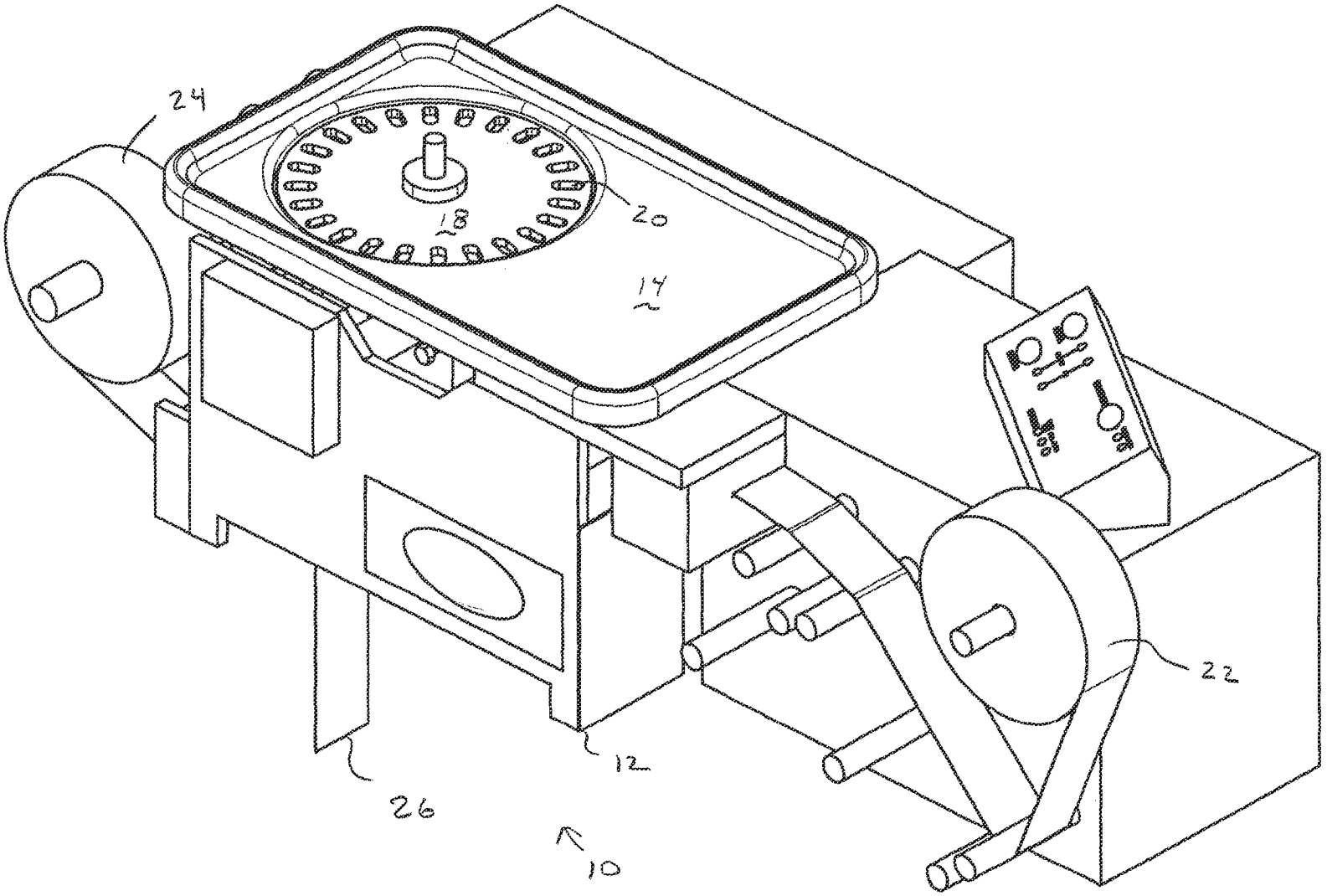
FIG. 2 is a front right perspective view of the prior art machine shown in FIG. 1.

Referring now to the drawings and particularly to FIG. 1 there is shown therein an exemplary unit dose pill packaging machine 10 of a prior art configuration. The exemplary packaging machine 10 includes features described in the incorporated disclosure. The exemplary machine includes a body 12. A pill supporting tray 14 is releasably connected to the body 12 by fasteners 16. A rotatable pill disc 18 includes a plurality of apertures 20 therein. The apertures 20 are sized for each receiving a respective individual pill therein. All the apertures of the pill disc are configured for receiving the same size and configuration of pill.

The body 12 of the exemplary machine 10 is configured to support a first roll 22 of packaging material thereon. The body of the machine is also configured to support a second roll 24 of packaging material. The exemplary materials of the rolls 22 and 24 are configured to be joined together to produce a strip 26 of unit dose packages 25 each of which houses a single pill. In exemplary arrangements the materials are joined by suitable adhesive materials and/or heat welding to encapsulate pills in the unit dose packages in air tight relation. Further in exemplary arrangements the strip may be perforated so that each unit dose package 25 can be readily separated from the others in the strip. The exemplary machine further includes a thermal transfer printhead or other suitable printing device that enables printing indicia on the unit dose packages.

Figure 3:
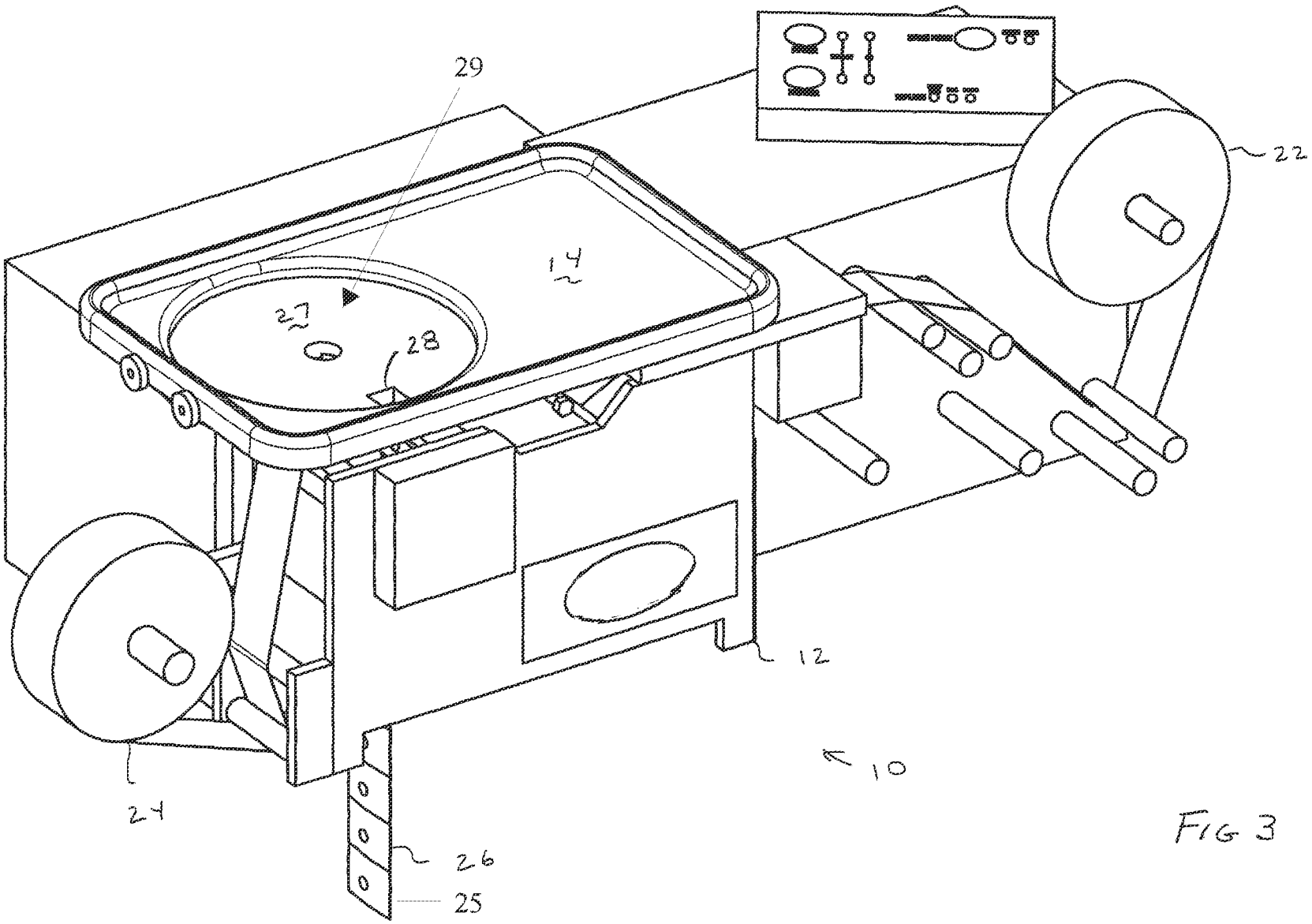
FIG. 3 is a front left perspective view of the machine of FIG. 1 with its manual fill pill disc removed.
Figure 4:
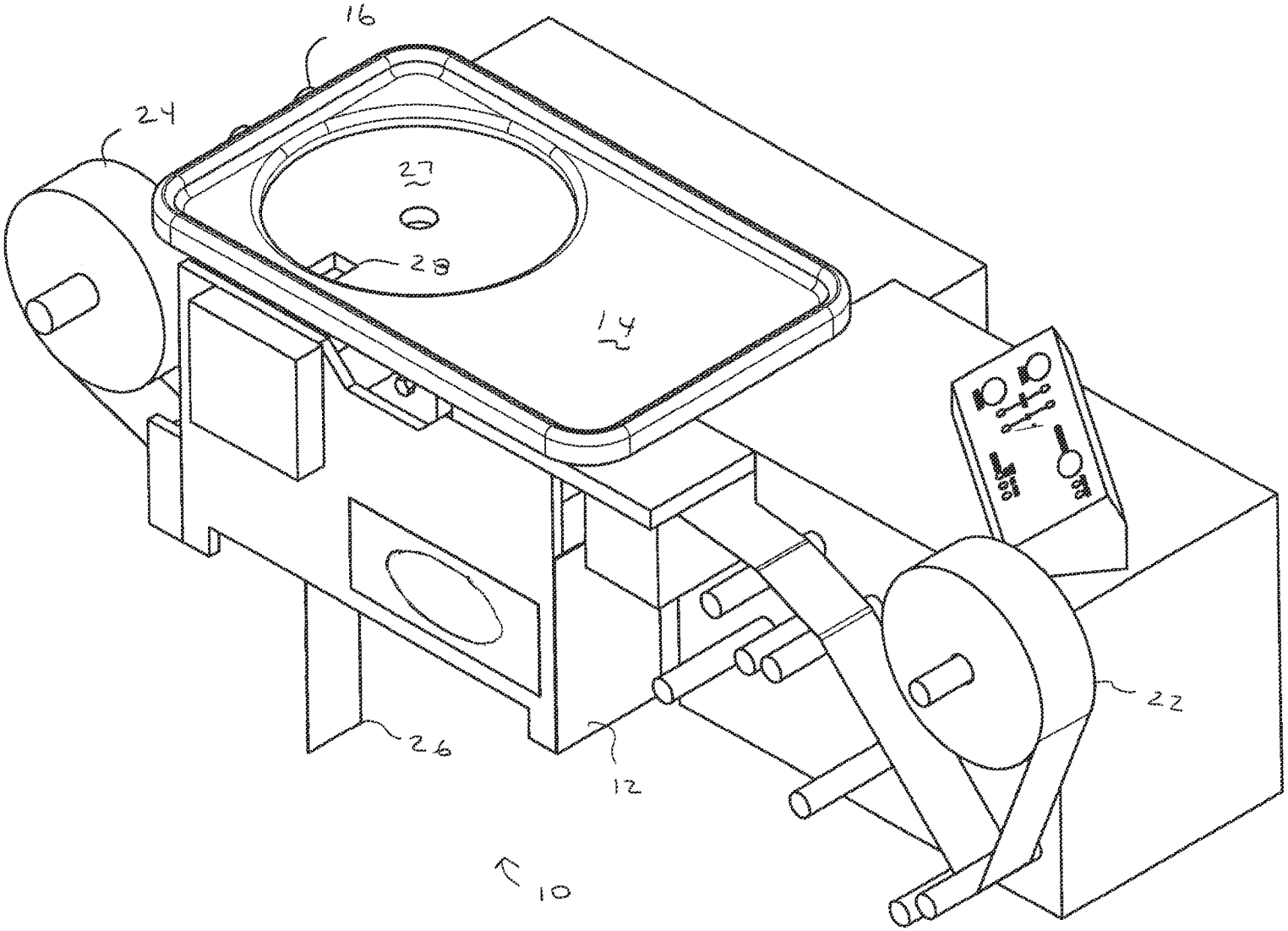
FIG. 4 is a front right perspective view of the machine with the pill disc removed.

In the exemplary operation of the machine 10 a human operator places a plurality of pills in supported connection with the tray 14. The operator then uses a suitable instrument to manipulate the pills such that each pill is engaged in one of the apertures 20. Pills positioned in the apertures are separated on a top surface of a support plate 27. The exemplary support plate has a plate upper surface 29. The pill disc 18 rotates in an indexing manner such that each aperture is placed in overlying relation of a drop opening 28 as shown in FIG. 3. When a respective aperture of the pill disc 18 rotates so as to be placed in aligned relation with the drop opening, the pill in the aperture falls into an area of a mechanism within the machine in which the pill is encapsulated between the strips of packaging material, sealed and integrated into a unit dose package 25 in the strip 26.

Packaging machines of the type shown will commonly operate to package about 60 pills per minute. As a result the human operator must be skilled in the manipulation of the pills in order to assure that the apertures are filled so that the unit dose packages are produced.

Figure 5:
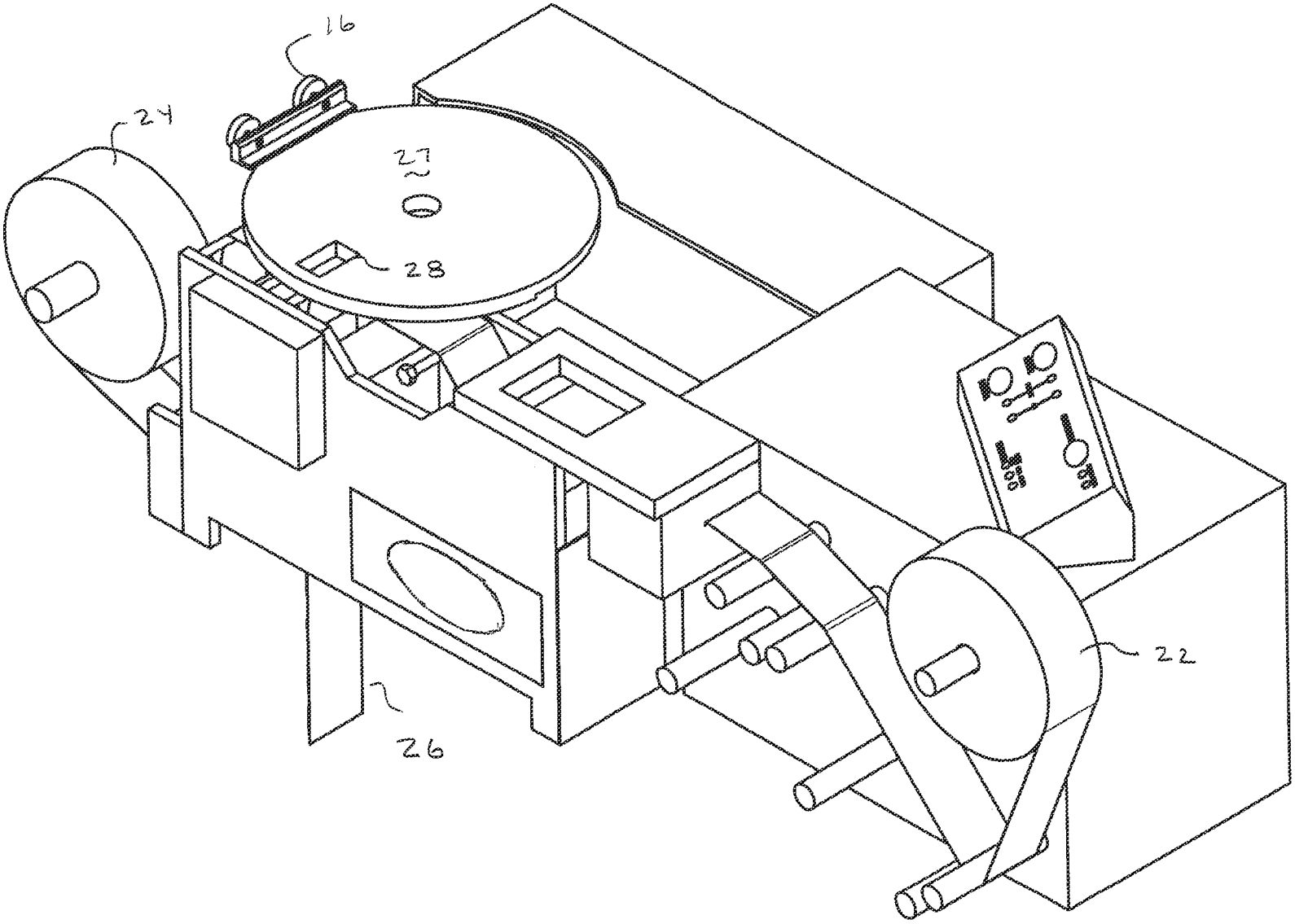
FIG. 5 is a front right perspective view of the machine with its pill disc and pill supporting tray removed.

As represented in FIG. 3 at least some exemplary prior art machines include removable pill discs which can be interchanged with pill discs with apertures that accommodate pills of other configurations. As a result some exemplary prior art machines can be reconfigured to produce single dose packages of pills of different types. Further in exemplary arrangements the tray 14 on which the pills are supported prior to being engaged in the apertures of the pill disc is also removable through disengagement of the fasteners 16 as shown in FIG. 5. Of course it should be understood that this configuration is exemplary and in other arrangements other machine configurations, structures and operations may be utilized.

Figure 6:
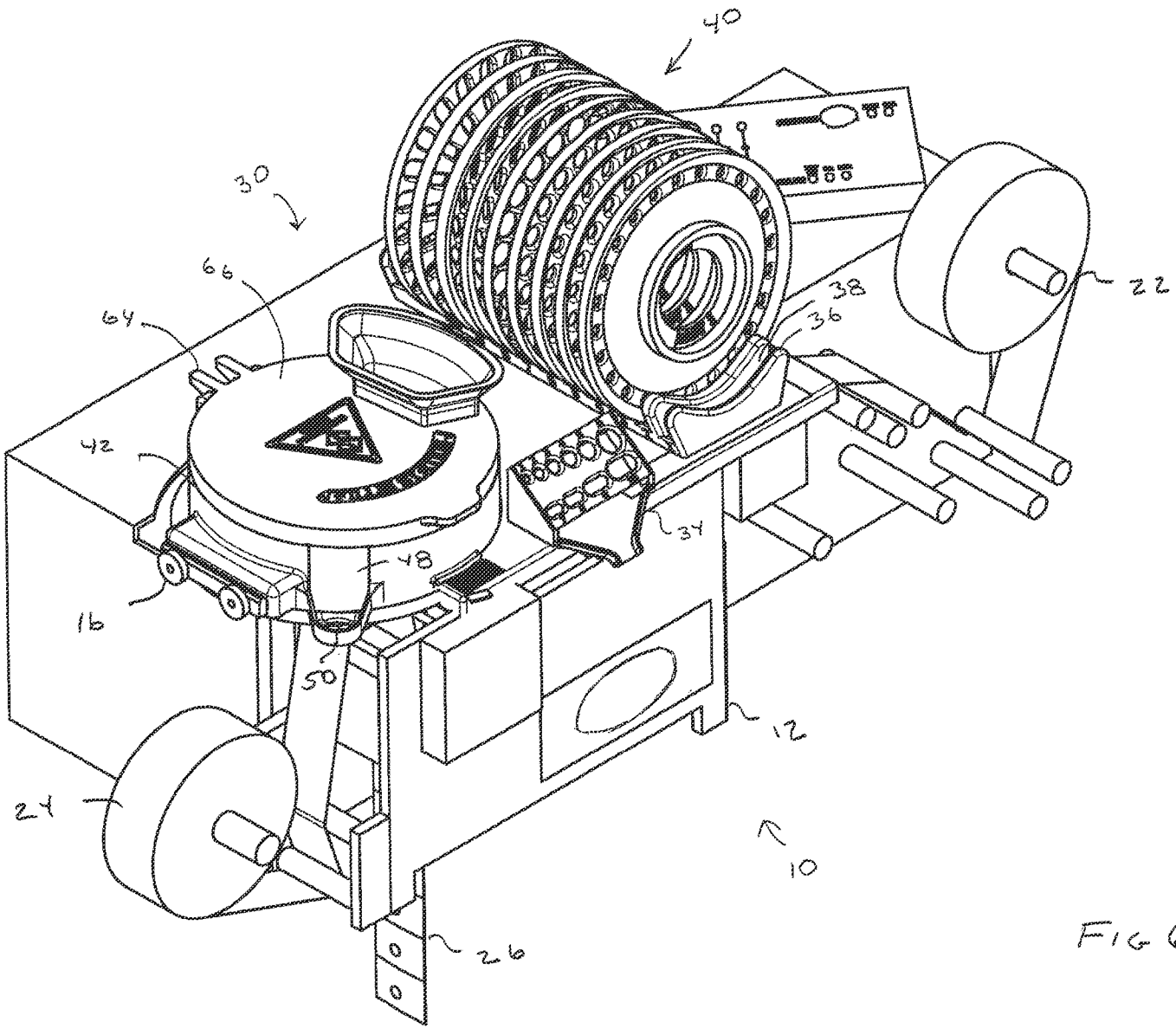
FIG. 6 is a front left perspective view of the unit dose packaging machine of FIG. 1 with the pill disc and pill supporting tray replaced with a pill feed apparatus of an exemplary arrangement.

The pill disc 18 and pill supporting tray 14 may be removed from an exemplary prior art machine and replaced with a pill feed apparatus 30 of an exemplary arrangement which is shown in FIG. 6. The exemplary apparatus enables a plurality of pills to be automatically separated and individually delivered into the existing packaging mechanism of the packaging machine so that the pills are included in unit dose packages. The exemplary pill feed apparatus is engaged with the machine 10 through the existing releasable fasteners 16. The exemplary apparatus facilitates the reliable delivery and packaging of pills having various configurations. The exemplary apparatus further reduces the effort required by the operator to successfully operate the packaging machine. Further the exemplary arrangement makes it easier to change the machine operation from one pill configuration to another while minimizing potential errors.

Figure 7:
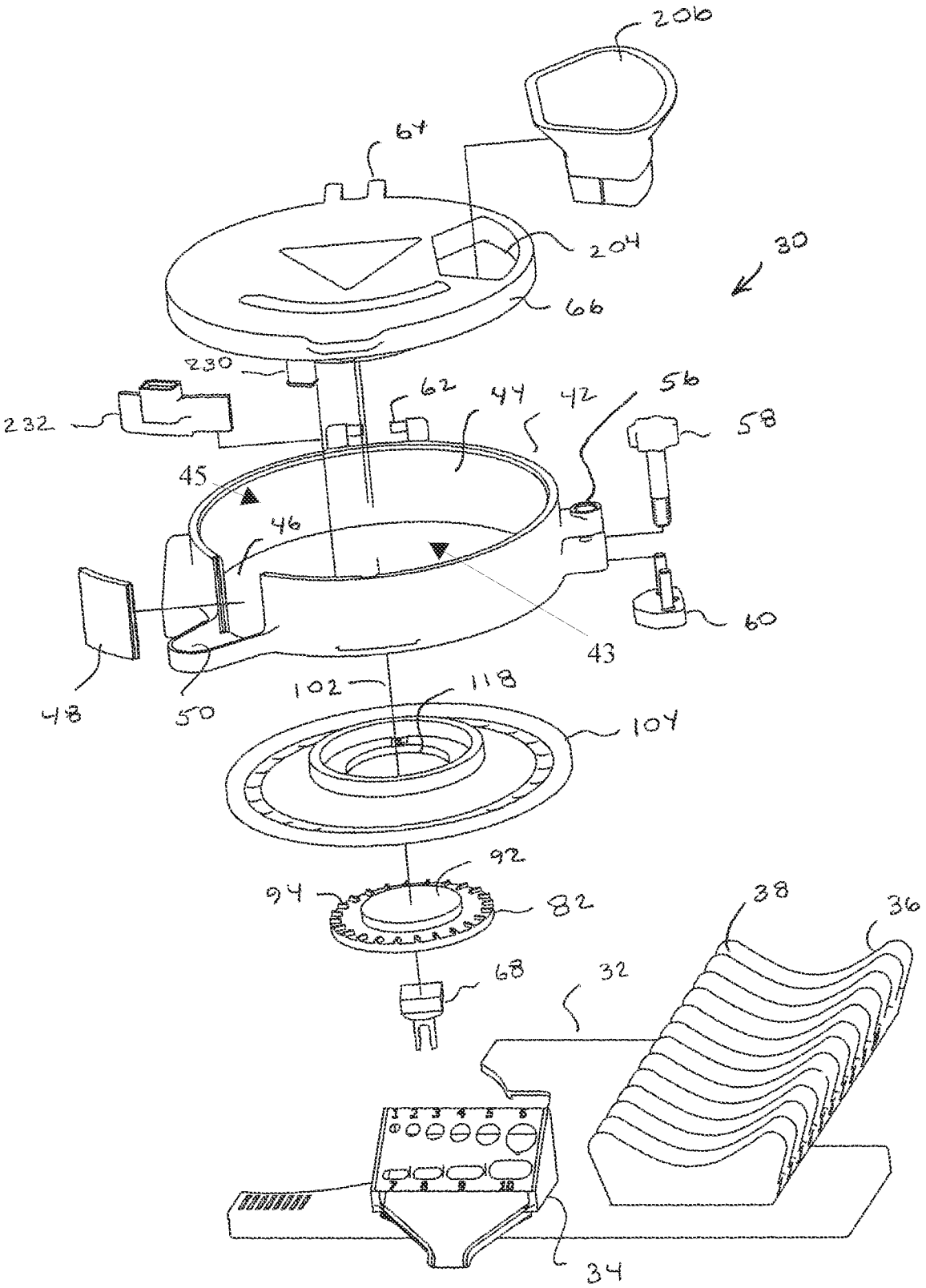
FIG. 7 is an exploded view of the pill feed apparatus shown in FIG. 6.

As shown in FIG. 7 the exemplary pill feed apparatus includes a deck 32. The deck 32 is engageable with the upper surface of the machine 10. The exemplary deck 32 is positioned in place of the prior tray 14. The exemplary deck 32 has in attached connection therewith a pill sizer 34 which is later discussed in detail. The pill sizer is usable by an operator to determine the particular feeder disc to be used with a particular pill configuration. The deck further includes in operative connection therewith a plurality of disc holders 36. The exemplary disc holders 36 include a plurality of aligned feeder disc accepting recesses 38. A respective feeder disc among the plurality of discs 40 that are usable in the machine, may be stored in the respective recess as shown in FIG. 6.

Figure 8:
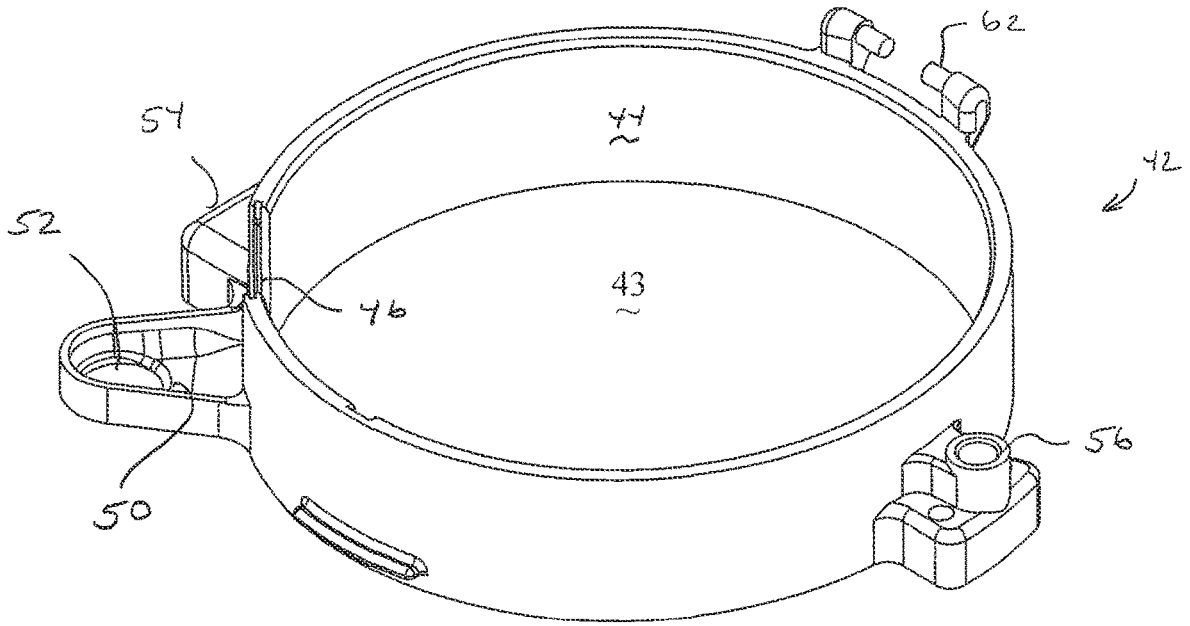
FIG. 8 is a top front perspective view of an exemplary base ring of the exemplary pill feed apparatus.
Figure 9:
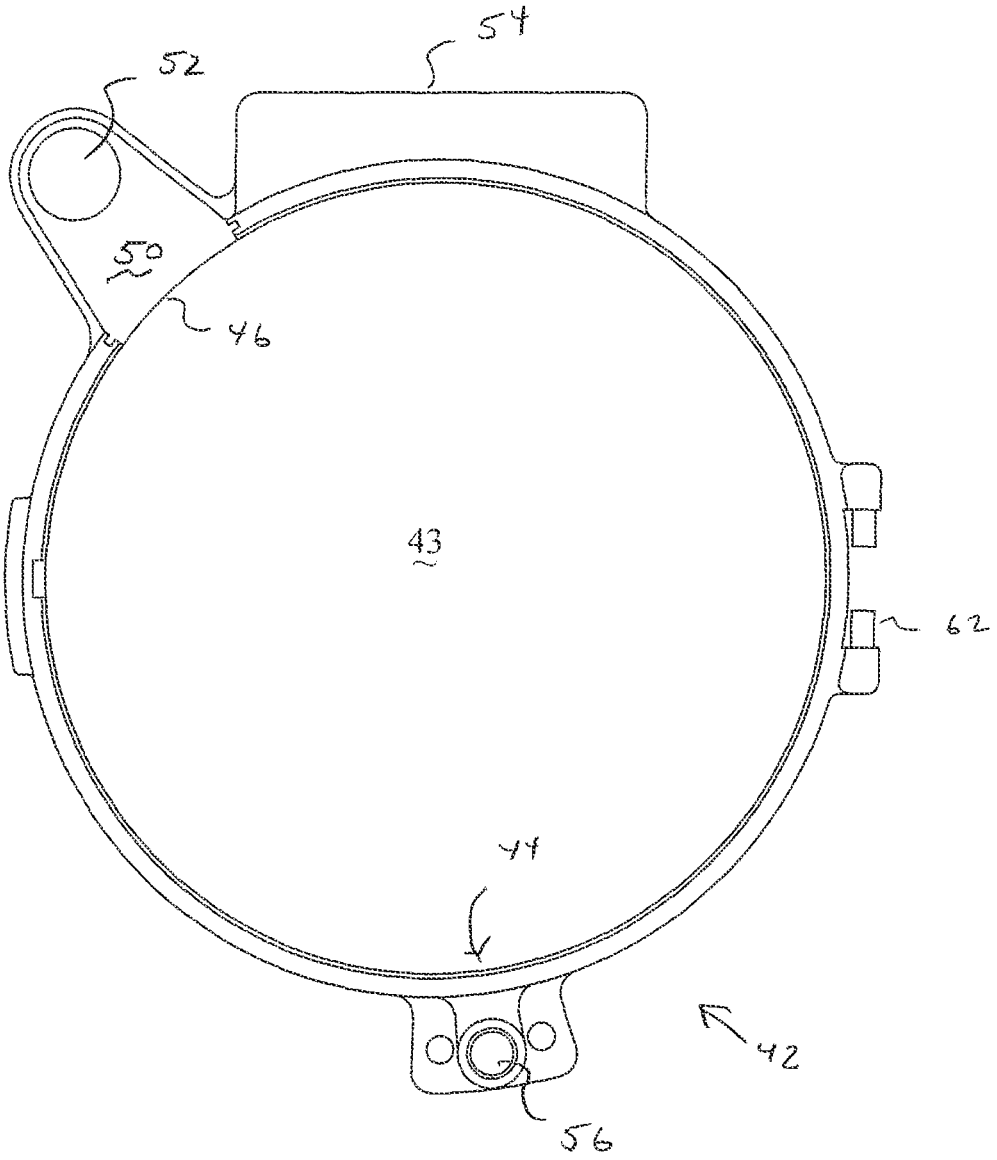
FIG. 9 is a top view of the base ring.

The exemplary pill feed apparatus 30 further includes an annular base ring 42 which is alternatively referred to herein as a base. The exemplary base ring 42 includes a generally circular annular internal wall 44 as shown in FIG. 8. When used herein generally circular means that the majority of the item referred to has a circular shape. The exemplary base ring 42 further includes a clean out opening 46 that extends radially through the annular wall 44. The exemplary clean out opening 46 is sized to be closed by a removable access cover 48 during operation of the assembly. The side walls of the exemplary access cover and the walls bounding the clean out opening include interengaging projections and recesses. This exemplary releasable engaging mechanism enables the access cover to be held in the opening 46, and readily removed by relative upward movement. An external pill holding pocket 50 extends externally on the base ring in radial outward alignment with the clean out opening 46. The pill pocket 50 includes a bottom opening 52. The bottom opening 52 enables pills that have been removed from the interior area of the base ring through the clean out opening 46, to be directed downward through the opening and into a suitable container.

The exemplary base ring 42 further includes a suitable bracket portion 54. Bracket portion 54 is configured to engage with releasable fasteners 16 to enable the base ring to be releasably positioned in engagement with the body 12 of the machine. The exemplary base ring 42 further includes a mounting opening 56. The mounting opening 56 is configured to receive a threaded thumbscrew 58 or other releasable fastener therein. The thumbscrew 58 is configured to engage a lower clamp 60. The lower clamp 60 is configured to engage a projecting surface of the existing machine to hold the base ring in engagement with the body 12. Of course it should be understood that this configuration of the base ring and the mounting thereof on the packaging machine is exemplary and in other arrangements other approaches may be used.

The exemplary base ring further includes a pair of hinge posts 62. The inward extending hinge posts are configured to engage respective 64 cars of an inserter 66, which is alternatively referred to herein as a cover. The exemplary engaged hinge posts 62 and cars 64 comprise a hinge that enables the inserter 66 to be rotationally movably mounted in operative connection with the base ring. In the exemplary arrangement the inserter 66 is movable between a closed position in which the inserter operates to close and vertically bound the base interior area 43 within the base ring 42, and an open position. In the open position the inserter is at least partially moved away from the base ring opening 45 of the base interior area 43 so that the base interior area is accessible from outside the base ring. This exemplary arrangement enables the interior area 43 of the base ring to be readily accessed for purposes of changing the configuration of the device to handle different pill sizes and for other purposes as later discussed.

The exemplary pill feed apparatus 30 is configured to be driven by the drive mechanism of the existing packaging machine which was previously utilized to rotate and index the pill disc 18. The exemplary assembly includes a drive pin 68. As shown in greater detail in FIGS. 19-21 the exemplary drive pin 68 includes a lower U-shaped portion 70. The U-shaped portion 70 includes a pair of radially disposed spaced apart legs 72. The legs 72 bound a recess 74. Recess 74 is configured to receive and engage therein a drive post 76 of the existing drive of the machine which is shown in phantom. The drive post 76 rotates in an indexing manner in coordination with the pill encapsulating mechanism within the machine.

Figure 12:
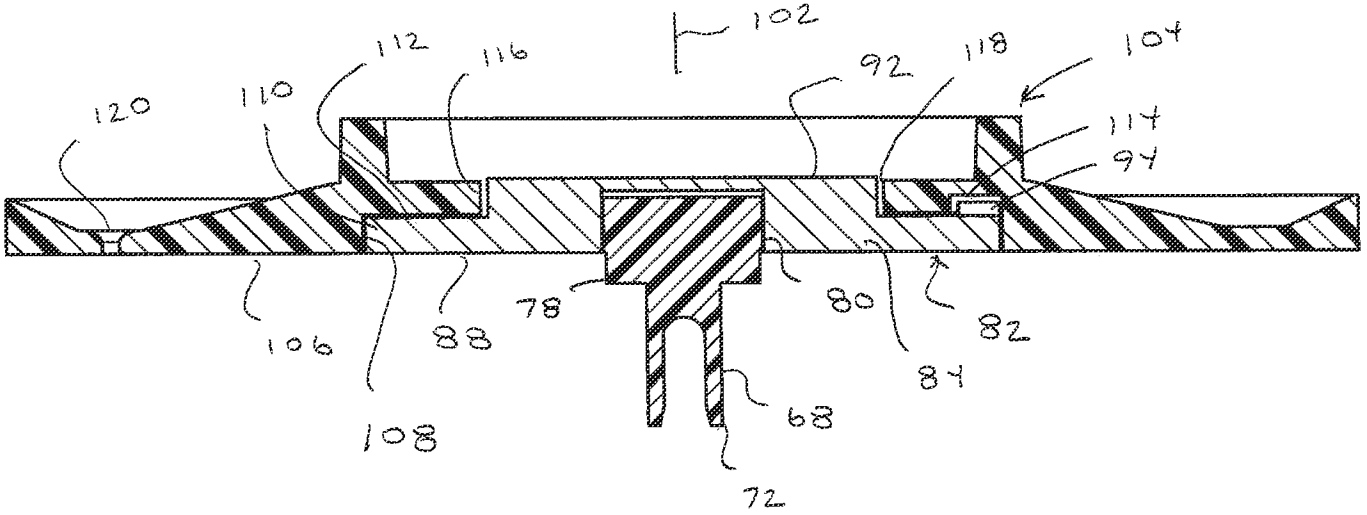
FIG. 12 is a diametric cross-sectional view of an exemplary feeder disc, drive platter and drive pin of the exemplary pill feed apparatus.
Figure 13:
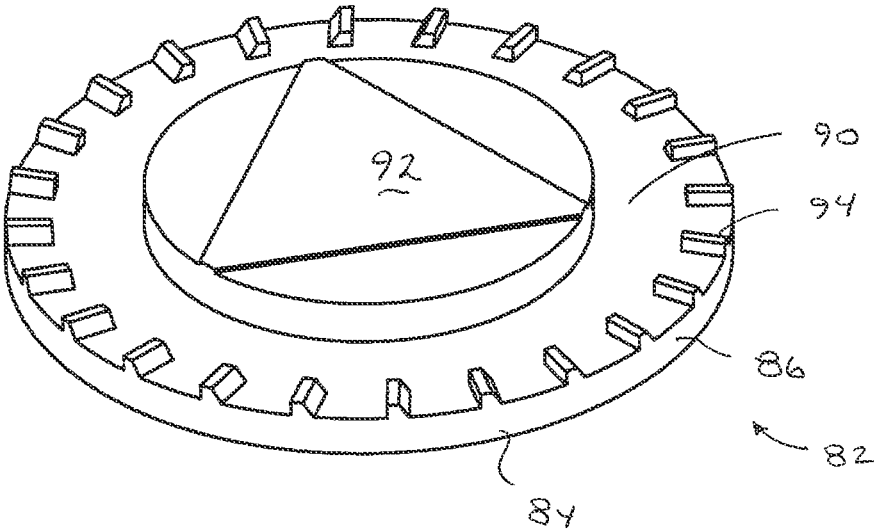
FIG. 13 is a top front perspective view of the exemplary drive platter.
Figure 16:
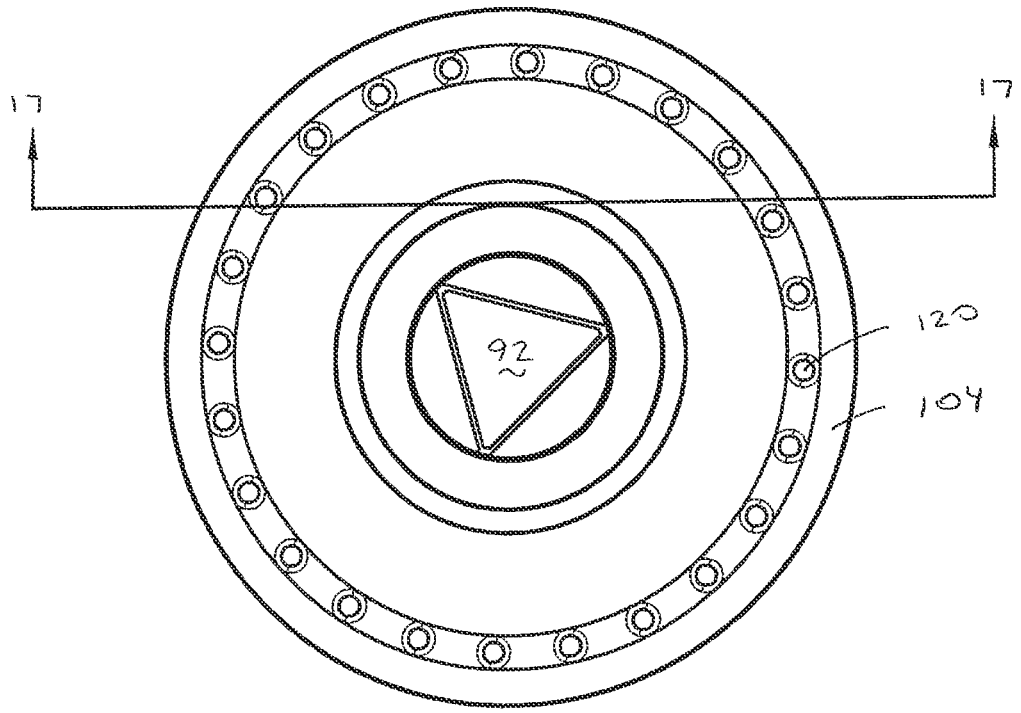
FIG. 16 is a top view of an exemplary feeder disc.

The exemplary drive pin 68 further includes and terminates upwardly at a head 78. In the exemplary arrangement the head comprises a square portion in a top view that in the operative position extends above the U-shaped portion 70. In the exemplary arrangement the head 78 is configured to releasably be engaged in a corresponding square-shaped recess 80 on a lower side of a drive platter 82 as shown in FIG. 12 for example. The exemplary configuration provides for the drive pin 68 to be releasably engaged with the drive platter 82 without any significant rotational play or lash between the drive post 76 and the drive platter 82. This helps to assure accurate positioning and coordinated rotational movement of the drive platter and the feeder discs as later discussed.

Further in the exemplary arrangement the legs 72 of the U-shaped portion 70 of the drive pin 68 are configured to be frangible. As a result if the head 78 of the drive pin 68 encounters resistance to rotational movement above a force threshold, the legs 72 will deform and/or fracture (each of which condition is referred to therein as a break) in response to the force imparted by the drive post 76. This reduces the risk of damaging the drive post or other mechanisms within the packaging machine. Further as can be appreciated in this exemplary arrangement, if the drive pin 68 is damaged due to encountering an excessive resistance force, the drive pin can be readily replaced with a new drive pin. Of course this approach is exemplary and in other arrangements other approaches may be used.

As shown in FIGS. 12-18 the exemplary drive platter 82 includes a base portion 84 which is bounded by a circular outer surface 86. The base portion 84 includes a lower face 88 in which the square-shaped recess 80 extends. The base portion 84 further includes an upper face 90 that is on an opposed side of the base portion from the lower face 88. A central axially centered cylindrical projection 92 extends outward from the outer surface 86.

In the exemplary arrangement a plurality of equally angularly spaced upward extending projections 94 extend vertically from the upper face 90. The exemplary projections 94 are radially disposed away from the cylindrical projection 92 and terminate outwardly at the outer surface 86. In the exemplary arrangement each of the projections 94 includes in circumferential transverse cross-section, a tapered leading wall 96. Each tapered leading wall 96 is tapered at an obtuse angle relative to the upper face 90. The tapered leading wall 96 of a respective projection 94 terminates outwardly at an outer surface 98. Each respective projection is further bounded in transverse cross-section by a trailing wall 100. In the exemplary arrangement the trailing wall 100 extends in a plane parallel to a central axis 102 of rotation of the drive platter 82. In the exemplary arrangement the tapered leading wall 96 of each projection 94 is on the leading side of the respective projection 94 as the drive platter 82 rotates during operation in a rotational direction as represented by Arrow R.

Figure 17:
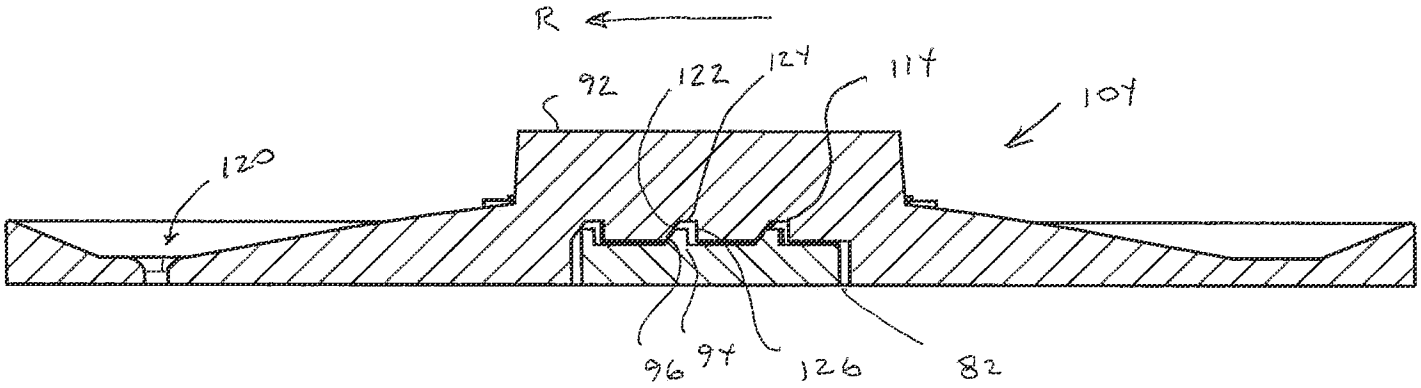
FIG. 17 is a cross-sectional view taken along line 17-17 in FIG. 16.
Figure 18:
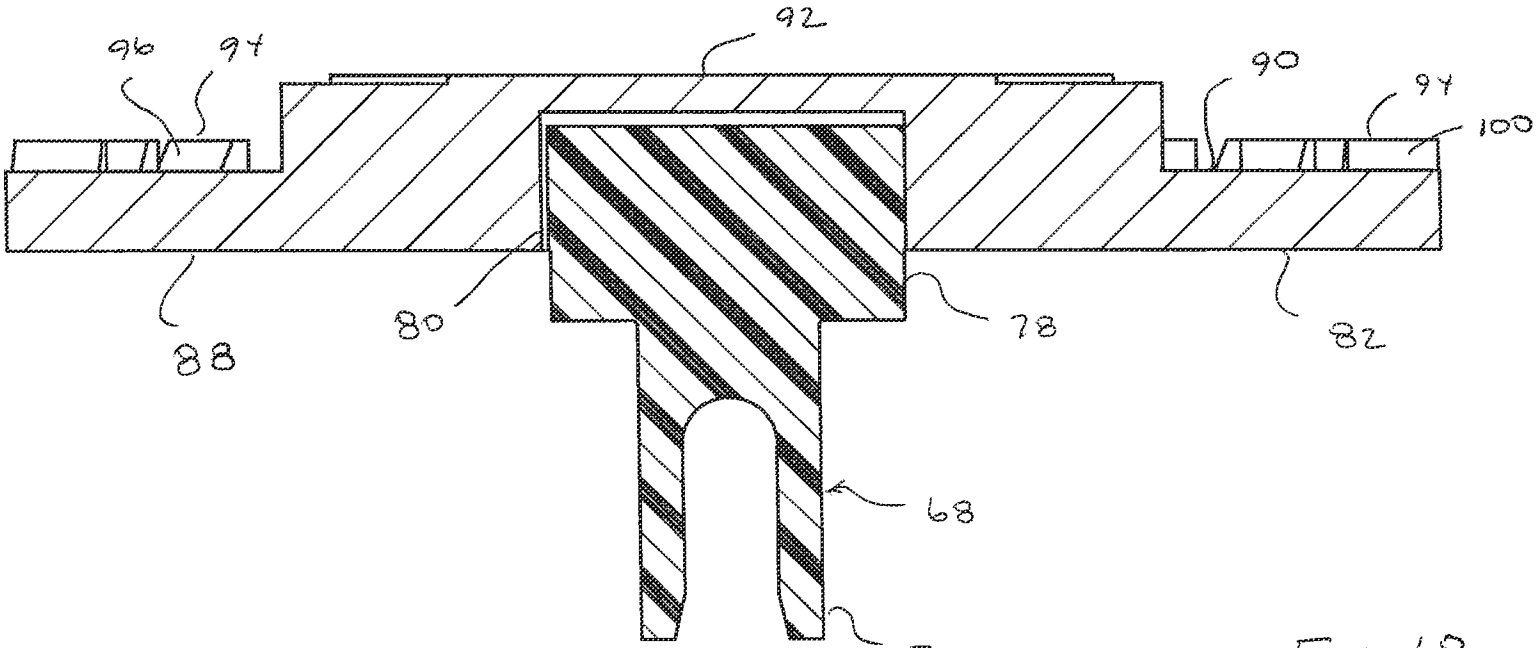
FIG. 18 is an enlarged cross-sectional view of the exemplary drive platter and drive pin.

As shown in FIGS. 12 and 17 each respective feeder disc used in the exemplary arrangement is configured to engage with the drive platter 82. As represented by the exemplary feeder disc 104 shown in FIGS. 12 and 17, the feeder disc includes a circular lower disc surface 106 with an axially centered disc recess 108 therein. Disc recess 108 includes a lower portion 110 which is configured to receive the base portion 84 of the drive platter therein. The lower portion 110 is bounded by a radially inward extending step face 112 which is configured to engage the upper face 90 of the drive platter. A plurality of angularly spaced upward extending projection engaging recesses 114 are positioned at the radially outer periphery of the step face 112. The projection engaging recesses 114 are configured to each receive therein a respective projection 94 of the drive platter 82. In the exemplary arrangement the engagement of each projection 94 of the drive platter 82 and a respective projection engaging recess 114 of the feeder disc 104 causes the feeder disc to rotate in engagement with the drive platter 82 and the drive pin 68 without relative rotational movement during normal operation. Of course this approach is exemplary and in other arrangements other approaches may be used.

The exemplary disc recess 108 of the feeder disc 104 includes an upper portion 116. The upper portion 116 is sized to receive the cylindrical projection 92 therein in centered relation. The exemplary upper portion 116 includes an upper opening 118 through which the central projection 92 extends. As shown in FIG. 12 the central projection 92 is engaged in close-fitting relation with the walls bounding the upper portion 116 and the upper opening 118. This helps to assure that the feeder disc and drive platter are each positioned in centered relation relative to the axis of rotation 102 when the feeder disc and the drive platter are in operative connection. This helps to assure that the feeder disc 104 and the pill engaging apertures 120 that extend therethrough, are enabled to be accurately moved and positioned by the drive mechanism including the drive post 76 in the machine. In other arrangements other configurations of interengaging projections and recesses may be used to maintain the feeder disc and drive platter in axially centered positions. For example in other arrangements the drive platter may include an axially centered recess that is configured to engage an axially centered projection on the feeder disc. Such interengaging projections and recesses may have numerous different configurations. The use of the interengaging projections and recesses helps to assure that the drive platter in the feeder disc are maintained in an axially centered arrangement even in circumstances where the feeder disc encounters resistance to rotational movement and the feeder disc and drive platter undergo relative rotational and vertical movement in a manner like that later described.

Further as shown in FIG. 17 each of the exemplary projection engaging recesses 114 is bounded in circumferential transverse cross section by a tapered engaging wall 122. The tapered engaging wall in the exemplary arrangement extends at substantially the same angle as the tapered leading wall 96 of each respective projection 94 of the drive platter 82. As a result in the exemplary arrangement the tapered leading wall 96 of a projection 94 is in flush abutting engagement with a tapered engaging wall 122 as shown in FIG. 17. Each projection engaging recess 114 is further bounded in transverse cross-section by an upper surface 124. The upper surface 124 of the exemplary arrangement extends a distance away from the outer surface 98 of the projection 94. Each projection engaging recess 114 is further bounded by a back wall 126. The exemplary back wall 126 in the operative position is disposed slightly away from the trailing wall 100 of the engaged projection 94. Of course it should be understood that this configuration is exemplary and in other arrangements other approaches and wall configurations may be used.

The exemplary arrangement of the drive platter 82 and feeder discs such as feeder disc 104, operate to provide a torque limiting clutch as the drive platter imparts rotational force to the feeder disc. This torque limiting clutch arrangement assures accurate movement of the feeder disc and reduces the risk of damage to the pill feed apparatus in the event of a jam or other malfunction which prevents or increases resistance to the rotation of the feeder disc 104. As can be appreciated, during normal operation the tapered leading walls 96 of each of the projections 94 engage the tapered engaging walls 122 of the projection engaging recesses 114 so that the tapered leading walls 96 impart rotational force and move the feeder disc 104. In the event that rotation of the feeder disc 104 is prevented or the disc encounters a higher resistance due to malfunction or a jam in the pills being moved by the apparatus, the tapered leading walls 96 of the projections 114 will move relative to the tapered engaging walls 122 of the recesses 114, allowing rotational movement of the drive platter 82 relative to the feeder disc. Further as can be appreciated such relative motion will cause the feeder disc to move upwardly relative to the drive platter until the degree of relative rotational movement between the drive platter in the feeder disc reaches the point where the projections engage in the next successive recesses. When that occurs the feeder disc will move downward as the projections 94 engage in the recesses 114. Such movement of the feeder disc may in some instances cause the condition that prevents rotation of the feeder disc to be cleared, and the feeder disc will thereafter rotate in synchronized relation with the drive platter. Alternatively, if the condition which prevented the movement of the feeder disc has persisted, the drive platter will again cause the projections to disengage from the current projection engaging recesses, and reengage in the next recesses. When the feeder disc and the drive platter undergo relative rotational and vertical movement the interengaging central projection 92 on the drive platter and recess 118 on the feeder disc assure that the drive platter and feeder disc maintain their respective axially centered positions. Thus the exemplary arrangement reduces the risk of damage to the assembly or the mechanism within the packaging machine. Of course these approaches are exemplary and in other arrangements other torque limiting connections may be utilized.

Figure 22:
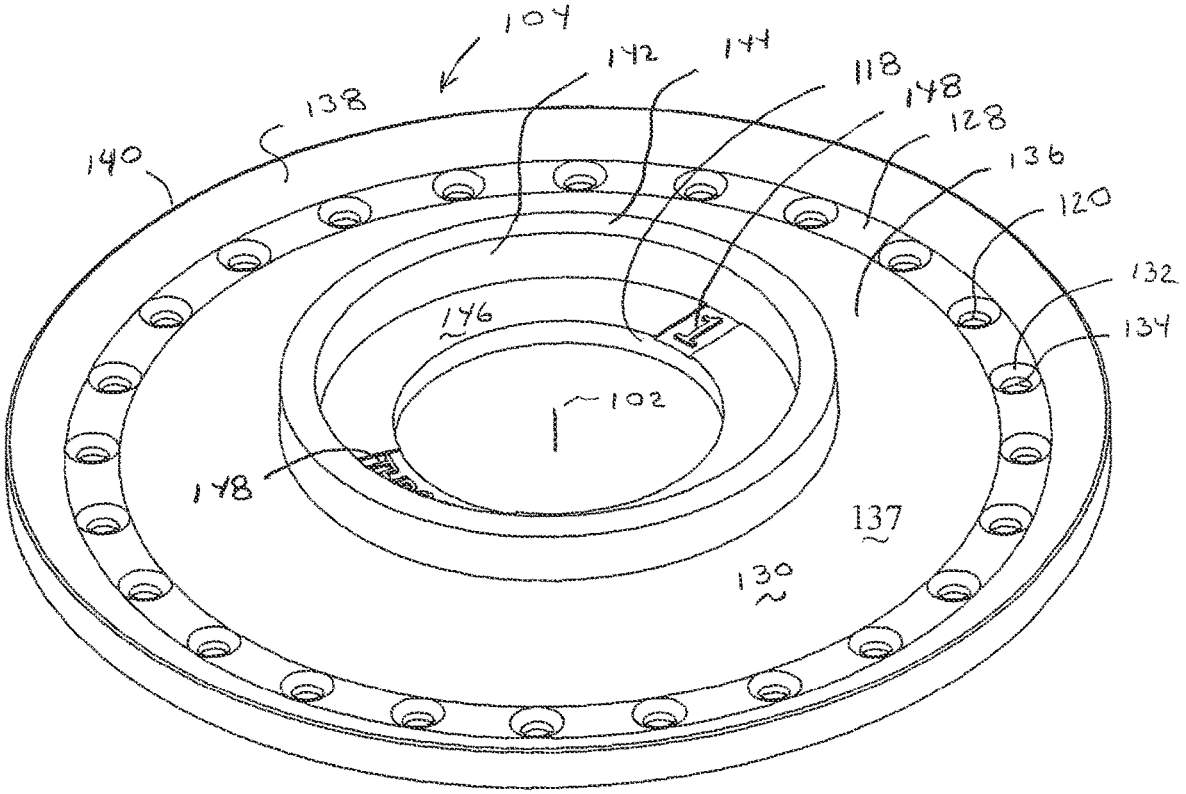
FIG. 22 is a top front perspective view of an exemplary feeder disc.
Figure 29:
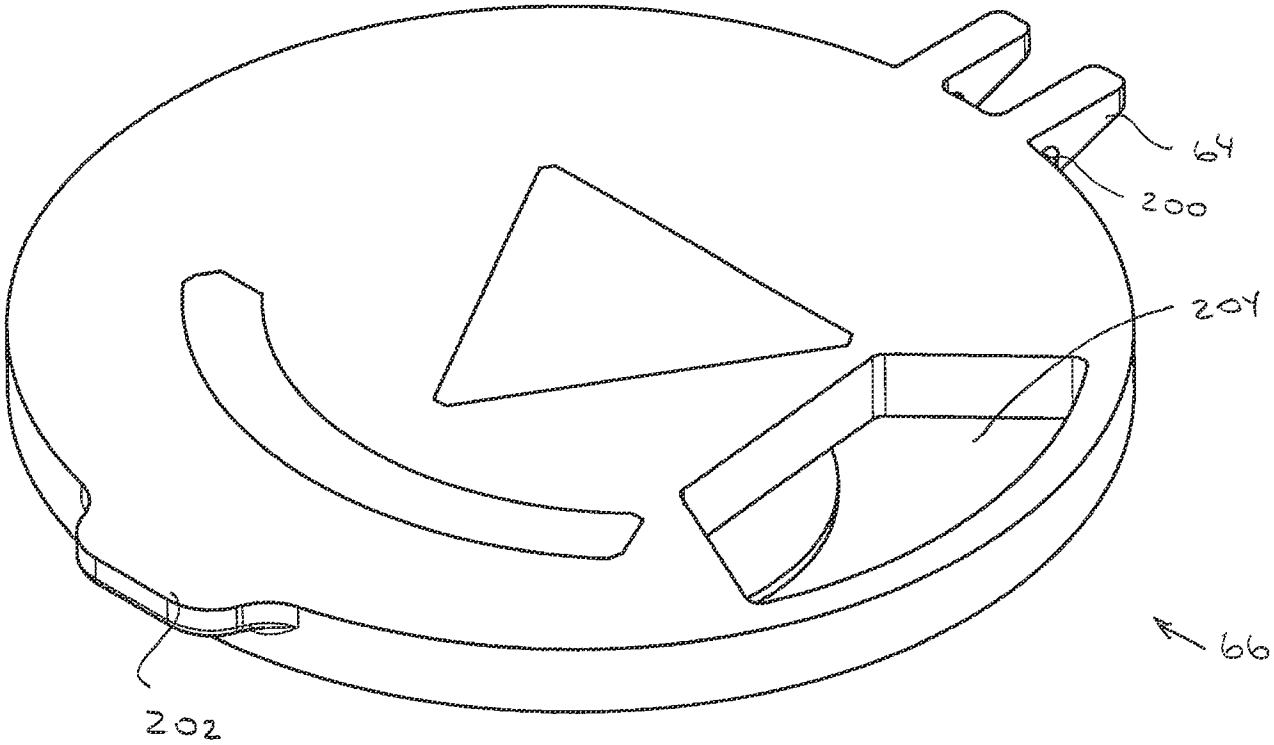
FIG. 29 is a front top right perspective view of an exemplary inserter of the pill feed apparatus.

The exemplary pill feed apparatus 30 may be utilized to separate numerous different pill sizes and configurations. This is achieved in the exemplary arrangement by using respective feeder discs that correspond to the particular pill configurations. Of course as can be appreciated each of the feeder discs include certain common features that enable them to be utilized in the apparatus. Referring to FIGS. 22-24 feeder disc 104 is shown in greater detail. The feeder disc 104 includes the plurality of evenly angularly spaced pill engaging apertures 120 as previously discussed. Each of the pill engaging apertures extend vertically through the feeder disc and are arranged in an axially centered annular portion 128 of the feeder disc. The exemplary apertures extend in a generally planar annular portion 128 of the upper surface 130 of the feeder disc. For purposes hereof generally planar means that the area is mostly flat other than the areas that are occupied by the pill engaging apertures 120. As shown in FIG. 22 the exemplary apertures are configured with an inwardly tapered upper portion 132 and a lower portion 134. In the exemplary arrangement the lower portion is horizontally bounded by walls that extend vertically in a transverse cross-section. The lower portion 134 is configured to receive and hold a pill therein such that the central axis of a generally cylindrical pill is positioned so as to extend vertically in the lower portion. In the exemplary arrangement pills that are positioned within a respective pill engaging aperture are vertically supported by operative engagement with the plate upper surface 29 of the support plate 27. The pill engaging apertures 120 are configured to hold the pill therein in a stable manner as the feeder disc 104 is rotated.

In the exemplary arrangement the tapered upper portions 132 of the pill engaging apertures are configured such that any pills which vertically overlie pills that are already positioned within the lower portion 134 can be disengaged from the tapered upper portion through engagement with one or more brushes that are attached to the inserter in a manner like that later discussed. Further the exemplary tapered upper portions are configured so that in the event that a generally cylindrical pill is positioned in the aperture 120 but with its central axis positioned in other than in the vertical direction, one or more brushes attached to the inserter are operative to engage the pill and cause it to move to have its central axis extend vertically and the pill to move downward into the lower portion so it is positioned in the pill engaging aperture. For example FIG. 24 shows a pill 143 positioned in the lower portion 134. In exemplary arrangements the contours of the tapered upper portions 132 are configured to avoid sharp edges or other similar features that may cause pills to be caught or crushed through the brushing action which causes individual pills to be positioned in each respective lower portion of the apertures. In exemplary arrangements in which the pills have a configuration of an elongated capsule or similar pill configuration, the pill engaging apertures of the feeder disc are configured so that pills are positioned in respective apertures with the elongated axis extending horizontally within the respective pill engaging aperture. When used herein a reference to a pill being positioned or being positionable in a pill engaging aperture refers to the pill occupying the respective aperture in a nested manner so that the outer surface of the pill extends continuously adjacent to the surface that bounds the pill engaging aperture and no other pill can extend within the respective aperture without the other pill being swept away from the respective aperture by the brushes during feeder disc rotation in a manner that is later discussed. Of course it should be understood that the described approaches are exemplary and in other arrangements other approaches may be used.

In the exemplary configuration of feeder disc 104 the upper surface of the disc 130 radially inward from the apertures includes a conical radially tapered annular inner portion 136. The annular inner portion is bounded upwardly by an annual inner portion surface 137 that tapers outward and downward with radial distance away from the central axis 102 toward the planar portion 128. The exemplary upper surface of the feeder disc further includes a tapered annular outer portion 138. The outer portion 138 is bounded upwardly by an annular outer portion surface 139 that in transverse cross-section is tapered downwardly with increasing radial proximity to the apertures and the axis 102, from an outer periphery 140 which is alternatively referred to as annular disc edge. The outer periphery is immediately adjacent to the circular annular internal wall 44 of the base ring 42 when the feeder disc is in the operative position. In the exemplary arrangement the annular disc edge 140 is disposed radially inward from the annular internal wall 44 of the base ring by no more than a radial distance that is less than the smallest dimension of each respective pill having the configuration that is to be positioned in the pill engaging apertures of the feeder disc being used. This exemplary approach helps to assure that no pills may extend between the annular disc edge and the annular internal wall and avoids pills being caught or damaged during operation of the apparatus. The exemplary annular outer tapered portion surface 139 extends downwardly tapered to the level of the planar portion 128 on an opposed side of the annular inner portion 136. As is subsequently explained, the inward tapered conical surface and the outer tapered conical surface of the feeder disc facilitates the movement of the pills so they are positioned in the pill engaging apertures 120 during operation of the pill feed apparatus. Of course it should be understood that this configuration is exemplary and in other arrangements other approaches may be used.

The exemplary feeder disc 104 further includes a central annular projection 142. The annular projection which is alternatively referred to as an annular feeder disc projection, extends upwardly in the operative position of the feeder disc, from the radially innermost area of the inward conical portion 136. The annular projection terminates upwardly at the top surface 144. As later discussed the top surface 144 of the annular projection is configured to be positioned in close proximity to a lower surface of an annular skirt projection on the inserter during operation to maintain the pills in supported connection with the feeder disc in the base interior area radially outward of the annular projection. In the exemplary arrangement the feeder disc includes a ring surface 146. The ring surface 146 extends radially outward from the upper opening 118 to the inside of the annular projection 142. In the exemplary arrangement the ring surface 146 includes visible indicia 148. The visible indicia 148 is usable to identify the particular disc and corresponds to the pill configuration that the feeder disc is made to handle and separate. As later discussed this makes it easier for the operator to install the feeder disc that corresponds to the configuration of a pill that the operator wishes the process. Of course this approach is exemplary and in other arrangements other approaches may be used.

FIGS. 25-26 show an alternative feeder disc 150. Feeder disc 150 is configured to separate a different pill configuration than feeder disc 104. Feeder disc 150 separates cylindrical pills that have a larger diameter than pill 143 which is handled by feeder disc 104. Feeder disc 150 includes a plurality of equally angularly spaced pill engaging apertures 152. The apertures 152 extend in a generally planar portion 154 of an upper surface 156 of the feeder disc. Similar to the previously described feeder disc, disc 150 includes a conical annular inner portion 158 with a tapered inner portion surface that extends radially inward of the apertures and the planar portion 154. An annular outer portion 160 extends radially outward of the apertures and the planar portion 154 and includes a tapered annular outer portion surface. The exemplary pill engaging apertures 152 each include a tapered upper portion 162 which is configured to facilitate aligning the pill within the aperture through engagement with the deformable brushes of the inserter. Each pill engaging aperture further includes a lower portion 164 which is configured to horizontally hold a cylindrical pill 166 with central axis thereof extending vertically in the aperture. The lower surface of pill 166 is in supported engagement with the plate upper surface 29.

The exemplary feeder disc 150 further includes an annular projection 168. Annular projection 168 is similar to annular projection 142 previously discussed. The disc further includes a ring surface 170 which is similar to ring surface 146. Indicia 172 which has a corresponding relationship to the particular disc and the pill configuration that the feeder disc is utilized to handle is included on the exemplary ring surface.

FIGS. 27 and 28 show a further alternative feeder disc 174. Feeder disc 174 is configured to handle pills having an elongated capsule or caplet configuration. The exemplary feeder disc 174 includes a plurality of equally angularly spaced pill engaging apertures 176. In this exemplary arrangement the pill engaging apertures 176 extend vertically through an axially centered annular portion of the disc which has in upper planar surface 178. The exemplary pill engaging apertures are positioned such that the central axis of the capsule extends radially relative to the axis of rotation 102. Each pill engaging aperture includes a tapered upper portion 180 to facilitate the pills engaging within the aperture, as well as a respective lower portion 182 for holding the pill 184 therein with the longitudinal axis of the pill extending horizontally in the aperture as the feeder disc rotates.

The exemplary feeder disc 174 includes an upper surface 186 which includes an inward conical annular inner portion 188. The upper surface 186 further includes an outer tapered annular outer portion 190, which in this arrangement extends a relatively shorter distance radially inward from the outer periphery 192 of the feeder disc. Similar to the other described feeder discs, disc 174 includes an annular projection 194 that extends upwardly from the upper surface. A ring surface 196 extends radially inwardly from the annular projection to the opening which accepts the cylindrical projection 92 therein. The ring surface 196 includes indicia 198 which is usable to identify the particular feeder disc and corresponds to the pill configuration that the feeder disc is configured to handle.

Of course it should be appreciated that in exemplary arrangements numerous additional feeder discs may be utilized that are configured for handling pills with the other pill configurations that may be processed using the pill feed apparatus.

The exemplary inserter 66 which is alternatively referred to herein as a cover, is comprised of a generally circular plate that is configured to extend in overlying relation of the base ring 42. The inserter is configured to close and upwardly bound the circular base ring opening 45 to the base interior area that is horizontally bounded by the circular wall 44 of the base ring when the inserter is in the operative position. The inserter 66 is movably mounted through engagement of the pivot posts 62 on the base ring in openings 200 in cars 64 of the inserter which serve as a hinge and enable the inserter to be movable between the closed, operative position in which the inserter extends generally horizontally and overlies the chamber horizontally bounded by the base ring 42, and an open, access position in which the inserter extends generally vertically and the chamber bounded by the base ring is accessible through the base ring opening 45. A handle projection 202 is positioned on the inserter diametrically opposite to the cars to facilitate inserter movement. As can be appreciated in the open position of the inserter the feeder disc that is currently within the base ring is manually accessible. This enables an operator to remove the feeder disc that is currently in place bounding the lower side of the base interior area, and to replace it with a different feeder disc. In the exemplary arrangement the changing of the feeder disc is all that is required for an operator to change between handling one pill configuration and another. No changes to the position of any of the plurality of brushes that are in fixed operative connection with the inserter as later described in detail, are required to be made to enable the apparatus to operate with any of the exemplary different feeder discs that are each respectively configured to handle a different pill configuration. Of course this approach is exemplary and in other arrangements other approaches may be used.

The exemplary inserter includes a top opening 204 that extends therethrough. The top opening 204 is configured to receive and engage a lower end of a funnel 206 therein. Funnel 206 is configured to enable pills to be introduced into the base interior area that is vertically bounded upwardly by the inside face 208 of the inserter and downwardly the feeder disc, and horizontally by the circular annular internal wall 44 of the base ring. An axially centered annular skirt projection 210 extends downward from the inside face 208. In the operative position of the inserter the skirt projection terminates downwardly in an inner annular surface 212. In the operative position of the inserter the inner annular surface 212 of the skirt projection 210 is positioned in vertically close adjacent relation with the upward extending annular projection of the feeder disc that is installed within the base interior area base ring. This is for example annular projection 142 of feeder disc 104. In exemplary arrangements the skirt projection 210 along with the annular projection on the feeder disc helps to maintain pills being processed in the area radially outward of the annular projection and the skirt projection.

The inner face 208 of the inserter further includes a plurality of brush engaging mounts thereon. The brush engaging mounts are configured to releasably engage respective deformable brushes that in the operative position of the inserter 66 extend vertically downward in the base interior area toward the feeder disc and which are configured to engage pills in a manner that cause one respective pill to be individually positioned in each pill engaging aperture of the respective feeder discs. In the exemplary arrangement mounts 214 and 216 are positioned on the inside face 208 and on angularly opposed sides of top opening 204. A further mount 218 is positioned angularly disposed in the direction that the feeder disc rotates relative to the inserter from the mount 216.

A further mount 220 is positioned angularly disposed in the rotational direction that the feeder disc rotates from the mount 218. Further angularly disposed in the direction that the feeder disc rotates is a further mount 222. Mount 224 is positioned angularly in the direction of feeder disc rotation from the mount 222 followed by a further mount 226. It should be noted that in this exemplary arrangement the mounts 214, 216, 220 and 208 extend generally radially outward from the skirt projection 210. The mounts 218 and 222 extend outward from the skirt projection but do not extend directly radially. Rather mounts 218 and 222 extend at an acute angle relative to the directly radial direction. The mount 226 extends inwardly from an outer periphery 228 of the inserter and is disposed radially away from the skirt projection. The purpose of this configuration in the exemplary arrangement will be discussed in the following description of the operation of the exemplary inserter. The exemplary inserter further includes a diverter support post 230. The diverter support post extends generally perpendicular to the inside face 208 of the inserter. The diverter support post 230 is configured to hold a diverter 232 in vertically movable engagement therewith.

Figure 37:
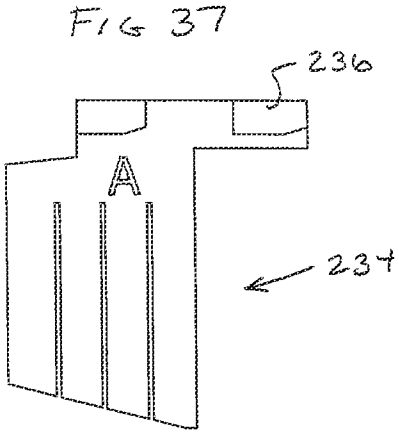
FIG. 37 is a front plan view of an exemplary brush used in the pill feed apparatus referred to for convenience herein as brush A.
Figure 42:
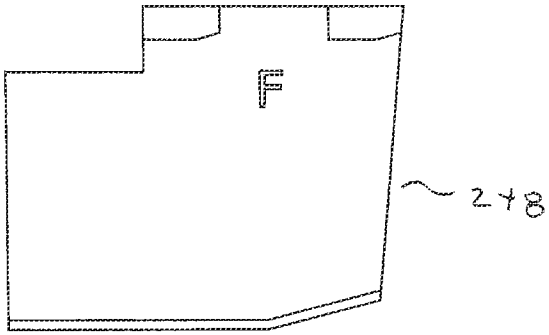
FIG. 42 is a front plan view of a further exemplary brush referred to for convenience herein as brush F.
Figure 41:
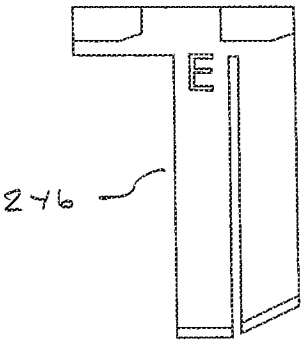
FIG. 41 is a front plan view of a further exemplary brush referred to for convenience herein as brush E.

In the exemplary arrangement each of mount 214 and mount 216 are configured to have a respective deformable brush 234 in engagement therewith. Brush 234 which is shown in FIG. 37 is alternatively referred to as brush A herein. Exemplary brush 234 comprises a plurality of separated, adjacent strips which are comprised of a deformable but substantially rigid plastic material. Brush A includes a mounting portion 236 that is configured to releasably engage with each of mounts 214 and 216. In the operative position of brush A and the other brushes discussed herein, the brush extends vertically downward from the inserter into the base interior area 238 in which the pills are processed which area/chamber is bounded by the inside face 208 of the inserter, the upper surface of the respective feeder disc, and the circular annular internal wall 44 of the base ring 42.

Figure 39:
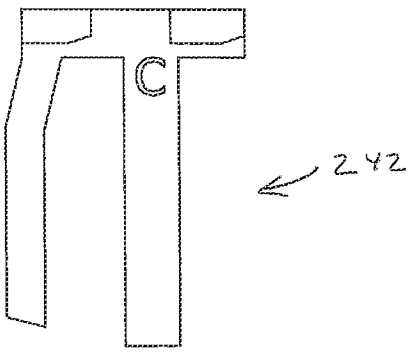
FIG. 39 is a front plan view of a further exemplary brush referred to for convenience herein as brush C.
Figure 38:
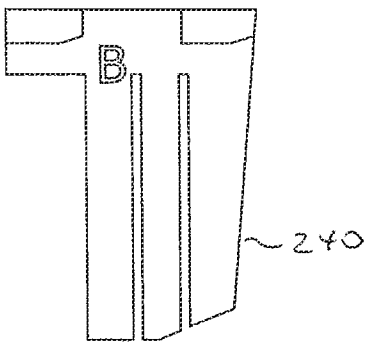
FIG. 38 is a front plan view of a further exemplary brush referred to for convenience herein as brush B.
Figure 40:
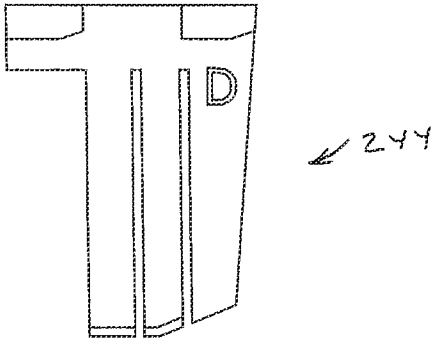
FIG. 40 is a front plan view of a further exemplary brush referred to for convenience herein as brush D.

A brush 240 that is shown in FIG. 38 is configured to releasably engage mount 216. Brush 240 is alternatively referred to herein as brush B. Similar to brush A, brush B is comprised of a plurality of adjacent generally rigid but flexible deformable plastic strips. A deformable brush 242 is shown in FIG. 39. Brush 242 is configured to releasably engage mount 220. Brush 242 is alternatively referred to herein as brush C. Releasably engageable with the mount 222 is a deformable brush 244 which is shown in FIG. 40. Brush 244 is alternatively referred to herein as brush D.

A further deformable brush 246 is releasably engaged with mount 224. Brush 246 is alternatively referred to herein as brush E. Releasably engaged with mount 226 is a deformable brush 248. Brush 248 is alternatively referred to as brush F. Each of the brushes A through F are attached to the mounts of the inserter via a mounting portion similar to the mounting portion 236 of brush A. Brush 248, which is brush F, in the exemplary arrangement is not comprised of strips and is thus less readily deformable than some of the other brushes for reasons that will be subsequently discussed.

Figure 36:
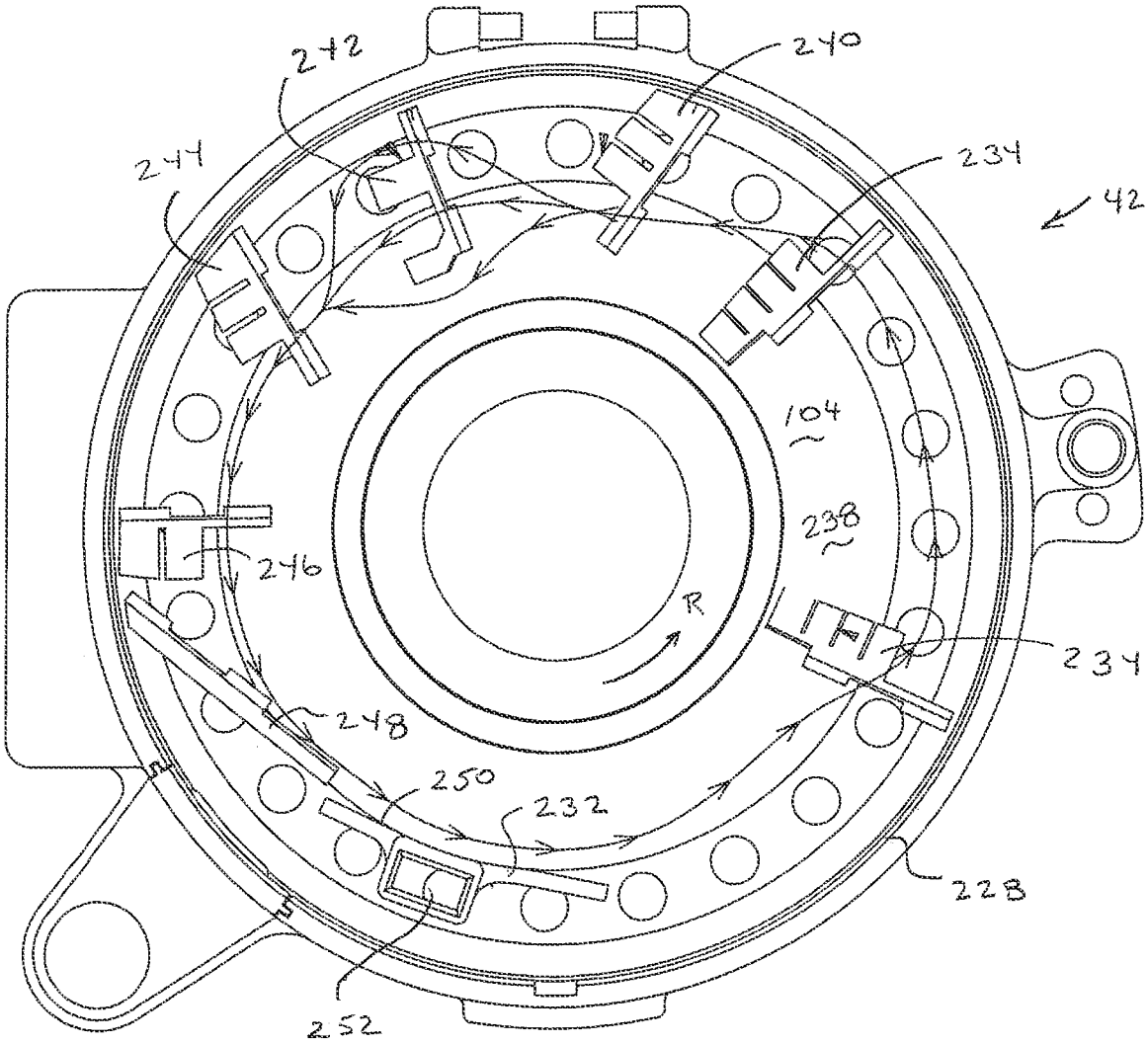
FIG. 36 is a top transparent view of the exemplary pill feed apparatus showing the exemplary internal brushes and with arrows showing the paths along which pills move relative to the feeder disc.

FIG. 36 is a top transparent view through the inserter 66 into the base interior area/chamber 238. In this exemplary arrangement the feeder disc 104 is shown installed in operative connection with the drive platter within the chamber 238. In this exemplary arrangement brushes 234 (brush A) are installed on angularly opposed sides of the top opening 204 that extends through the inserter 66. Brush 240 (brush B) is installed in the chamber and angularly disposed from the brush A 234 that is positioned on the side of the opening in the direction of rotation of the feeder disc indicated by Arrow R.

Further in the direction of feeder disc rotation from the brush 240 is the brush 242 (brush C). Brush D which is brush 244 is next positioned in the direction of feeder disc rotation. Brush 246 which is brush E is positioned further along the rotational direction, followed by brush 248 which is brush F. The diverter 232 which has an elongated pill guiding face 250 is positioned further in the direction of rotation. It should be noted in FIG. 36 that the diverter 250 includes an opening 252 which receives the diverter support post 230 therein. The exemplary diverter is enabled to move vertically in engaged relation with the support post 230 and is biased downwardly by gravity toward the upper surface of the feeder disc.

Figure 43:
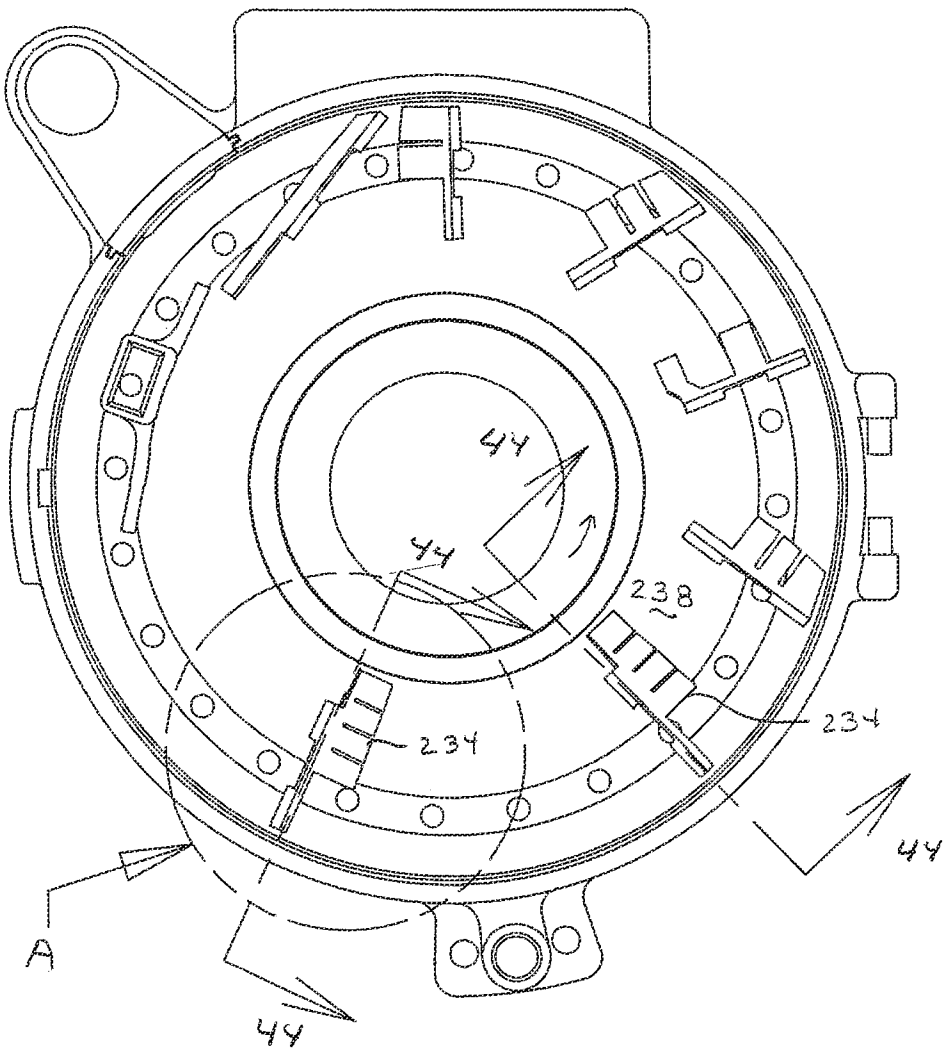
FIG. 43 is a top transparent view of the exemplary pill feed apparatus with a feeder disc installed therein.

As shown in FIGS. 43 and 44, a pair of brushes 234 (brush A) are positioned in the chamber 238 on opposed angular sides below the top opening 204 into which a plurality of pills in a batch to be processed are introduced into the chamber. As shown in FIG. 44 the brushes 234 include tapered inward surfaces 252 of the inward extending strips of which the brush is comprised. In the operative position the inward surfaces extend generally parallel to and are in close proximity to the inward conical portion 136 of the upper surface 130 of disc 104. The exemplary configuration of brush 234 provides an open area within the chamber 238 radially outward from the brush and above the pill engaging apertures 120 and the outer annular tapered portion 138.

Figure 47:
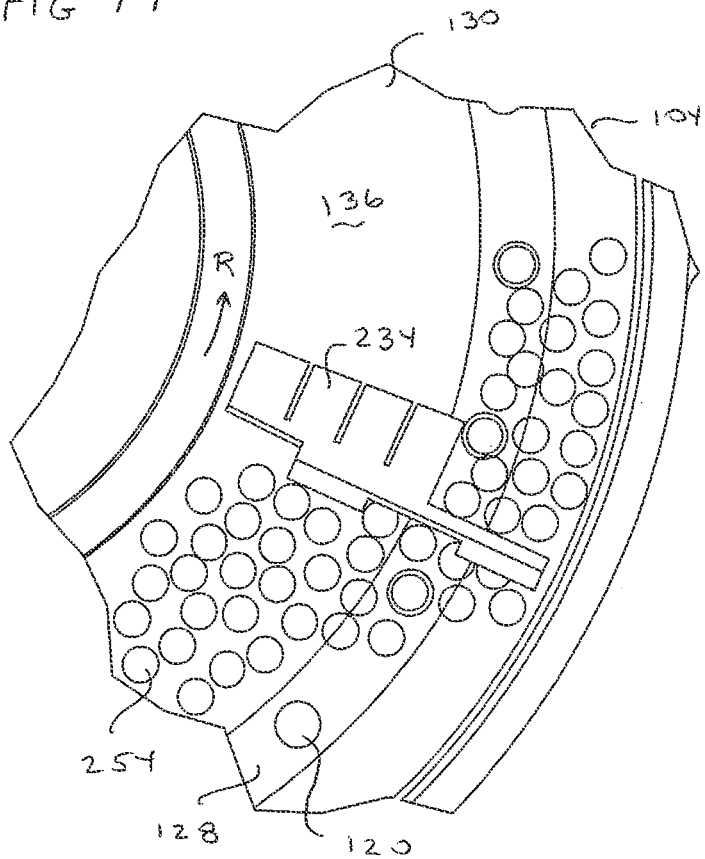
FIG. 47 is a top transparent view of area A shown in FIG. 44 with a plurality of pills adjacent to brush A.

As shown in FIG. 47 during rotation of the disc 104 pills 254 are caused to move by engagement with the upper surface 130 of the disc 104 in the area designated A in FIG. 43. Upon engagement with the brush 234 the pills are urged to move radially outwardly by the inward conical portion 136. As a result the pills are repositioned in overlying relation of the planar surface 128 and the pill engaging apertures 120. This facilitates moving the pills in overlying relation of the pill engaging apertures so that at least one pill will be engaged with and positioned within the pill engaging apertures. Pills engaged in the pill engaging apertures are moved by the feeder disc in supported connection with the underlying plate upper surface 29 of the support plate 27. As can be appreciated the brush 234 which is positioned in advance of the top opening 204 is operated to move the pills 254 into the area radially outward from the brush 234, and the similar brush 234 after the top opening operates to move any additional pills that have been inserted into the chamber 238 through the funnel to a similar radially outward location.

Figure 48:
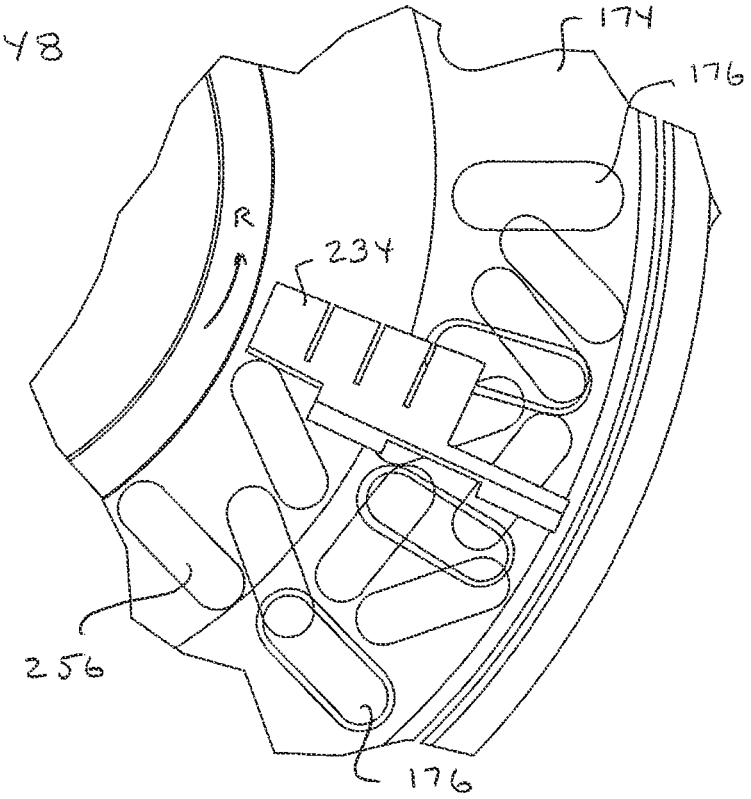
FIG. 48 is a top transparent view of area A shown in FIG. 44 with a plurality of capsules and a corresponding feeder disc for handling capsules adjacent to brush A.

FIG. 48 shows the brush 234 in the operative position when utilized in connection with a feeder disc for pills having a capsule configuration such as feeder disc 174. The pills 256 shown in FIG. 48 are moved supported on the upper surface of the feeder disc radially outward into the area overlying the pill engaging apertures 176. Thus it can be appreciated that the brush A of the exemplary configuration performs the desired function of moving and positioning the pills within the chamber regardless of the pill configuration and the corresponding feeder disc which is utilized.

Further it should be appreciated that in the event that for some reason the force that acts on the inward surfaces 252 of the brush 234 becomes greater than the force of the strips resisting deformation, the strips will deform enabling the pills or other object to move past the brush without causing any damage, after which the brush will return to its original undeformed condition. Of course it should be understood that this brush configuration is exemplary and in other arrangements other brush configurations and approaches may be used.

Figure 49:
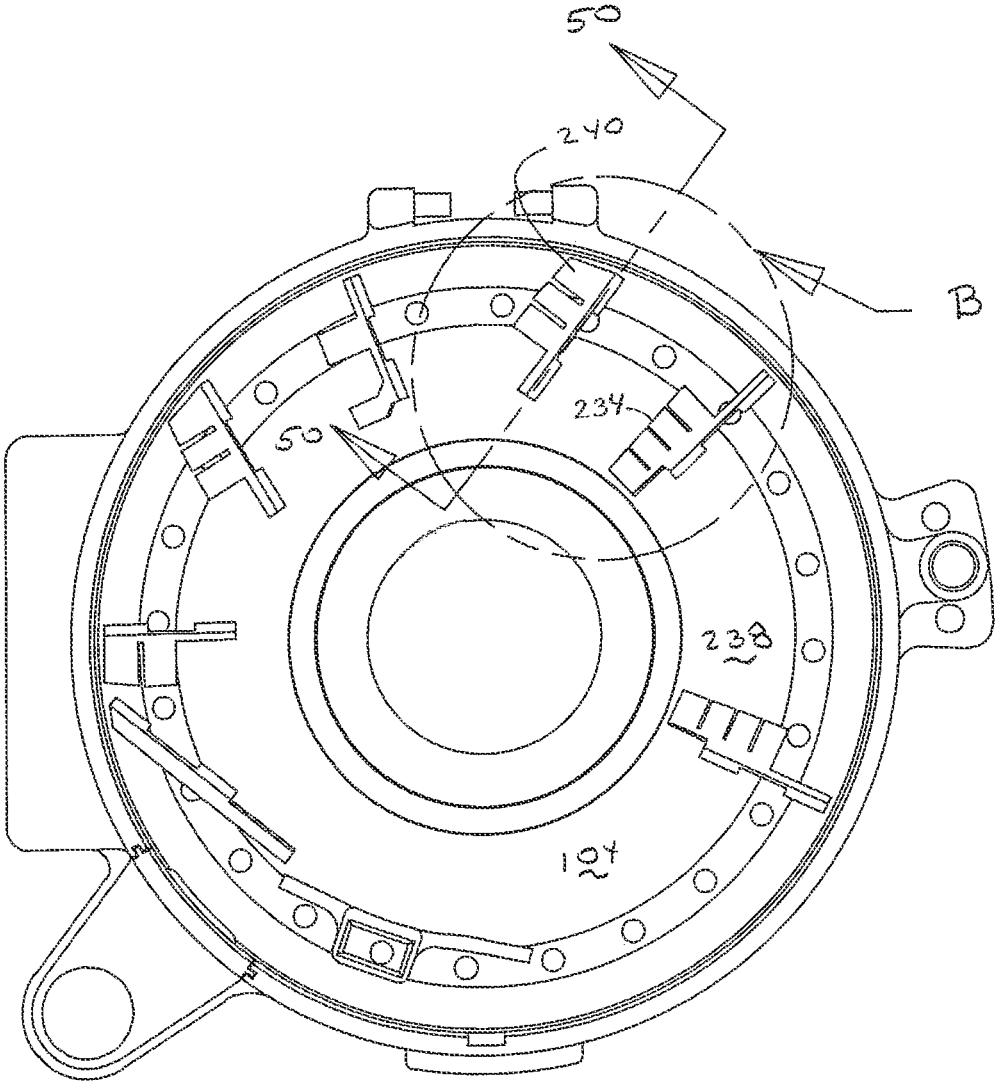
FIG. 49 is a top transparent view of the exemplary pill feed apparatus.
Figure 50:
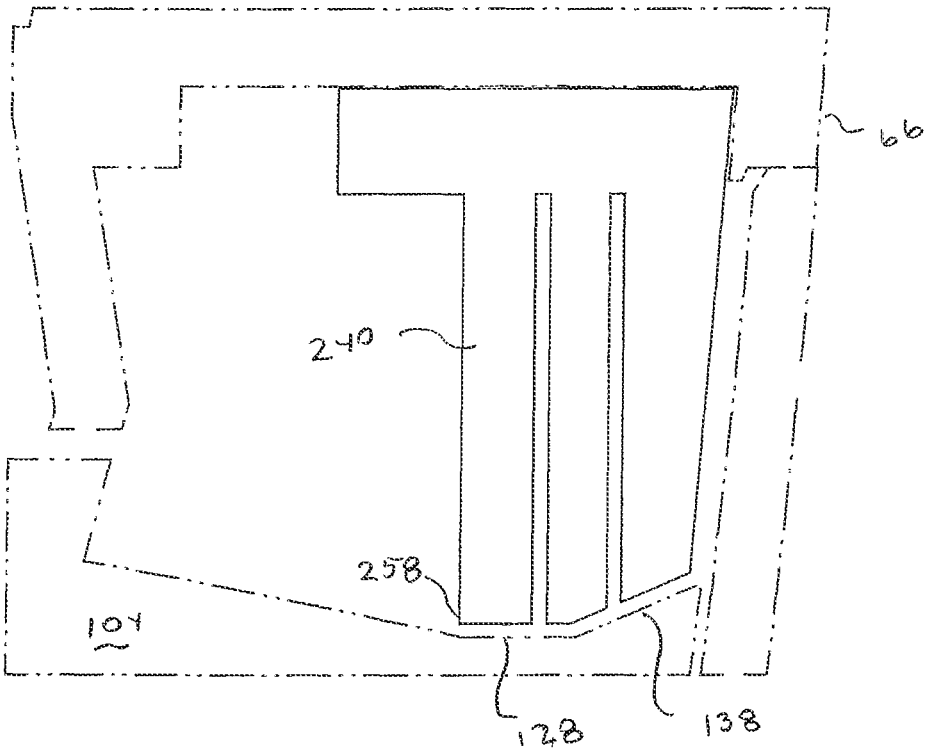
FIG. 50 is a cross-sectional view taken along line 50-50 in FIG. 49 and with the feeder disc and inserter shown in phantom.
Figure 51:
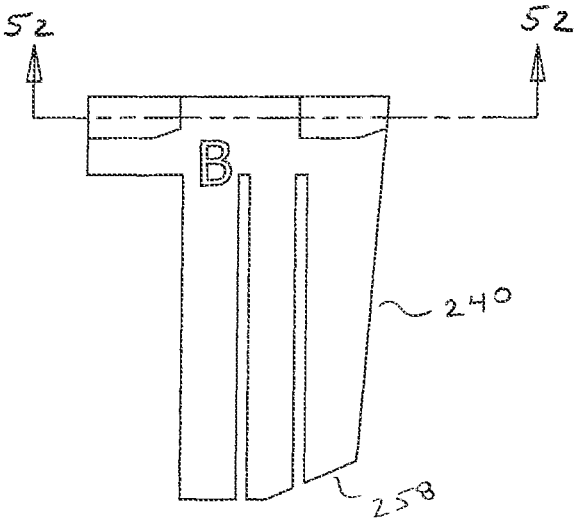
FIG. 51 is a front view of brush B including the mount portion thereof.
Figure 52:
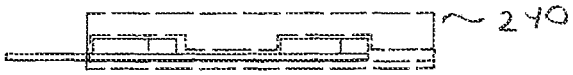
FIG. 52 is a cross-sectional view taken along line 52-52 in FIG. 51.

FIG. 49 shows a further top transparent view of the exemplary pill feed apparatus and chamber 238. Brush 240 (brush B) which is engaged by pills that have been moved in operative engagement with feeder disc 104 past brush 234, extends downward from the inside face 208 of the inserter 66. As shown in FIG. 50 the strips which comprise brush 240 include inward surfaces 258 which are disposed adjacent to the planar portion 128 and the annular tapered outer portion 138 of feeder disc 104.

Figure 53:
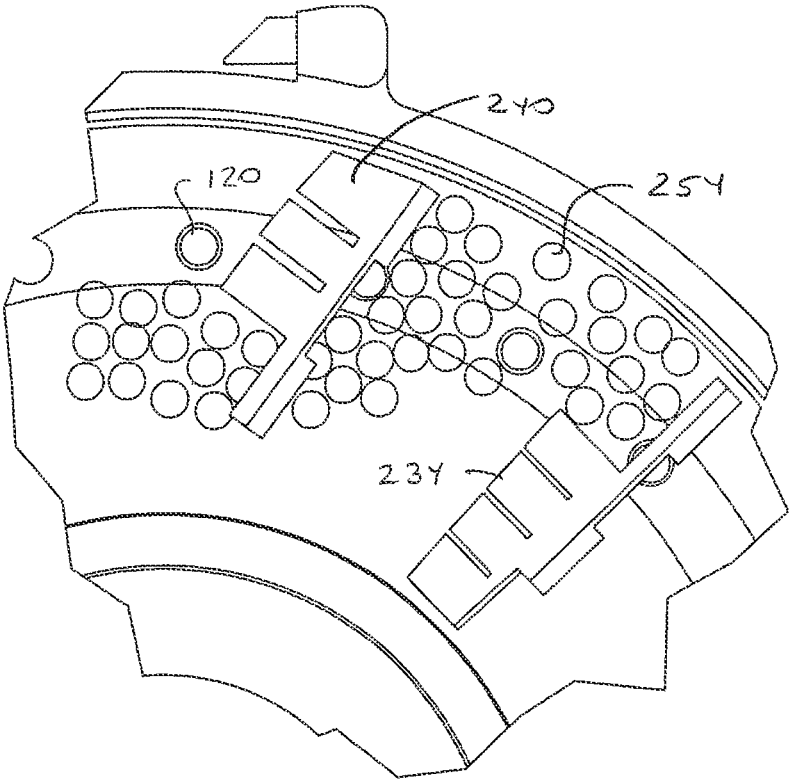
FIG. 53 is a top transparent view showing pills and a corresponding feeder disc in area B in FIG. 49.

As shown in FIG. 53 in area B shown in FIG. 49, brush B operates to further cause the pills to move in a manner that facilitates filling the pill engaging apertures. Brush 240 operates to block pill movement and hold the pills 254 over the pill engaging apertures 120 as the disc rotates. This urges pills to engage and be positioned in the pill engaging apertures. The brush 240 further is positioned at an angle that urges the pills that are not engaged in a pill engaging apertures to move radially inward of the brush 240 onto the inward conical portion of the upper surface of the feeder disc to enable the pills to move past the brush 240. Further as can be appreciated, the angle of the exemplary brush 240 facilitates holding back the movement of pills relative to the moving feeder disc so as to increase the chances for pill engagement in each of the pill engaging apertures.

Figure 54:
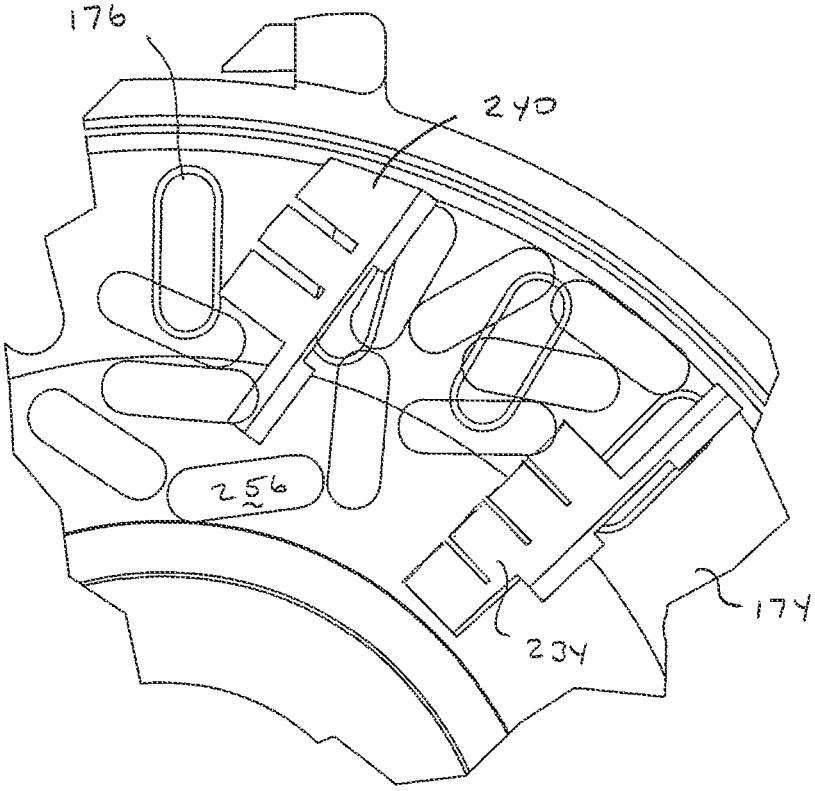
FIG. 54 is a top transparent view showing capsules and a corresponding feeder disc in area B in FIG. 49.

FIG. 54 shows the exemplary brush 240 operating in conjunction with pills 256 having a capsule configuration and in conjunction with feeder disc 174. As shown in this Figure the brush 240 operates in a manner similar to that previously described in connection with pills 254, to cause the pills 256 to be held from movement and backed up over the pill engaging apertures 176 to increase the chances for filling the apertures with pills. Further the pills 256 that are not engaged in a pill engaging aperture 176 are urged to move radially inward to rotationally move with the feeder disc past the brush 240.

Figure 55:
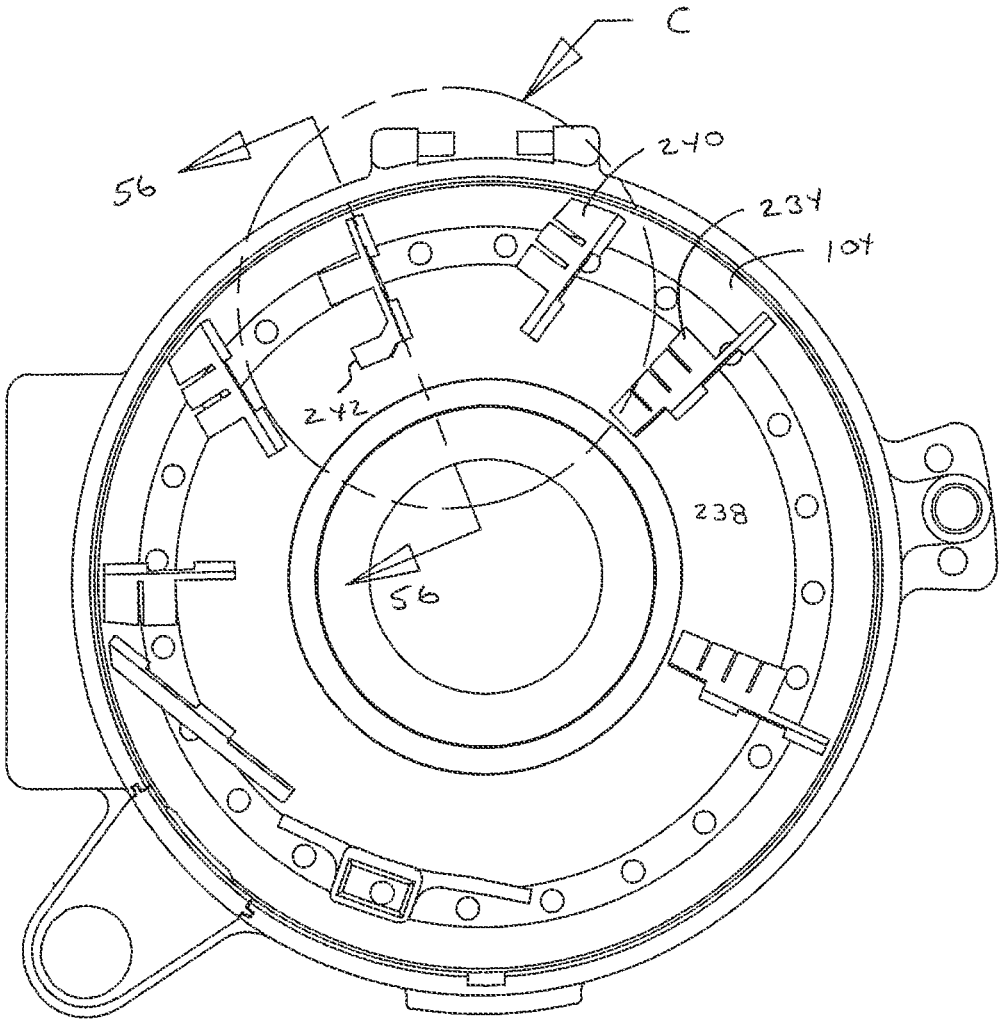
FIG. 55 is a top transparent view of the exemplary pill feed mechanism.
Figure 56:
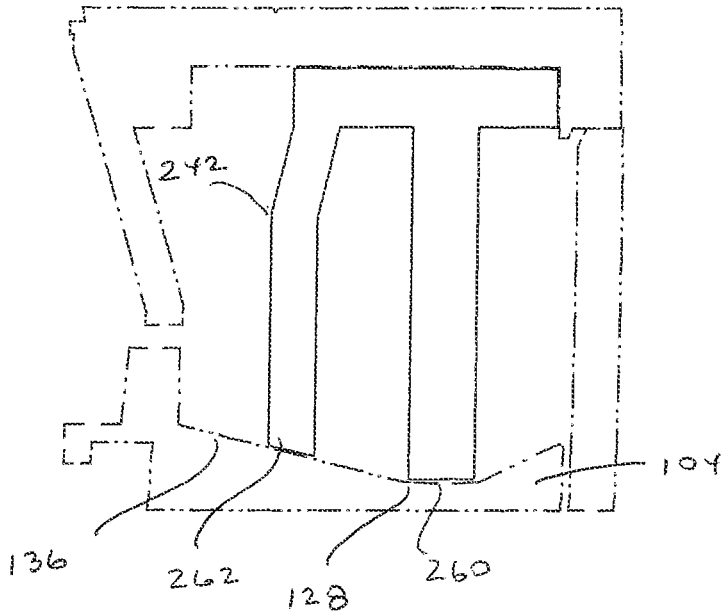
FIG. 56 is a cross-sectional view taken along line 56-56 in FIG. 55 and with the inserter and the feeder disc shown in phantom.
Figure 57:
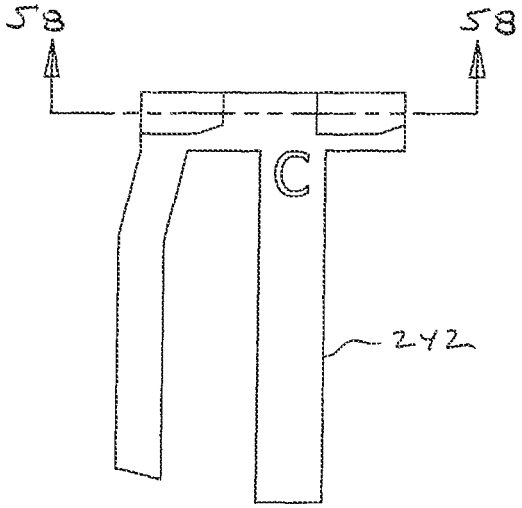
FIG. 57 is a front view of brush C including the mount portion thereof.
Figure 58:
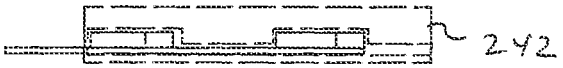
FIG. 58 is a cross-sectional view taken along line 58-58 in FIG. 57.

FIG. 55 is a further transparent view showing area C within the chamber 238. In area C the pills which have moved past brush 240 (brush B) engage with brush 242 (brush C). As shown in FIG. 56 exemplary brush 242 includes a pair of radially spaced strips. One of the strips has an inward surface 260 that is disposed in engagement with the planar portion 128 that includes the pill engaging apertures 120. The radially inwardly disposed strip includes an inward surface 262 that is engaged with the inward conical portion 136 of the upper surface of the feeder disc 104.

Figure 59:
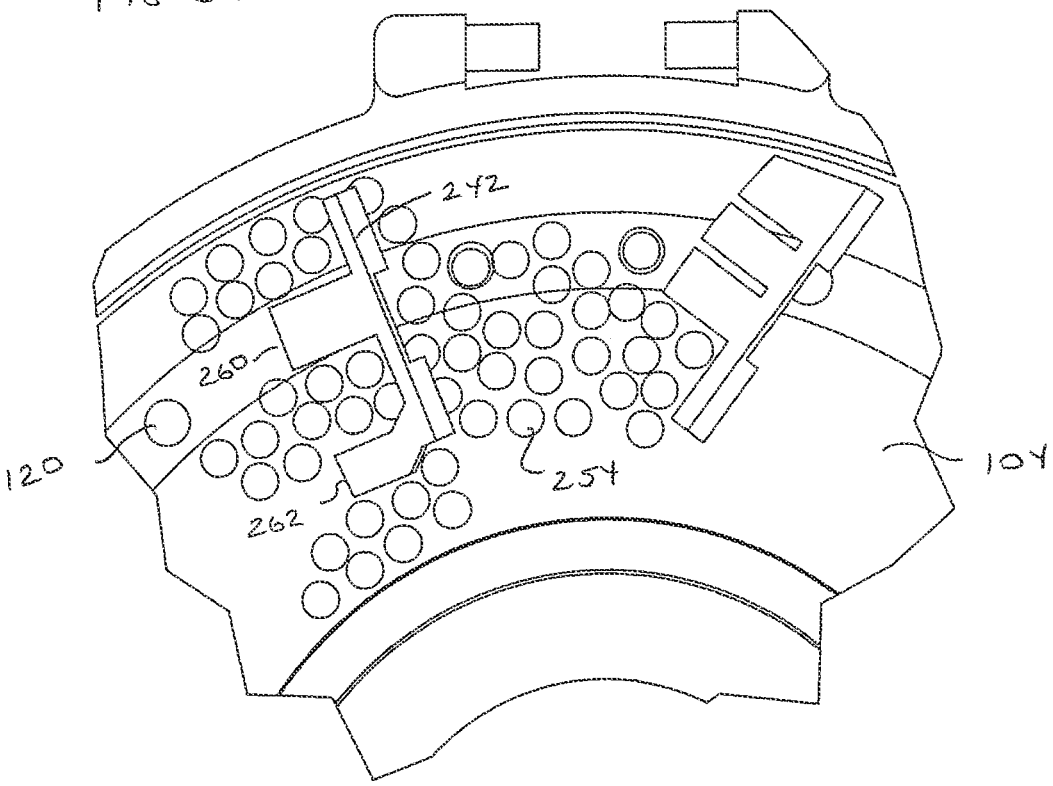
FIG. 59 is a top transparent view of area C shown in FIG. 55 with a plurality of pills and a corresponding feeder disc.

As shown in FIG. 59 the inward surface 260 sweeps over the pill engaging apertures 120. This sweeping action of brush C operates to remove any pills which are extending in vertically overlying relation of another pill that is already positioned within a pill engaging aperture 120. The sweeping action of the inward surface 260 of the brush further causes pills which may be standing upright or without the central axis positioned vertically, to be moved so as to be in alignment with the pill engaging apertures so that the pill can move downward into the lower portion of the pill engaging aperture and be positioned within the aperture. Further as shown in FIG. 49 the inward surface 262 of the radially inward strip of brush 242 provides for spreading the pills that are not in a pill engaging aperture over the upper surface of the feeder disc 104.

Figure 60:
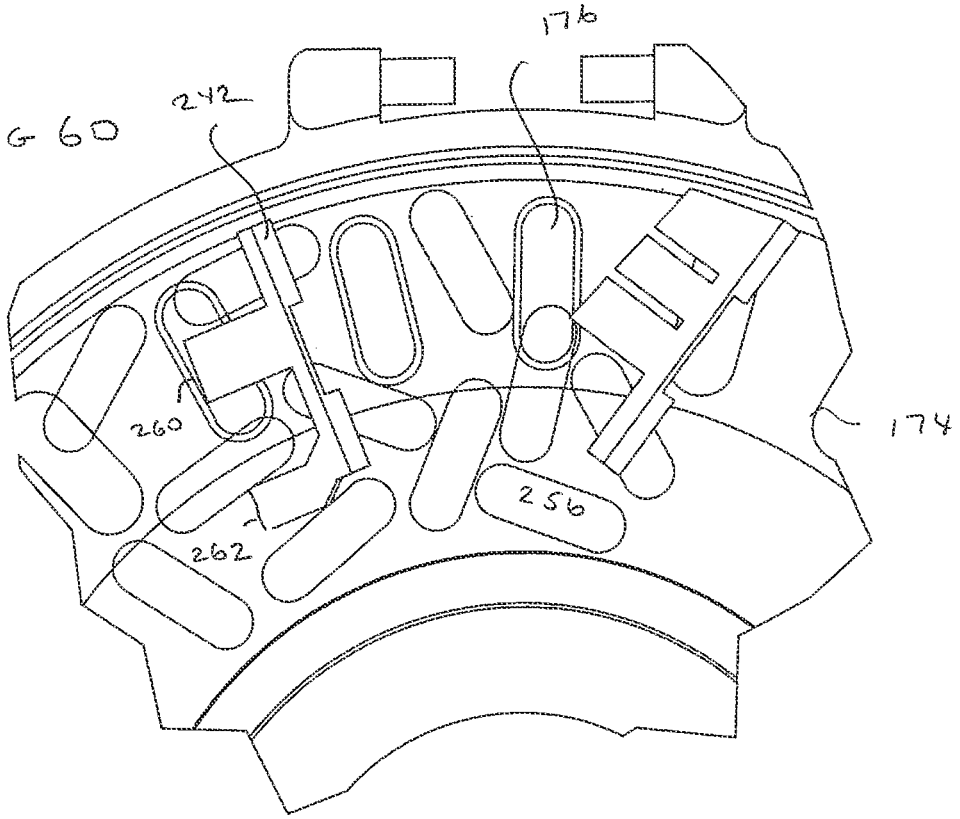
FIG. 60 is a top transparent view of area C shown in FIG. 55 with a plurality of capsules and a corresponding feeder disc.

FIG. 60 shows how brush 242 performs the same function when processing pills 256 in a capsule configuration that are moved into pill engaging apertures 176 of feeder disc 174. In this exemplary arrangement the inward surface 260 of the brush performs the function of removing pills that are overlying a pill already positioned in an aperture and also helps to cause a pill that may be partially engaged in an aperture to move into alignment with and into the lower portion of the aperture and be positioned in the aperture. Inward surface 262 on the radially inward disposed strip operates to spread the remaining pills that are not positioned in an aperture over the surface of the disc.

Figure 61:
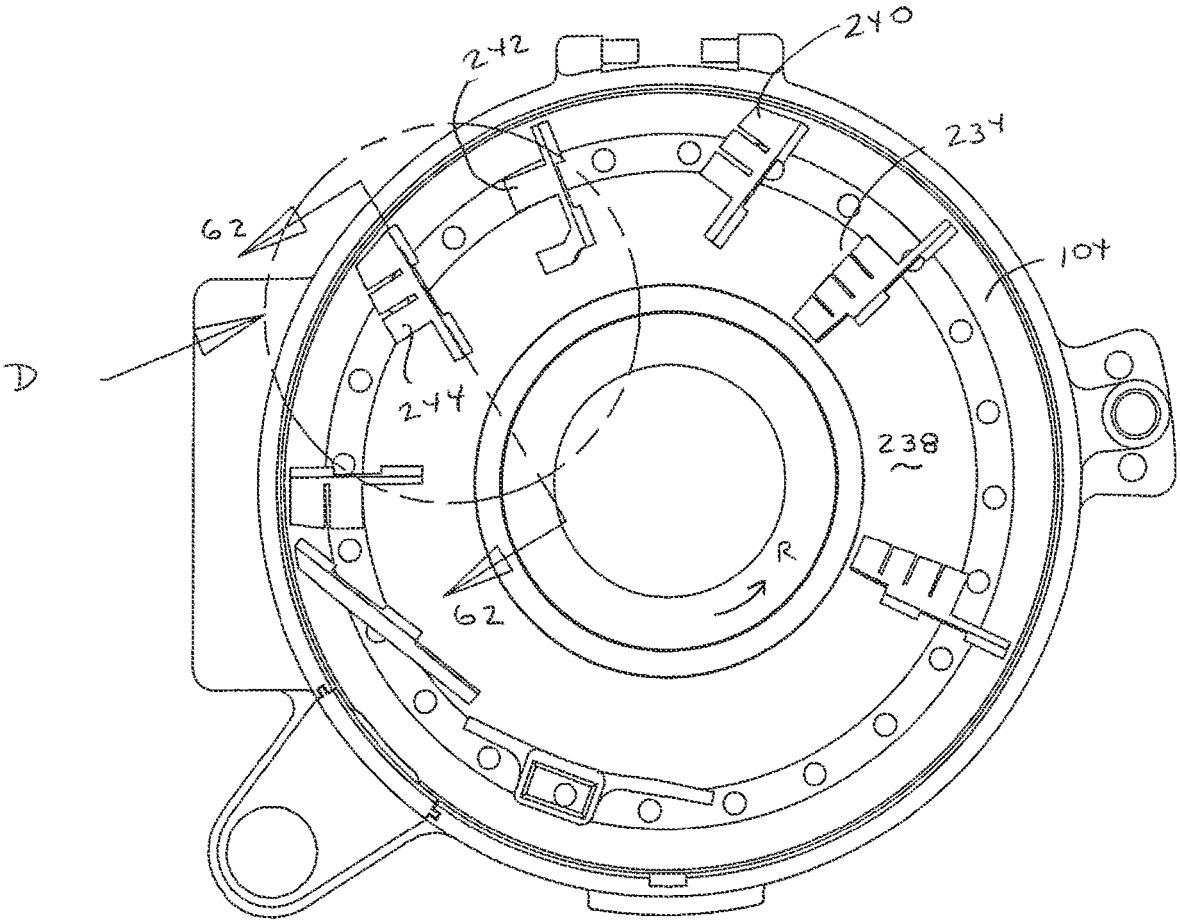
FIG. 61 is a top transparent view of the exemplary pill feed assembly.
Figure 62:
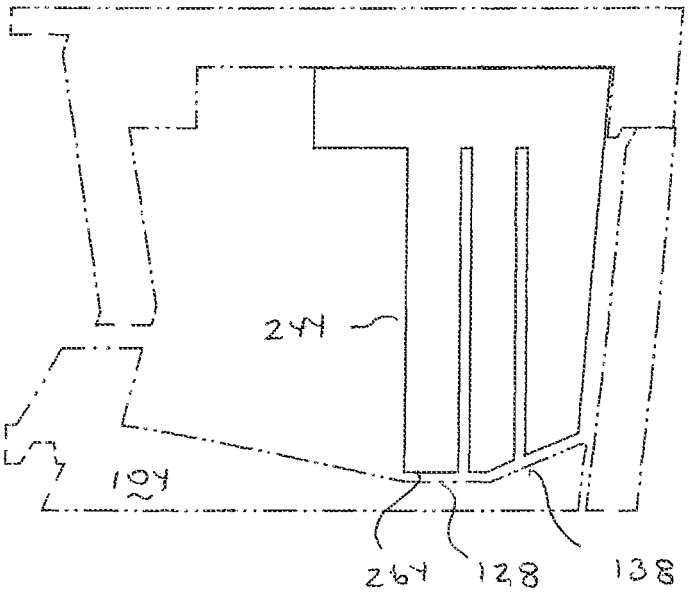
FIG. 62 is a cross-sectional view taken along line 62-62 in FIG. 61 and with the inserter and feeder disc shown in phantom.
Figure 63:
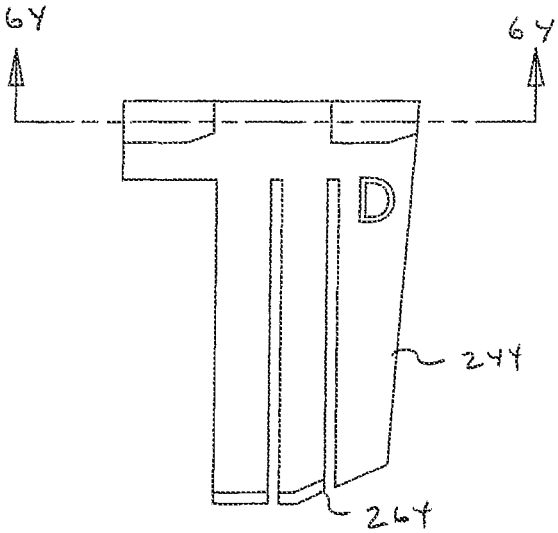
FIG. 63 is a front view of brush D including the mount portion thereof.
Figure 64:
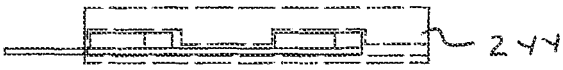
FIG. 64 is a cross-sectional view taken along line 64-64 in FIG. 63.

FIG. 61 is a further transparent view of the exemplary apparatus and the brush 244 (brush D) in an area labeled D within the chamber 238. Pills carried on the upper surface of the feeder disc 104 are moved into engagement with brush 244 after being moved past brush 242. As shown in FIG. 62 brush 244 has inward surfaces 264 of the inward extending strips that extend in close overlying relation of the planar portion 128 and the pill engaging apertures 120 of the feeder disc. The inward surfaces also extend in close proximity and in overlying relation of the outer annular tapered portion 138.

Figure 65:
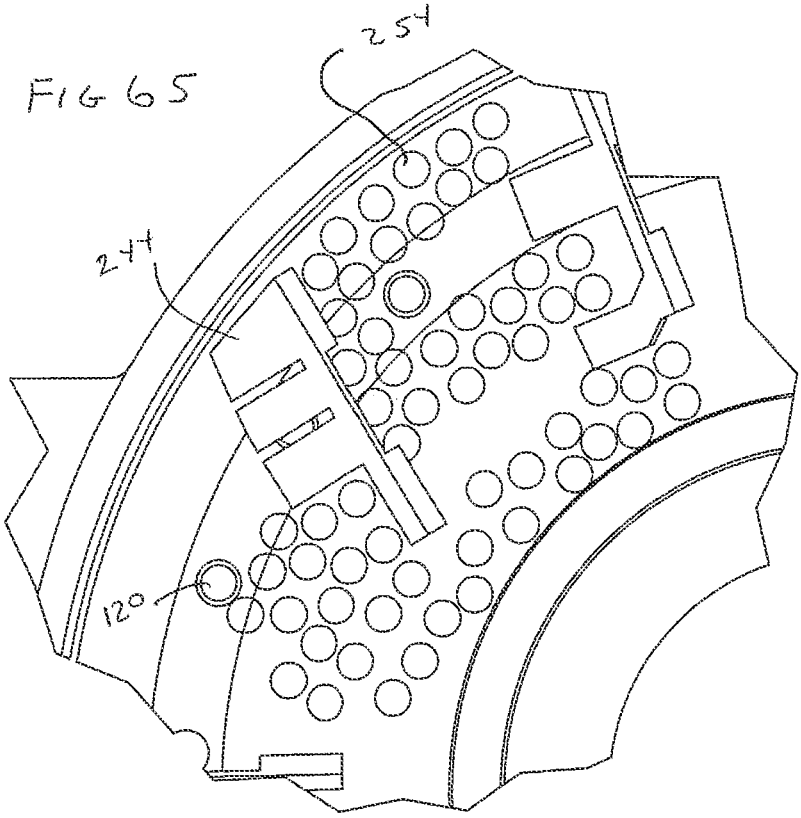
FIG. 65 is a top transparent view of area D in FIG. 61 with a plurality of pills and a corresponding feeder disc.

As shown in FIG. 65 the pills 254 when engaging brush 244 are temporarily held from movement above the path of the moving pill engaging apertures 120. The angle of the exemplary brush 244 (brush D) holds the pills by backing them up for a period of time as the feeder disc continues to move such that any open pill engaging apertures are filled with a respective pill. Further the exemplary brush 244 aggressively sweeps over the upper surface of the pill engaging apertures. This is done to remove any pills that may be overlying a pill already positioned in the lower portion of a pill engaging aperture. Further the aggressive sweeping action of brush 244 operates to move and reposition cylindrical pills that are engaged in the pill engaging aperture but that do not have the central axis thereof extending vertically. Further brush 244 urges the pills that are not engaged in the pill engaging apertures to move radially inwardly so they move rotationally past the brush 244.

Figure 66:
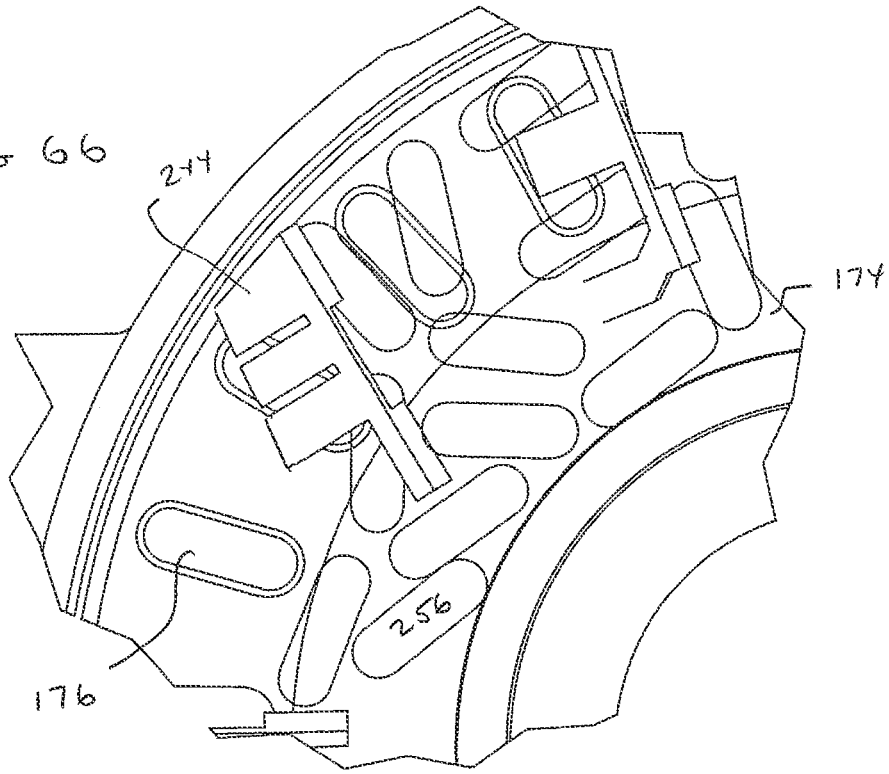
FIG. 66 is a top transparent view of area D in FIG. 61 with a plurality of capsules and a corresponding feeder disc.

FIG. 66 shows the operation of brush 244 in engagement with pills in the configuration of capsules 256. The brush performs the function of aggressively sweeping over the pill engaging apertures 176 in the feeder disc 174. Again the same brush D operates to aggressively sweep away any pills overlying a pill that is already within a pill engaging aperture and to reposition pills that may be engaged in the aperture but not properly positioned within the aperture, while remaining pills are moved radially inwardly to be carried past the brush 244.

Figure 67:
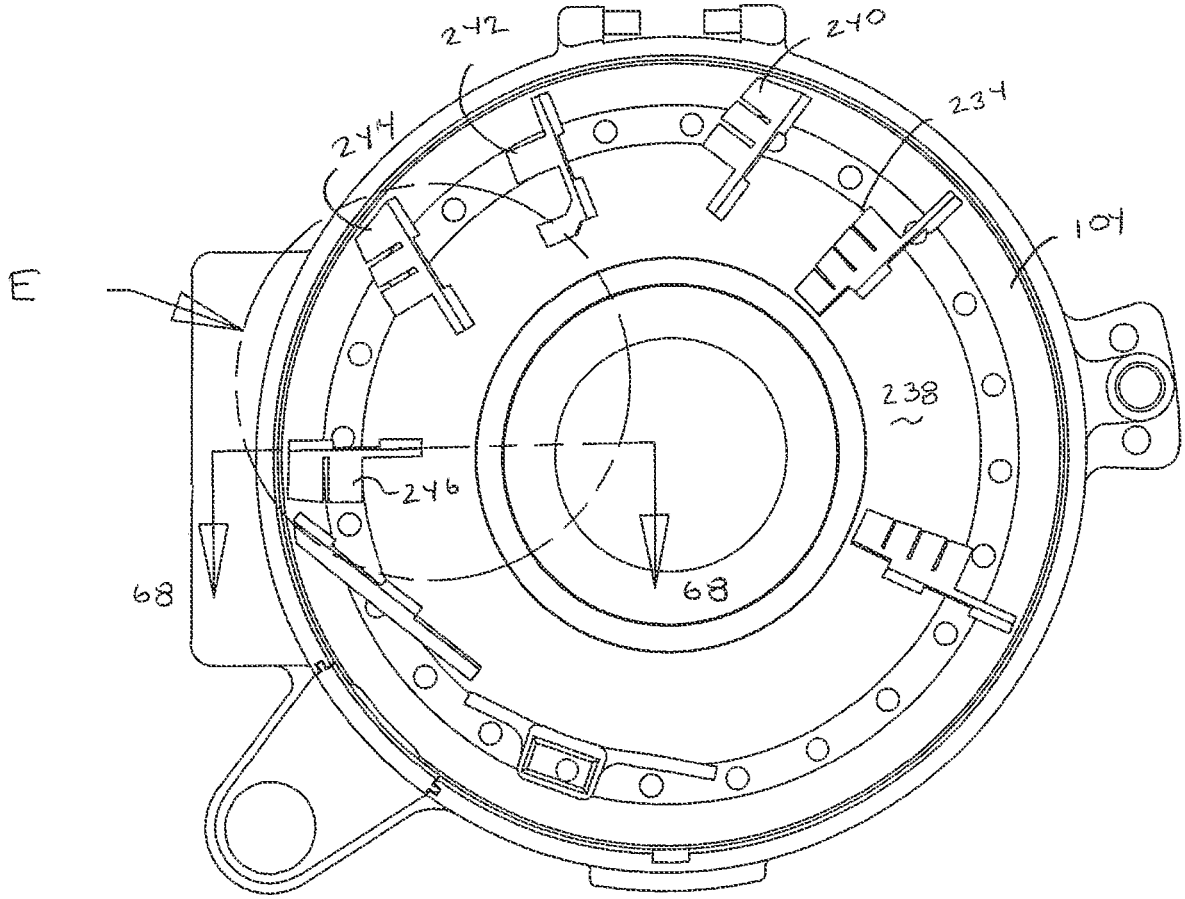
FIG. 67 is a top transparent view of the exemplary pill feed apparatus.
Figure 68:
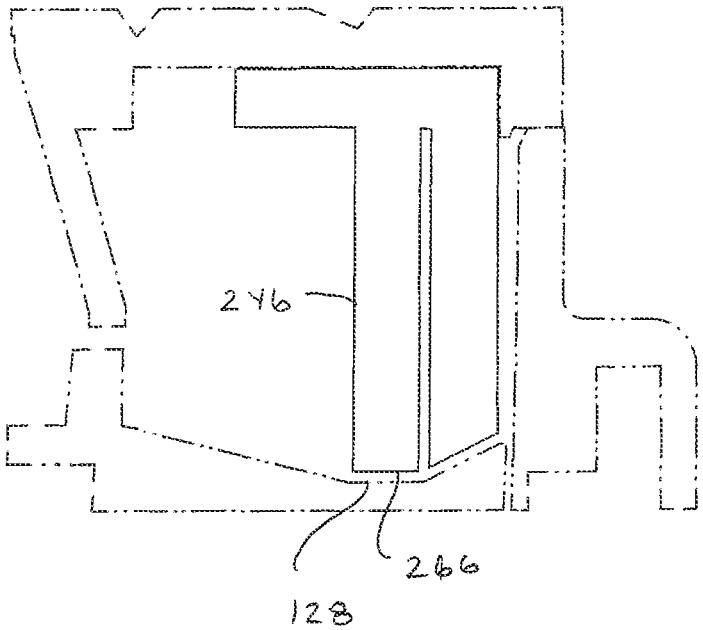
FIG. 68 is a cross-sectional view taken along lines 68-68 in FIG. 67 with the inserter and the feeder disc shown in phantom.
Figure 69:
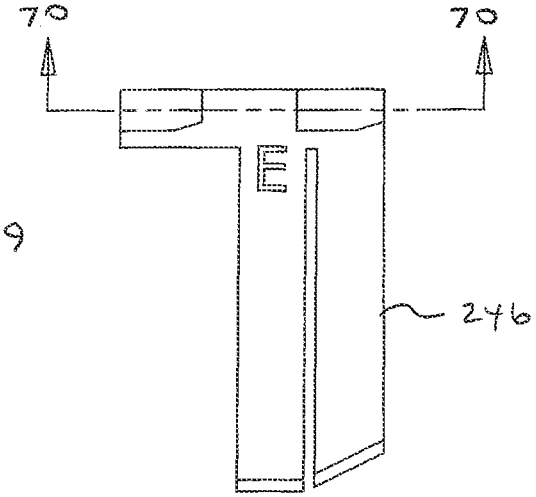
FIG. 69 is a front view of brush E including the mount portion thereof.
Figure 70:
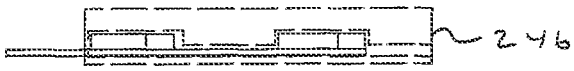
FIG. 70 is a cross-sectional view taken along line 70-70 in FIG. 69.

FIG. 67 is a further top transparent view showing the chamber 238 and an area E thereof in which brush 246 acts upon the pills that are supported on the upper surface of the feeder disc 104. Brush 246 (brush E) is shown in greater detail in FIG. 68. The inward surfaces 266 of brush 246 are positioned in close proximity to the planar portion 128 which includes the pill engaging apertures 120 and also the outer annular tapered portion 138 of the feeder disc. The exemplary brush 246 further aggressively sweeps over the pill engaging apertures 120 to remove any pills overlying a pill that is already positioned by being nested in the lower portion of the aperture. The sweeping action of the inward surfaces 266 further reorients any pills that are engaged in the aperture but not properly positioned. As can be appreciated the inward surfaces 266 of brush 246 provide open space radially inward of the planar portion 128 which enable the passage of pills therethrough.

Figure 71:
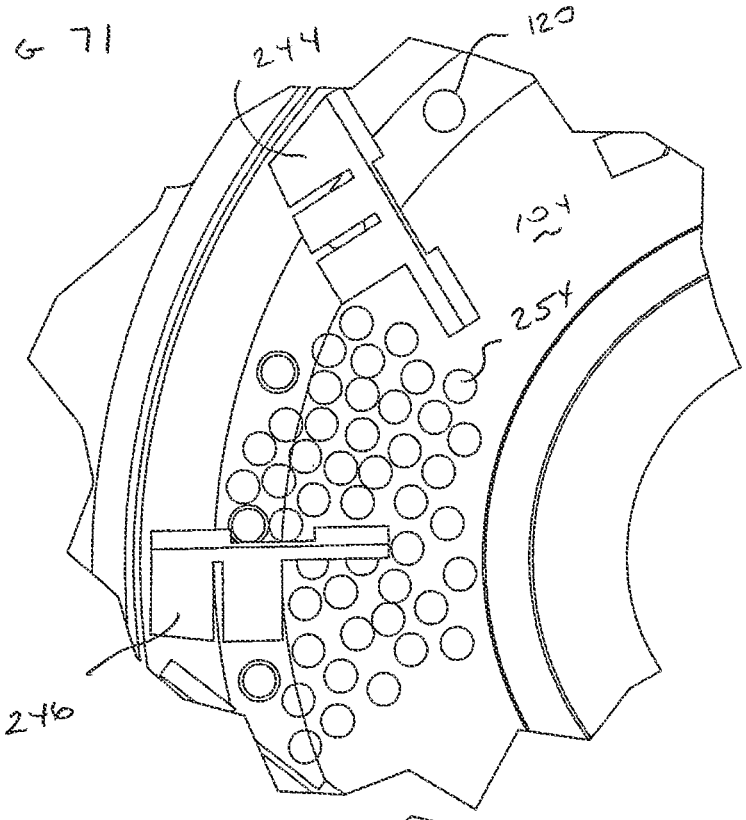
FIG. 71 is a top transparent view of area E in FIG. 67 with a plurality of pills and a corresponding feeder disc.

In FIG. 71 the pills 254 are shown as being urged by the brush 246 to move radially inward to move past the brush. Further the inward surfaces of the brush 244 engage pills in the pill engaging apertures 120 to remove any overlying double pills and to reorient pills that may be not properly oriented and positioned within the respective apertures.

Figure 72:
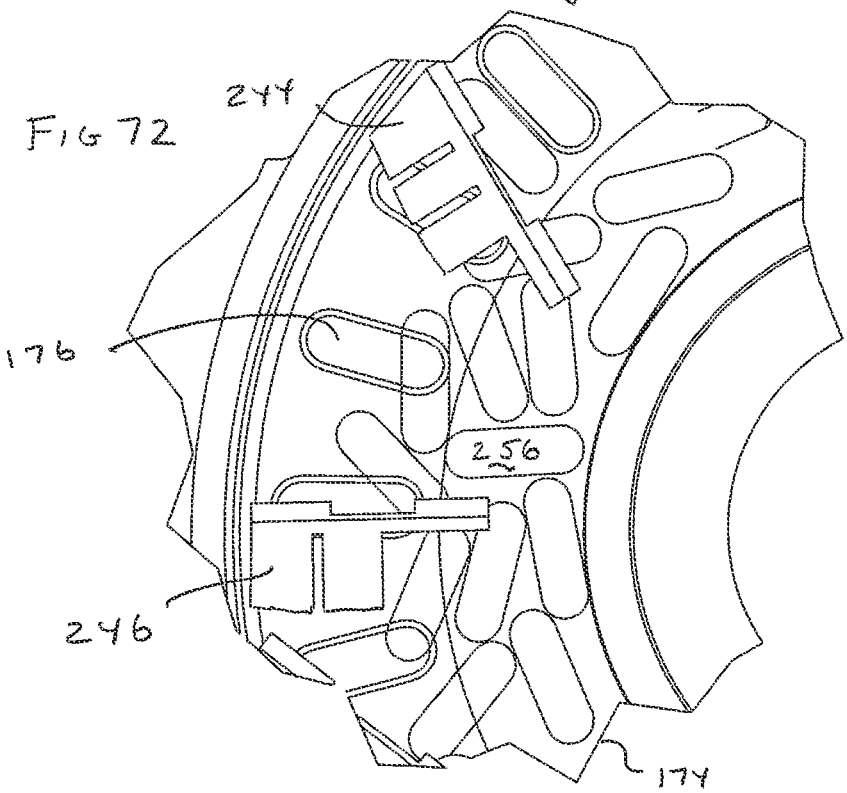
FIG. 72 is a top transparent view of area E in FIG. 67 of the plurality of capsules and a corresponding feeder disc.

FIG. 72 shows the operation of brush 244 in moving pills 256 in the capsule configuration into the apertures 176 of feeder disc 174. As is the case with the pills 254, brush E operates to remove pills overlying pills that are already properly positioned in a pill engaging aperture, as well as to reorient pills that are engaged but not properly oriented within the apertures. Further brush 244 operates to cause the pills that are not positioned in an aperture to move radially inward on the inward surface of the feeder disc 174 to move past the brush.

Figure 73:
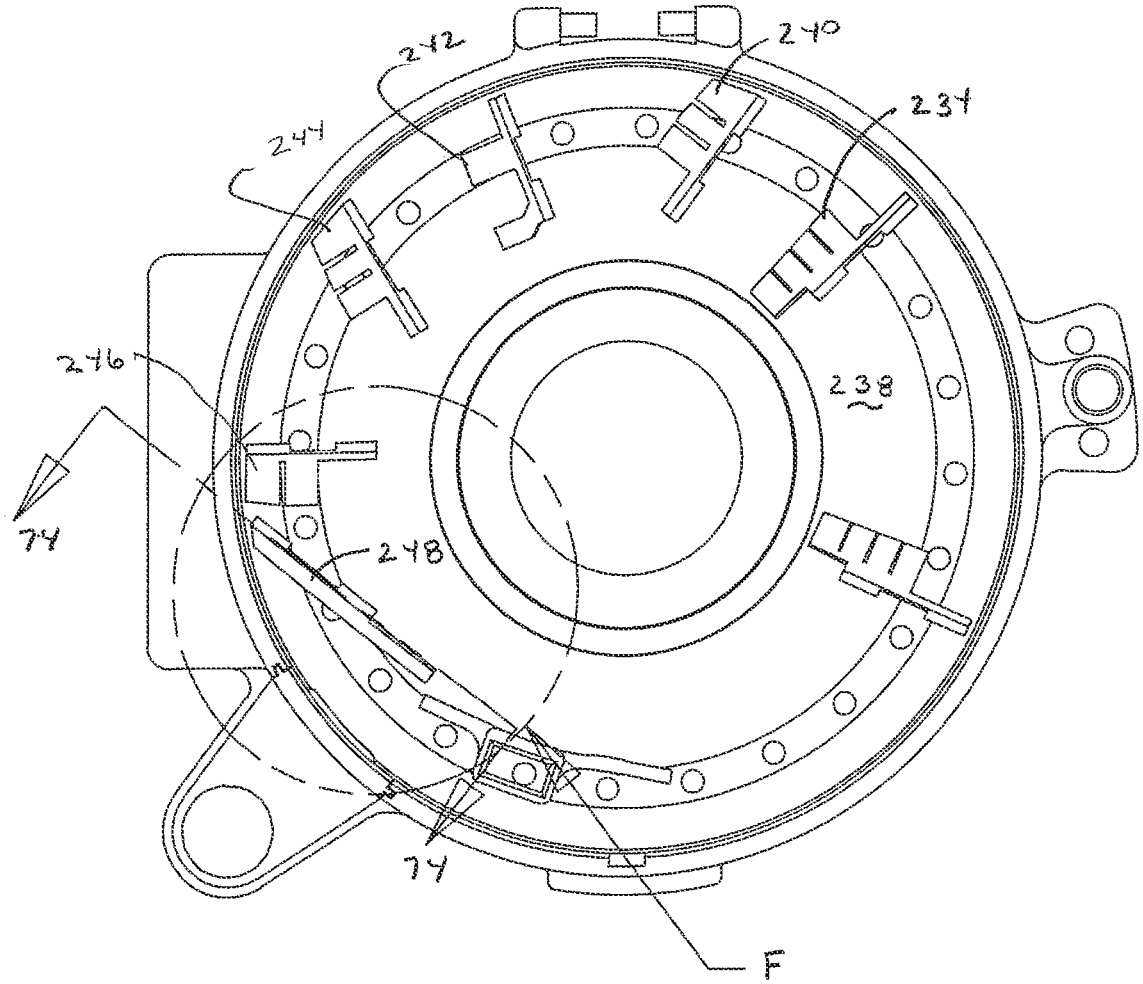
FIG. 73 is a top transparent view of the exemplary pill feed mechanism.
Figure 74:
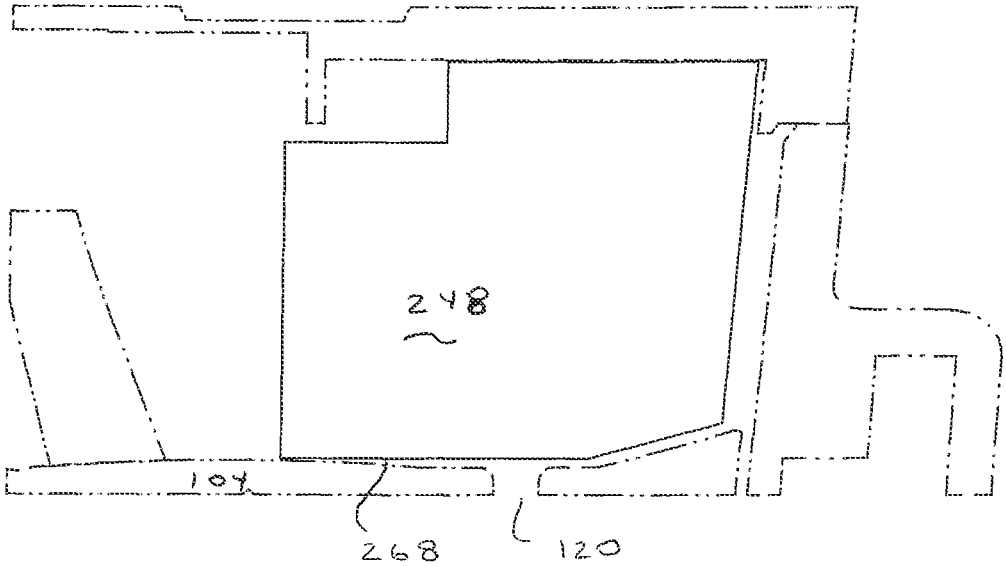
FIG. 74 is a cross-sectional view along line 74-74 in FIG. 73 with the inserter and the feeder disc shown in phantom.
Figure 75:
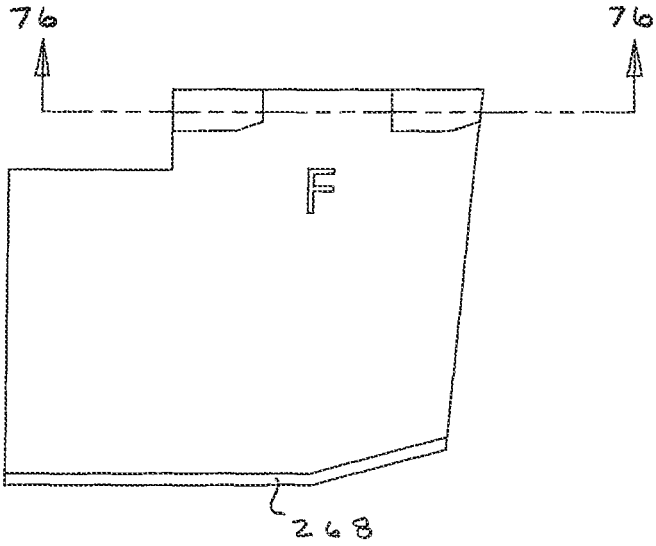
FIG. 75 is a front view of brush F including the mount portion thereof.
Figure 76:
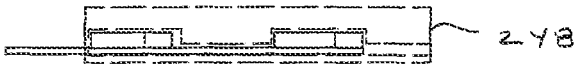
FIG. 76 is a cross-sectional view taken along line 76-76 in FIG. 75.

FIG. 73 is a further top transparent view of the inserter showing the chamber 238. FIG. 73 highlights an area designated F within the chamber in which brush 248 is positioned. As shown in FIG. 74 brush 248 (brush F) is angled inwardly from the outer periphery of the base interior area/chamber and has an inward surface 268 that is in close engagement with the corresponding upper surface of the feeder disc 104. The exemplary brush 248 extends substantially across the radially outward portion of the feeder disc and in overlying relation of the pill engaging apertures 120. Further the brush 248 of the exemplary arrangement is not comprised of inward extending strips but rather a continuous material which is more resistant to deflection and deformation than some of the inward surfaces of other brushes used in the exemplary arrangement.

Figure 77:
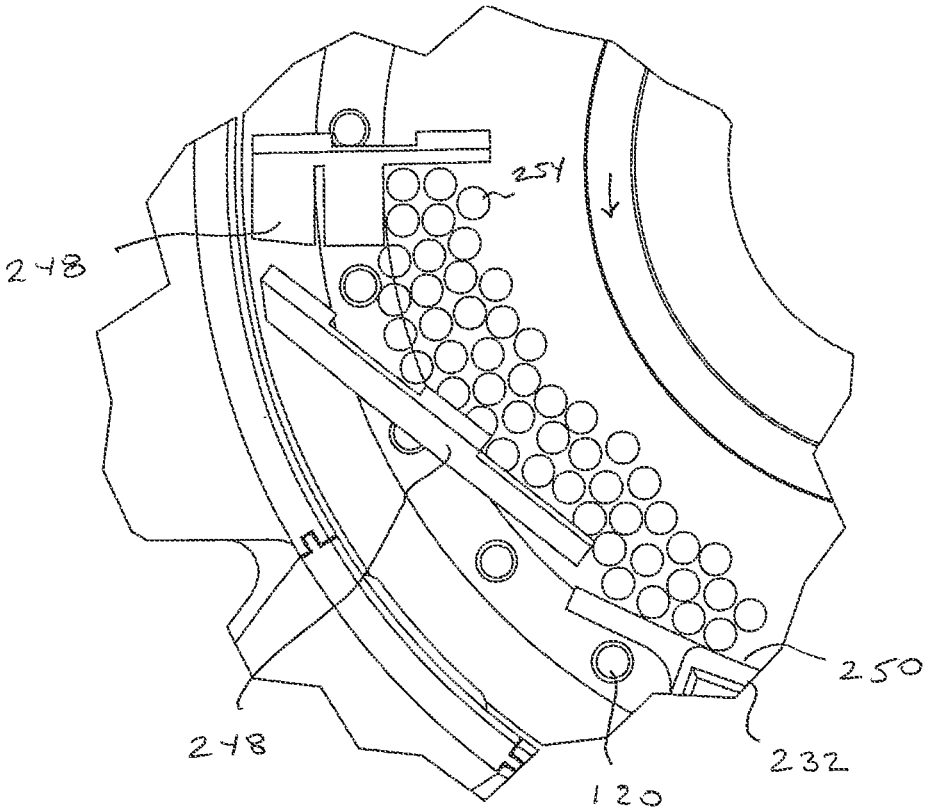
FIG. 77 is a top transparent view of area F in FIG. 73 with a plurality of pills and a corresponding feeder disc.

As shown in FIG. 77 the exemplary brush 248 operates to engage and guide pills 254 which are moving in engaged relation with the upper surface of the feeder disc, further radially inward from the radial position to which the pills are moved by the preceding brush 248. The exemplary brush 248 (brush F) guides the pills further radially inward beyond the pill guiding face 250 of the diverter 232. Thus in this exemplary arrangement the brush 248 moves all the other pills that are not positioned in a pill engaging aperture radially inward such that the pills are disposed away from the pill engaging apertures. This helps to position the pills so that they are away from the apertures 120 when the apertures move to be in vertically overlying relation of the drop opening 28 in which the pills are delivered into the packaging encapsulation mechanism.

Figure 78:
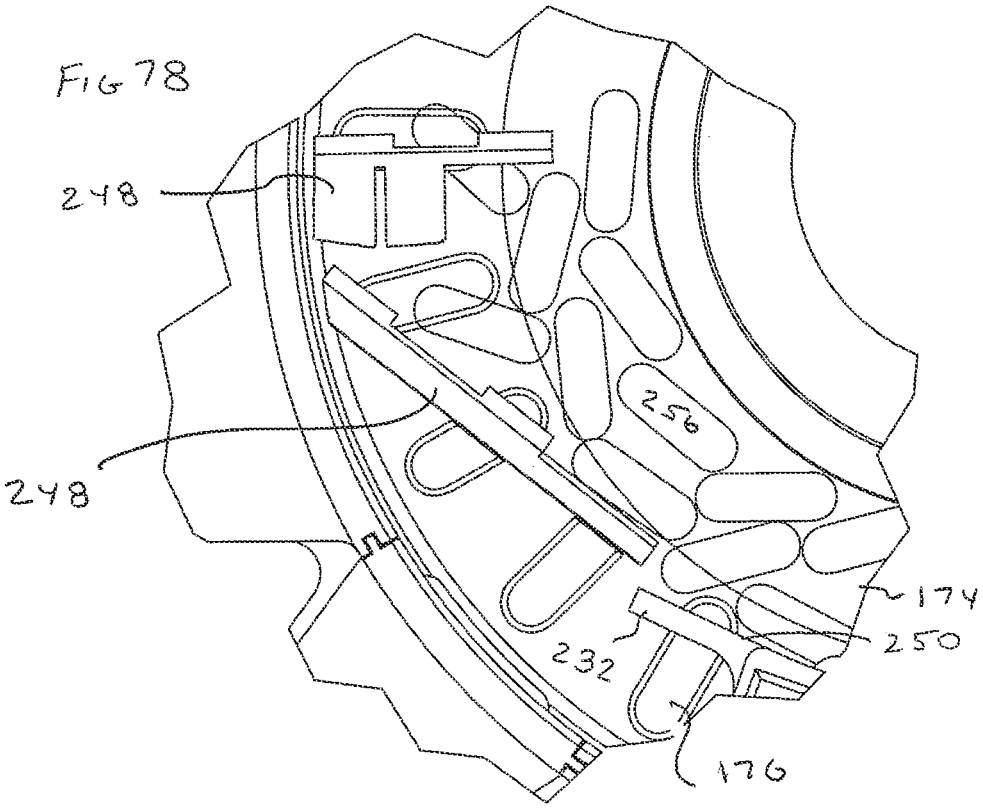
FIG. 78 is a top transparent view of area F in FIG. 73 with a plurality of pills and a corresponding feeder disc.

FIG. 78 shows the similar operation of brush 248 in the processing of pills 256 which are in the configuration of capsules which are positioned in apertures 176 of feeder disc 174. In this configuration the brush F operates in a similar fashion to move the pills further radially inward beyond the pill guiding face 250 of the diverter 232. The brush F further helps to assure that no pills other than those that are positioned within the pill engaging apertures reach the area vertically above the drop opening 28.

Figure 79:
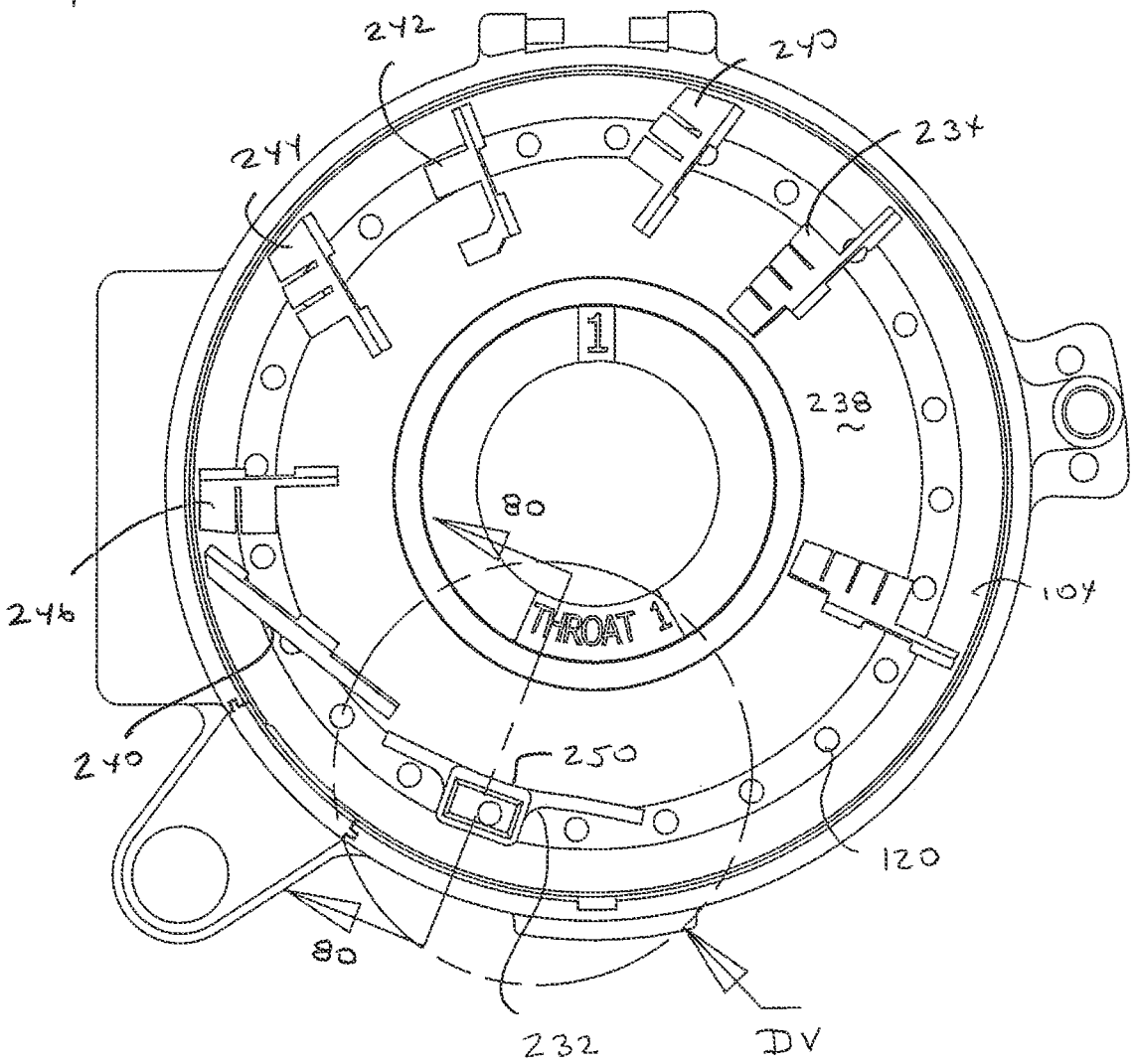
FIG. 79 is a top transparent view of the exemplary pill feed apparatus.

FIG. 79 is a further transparent view of the chamber 238 in which the pills are separated and individually delivered to the exemplary pill encapsulating mechanism that places the pills in individual unit dose packages. FIG. 79 highlights an area designated DV in which the diverter 232 operates to hold the pills that are not positioned within a pill engaging aperture radially inward away from area of the drop opening 28. The diverter 232 includes pill guiding face 250 which is disposed slightly radially outward from the innermost end of the pill guiding surface on brush 240 (brush F). Further the diverter 232 is movably mounted vertically in guided connection on the diverter support post 230 which extends downward from the inside face 208 of the inserter 66. The exemplary pill guiding face 250 of the diverter extends angularly across the upper surface of the feeder disc 104 to an angular position in the rotational direction that is beyond the drop opening 28 in the machine. This helps to assure that only those pills that are positioned within a pill engaging aperture 120 will move individually downward into the drop opening to the encapsulation mechanism within the packaging machine.

Figure 80:
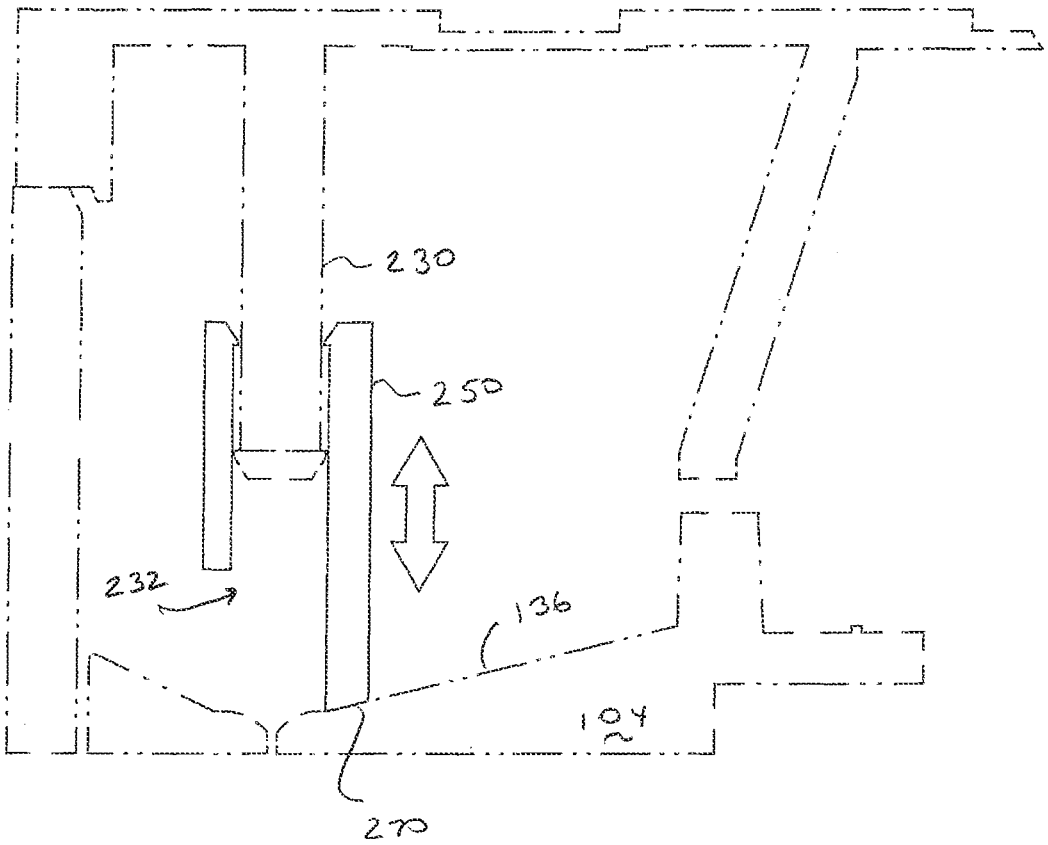
FIG. 80 is a cross-sectional view taken along line 80-80 in FIG. 79 with the inserter and the feeder disc shown in phantom.
Figure 81:
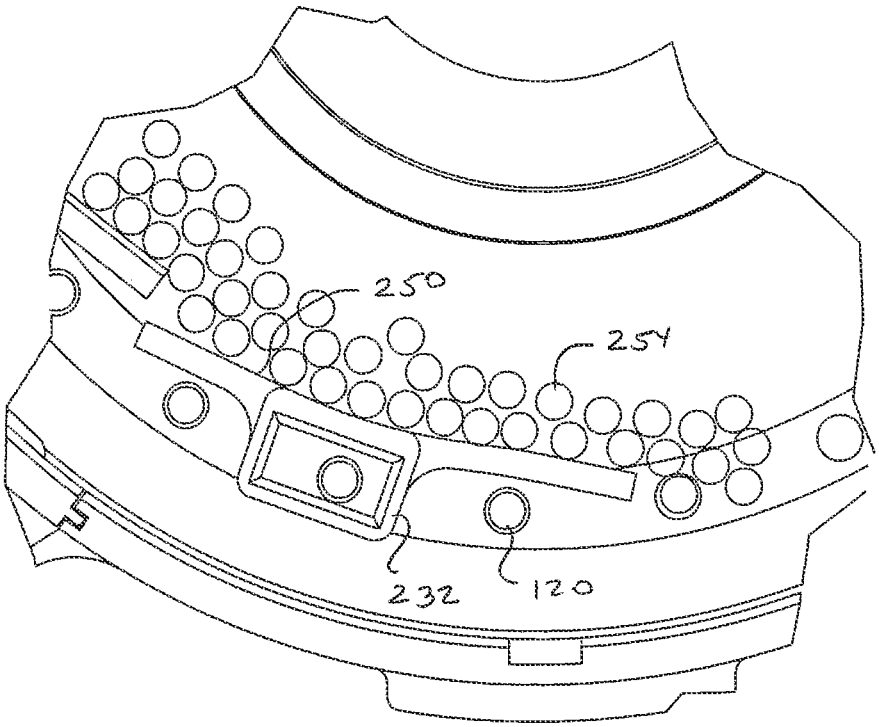
FIG. 81 is a top transparent view of area DV in FIG. 79 showing the diverter, a plurality of pills and a corresponding feeder disc.
Figure 82:
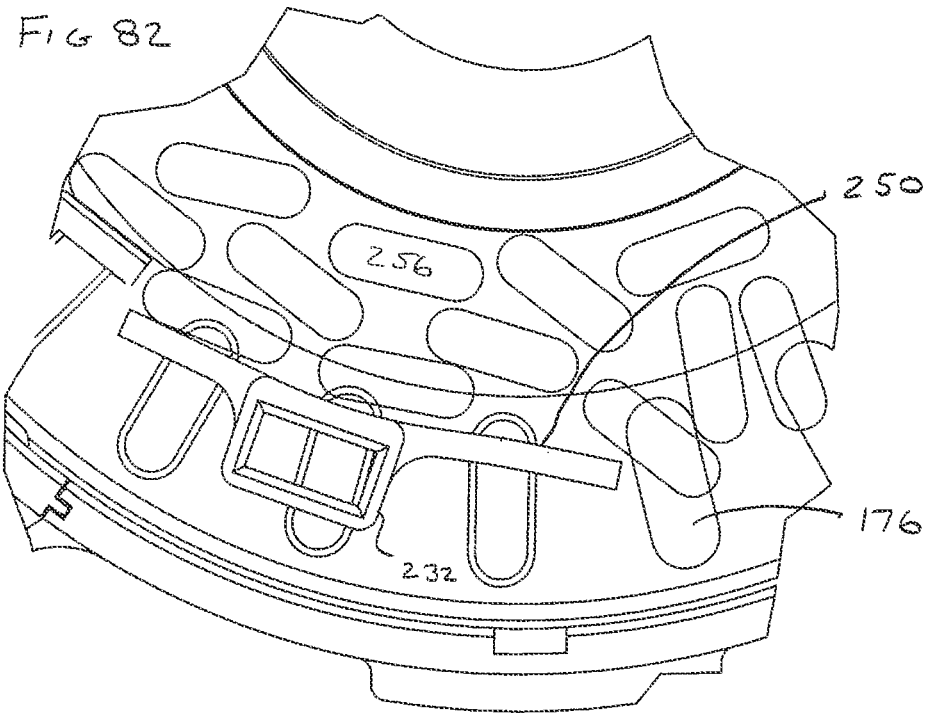
FIG. 82 is a top transparent view of area DV in FIG. 79 showing a diverter, a plurality of capsules and a corresponding feeder disc.

As shown in FIG. 80 the inward surface 270 of the pill guiding face 250 of the diverter 232 rides in abutting engagement with the inward conical portion 136 of the feeder disc 104. This helps to maintain the pills radially inward from the pill engagement apertures. This is shown in FIG. 81 in which pills 254 are held radially inward away from apertures 120 as each aperture with a respective pill positioned therein moves vertically above the drop opening 28. After the remaining pills 254 have moved in engagement with the upper surface of the feeder disc in the rotational direction of the feeder disc beyond the drop opening, the pills 254 are enabled to disengage from the pill guiding face 250 and again move radially outward. It is shown in FIG. 82 how the exemplary diverter 232 operates in a similar manner in connection with pills 256 that have a capsule configuration. The pill guiding face 250 operates to maintain all the pills 256 other than those that are engaged in the pill engaging apertures 176, radially inwardly away from the pill engaging apertures as the apertures pass in overlying relation of the drop opening.

It should be understood that the arrangement shown is exemplary and in some other arrangements the functions carried out by the diverter may alternatively be achieved through use of one or more deformable brushes that move the pills that are not positioned within a respective pill engaging aperture radially away from each aperture as it is in vertically overlying relation of the drop opening. Further it should be understood while the exemplary pill engaging surface of the diverter provides a generally straight surface along which pills may travel while in engaged relation with the tapered inner annular surface of the feeder disc, other arrangements may utilize other surface configurations to position pills away from the apertures in vertically overlying relation of the drop opening, and to subsequently enable pill movement radially toward the pill engaging apertures after apertures have moved past the drop opening.

As can be appreciated those pills that were not delivered into the drop opening and are remaining in engagement with the upper surface of the feeder disc are carried therewith into engagement with the brush 234 that is spaced ahead of the top opening 204 in the inserter. These remaining pills are then moved to a radially outward position on the top surface of the feeder disc and in overlying relation of the now empty pill engaging apertures 120. This causes further pills to be engaged in the pill engaging apertures through repetition of the engagement of the pills with brushes A through F as the feeder disc rotates.

As can be appreciated the exemplary apparatus is operative to cause a respective one pill to be positioned in each respective pill engaging aperture with each rotation of the feeder disc. In the exemplary operation of the apparatus each rotation begins when the respective pill engaging aperture is empty due to having passed in overlying relation of the drop opening which has caused the pill previously positioned in the aperture to fall into the drop opening. The rotation of the pill engaging aperture then continues as discussed, past each of the plurality of deformable brushes until a pill is positioned in the aperture. A respective pill may be positioned in the respective aperture at any point during the rotation after the respective aperture has moved past the diverter. The engagement of pills with the brushes operates to move pills so that they are positioned in the respective aperture, and once a bill has been positioned in the aperture, to move other pills away from the aperture as the rotation continues to the point where the respective aperture extends again in overlying relation of the drop opening and the rotation is completed. The exemplary configuration of the deformable brushes which move pills circumferentially and radially inward and outward relative to each respective pill engaging aperture during each single feeder disc rotation help to assure that a pill is always positioned within the respective aperture as the aperture moves into a position extending in overlying relation of the drop opening. In addition the pill engaging aperture configurations of the exemplary arrangement help to assure that pills fall into the drop opening from the apertures in an orientation that is suitable for integration into packages provided by the exemplary packaging machine.

In exemplary arrangements the inserter is operative to reliably cause pills to be positioned in the pill engaging apertures for a wide variety of pill configurations without the need to change the position or configuration of any of the brushes. This facilitates the utilization of the pill feed apparatus because the only activity necessary to change from feeding one pill type to another is to change the corresponding feeder disc to the one corresponding to the configuration of pills to be processed. Further in the exemplary arrangement in the event of a problem which causes damage to one or more of the brushes, the mounting configuration of each brush to the inside face of the inserter enables the brushes to be readily replaced. This helps to reduce machine downtime. Of course it should be understood that the approaches described herein are exemplary and in other arrangements other approaches may be used.

Figure 33:
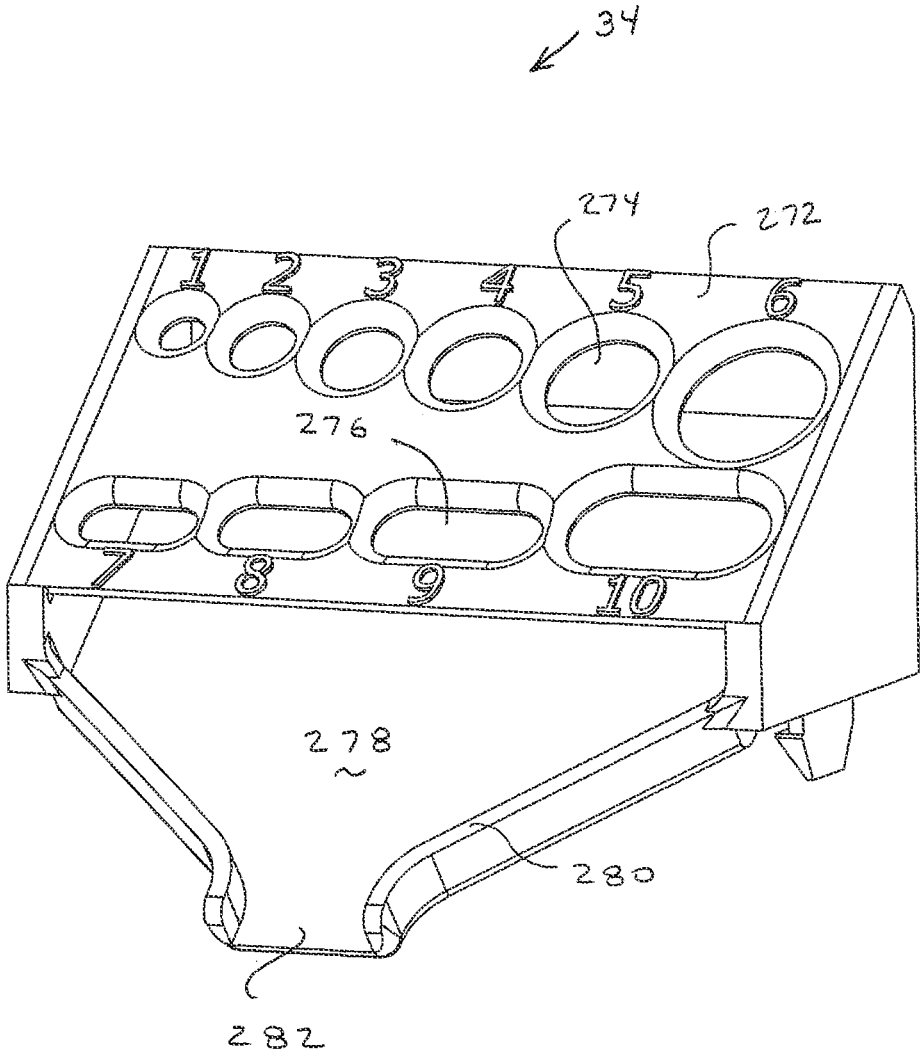
FIG. 33 is a top front right perspective view of a pill sizer of the exemplary apparatus.

The utilization of the exemplary pill feed assembly is further facilitated through the use of the pill sizer 34 that is included therewith. In the exemplary pill sizer 34 is in fixed operative connection with the deck 32. As shown in FIGS. 33-35 the exemplary pill sizer includes an upper face 272 that has a plurality of different openings therethrough. Each of the openings is sized to correspond to a particular pill configuration. Further each opening has associated indicia adjacent thereto which corresponds to the particular pill configuration, as well as the particular feeder disc that is utilized in processing the particular pill configuration. For example the opening 274 in upper face 272 corresponds to the feeder disc identified with the indicia "5". Similarly the opening 276 corresponds to a pill configuration that corresponds to the feeder disc labeled with the indicia "9".

The exemplary pill sizer includes a ramp surface 278 that vertically underlies the upper face and the openings therein. The ramp surface 278 includes convergent guides 280 that extend to a central outlet opening 282. As a result pills that have been passed through the openings fall downward onto the ramp surface 278 and are guided out of the pill sizer through the outlet opening 282. This process is represented in FIG. 35 in which a pill 284 is passed through the opening 276 to determine the size thereof. The indicia adjacent to the smallest opening that a particular pill will pass through in an orientation that corresponds to a horizonal orientation is indicative of the particular feeder disc that can be used to satisfactorily process the particular pill configuration.

In the use of the exemplary pill sizer the pill 284 is moved along a path 286 through the opening 276 to determine the appropriate pill size and feeder disc. In the use of the pill sizer the operator can accurately determine the corresponding feeder disc by attempting to pass the pill through the smallest opening, and sequentially trying larger openings until one is found through which the pill can pass without incurring any deformation of the pill. Once the numerical indicia associated with the smallest opening through which the pill may pass has been identified, the user may select the appropriate feeder disc from the plurality of discs stored in the recesses which comprise the respective disc holders 36 on the deck 32 of the pill feed apparatus.

Of course once the appropriate feeder disc has been determined the operator may install the disc by moving the inserter 66 to the upward position so that it is disposed away from the base ring 42. The operator can then remove the currently installed feeder disc and replace it with the one that is appropriate for the particular pill configuration that is desired to be processed. Once the chosen feeder disc is installed within the base ring and engaged with the drive platter 82, the inserter can be lowered into the operative position and the pills to be processed placed within the chamber. Of course it should be understood that to change the particular pills processed by the machine in some arrangements may require reprogramming of the labeling mechanism of the packing to mark the unit dose packages with the correct pill information as well as changing the packaging material which is utilized in connection with the packaging machine.

A further useful aspect of the exemplary arrangement of the pill feed apparatus is that it is driven by the existing mechanism of a packaging machine. The exemplary arrangement does not include additional drive motors, sensors or other items which have to be connected and integrated into the circuitry of the packaging machine. Of course it should be understood that in other exemplary arrangements pill feed devices that employ the principles described herein may incorporate motors, sensors or other components which facilitate the operation of the pill feed apparatus.

Further while the exemplary arrangement has been described as utilized in connection with an existing single dose packaging machine, other exemplary arrangements may be integrated into machines having other configurations and that integrate the components of the pill feeding apparatus therein. Additionally, exemplary arrangements of the apparatus may be comprised of environmentally friendly materials such as biodegradable plastics. Components of the exemplary arrangements may be comprised of such materials which can be safely disposed of after their useful life without harm to the environment.

Figure 83:
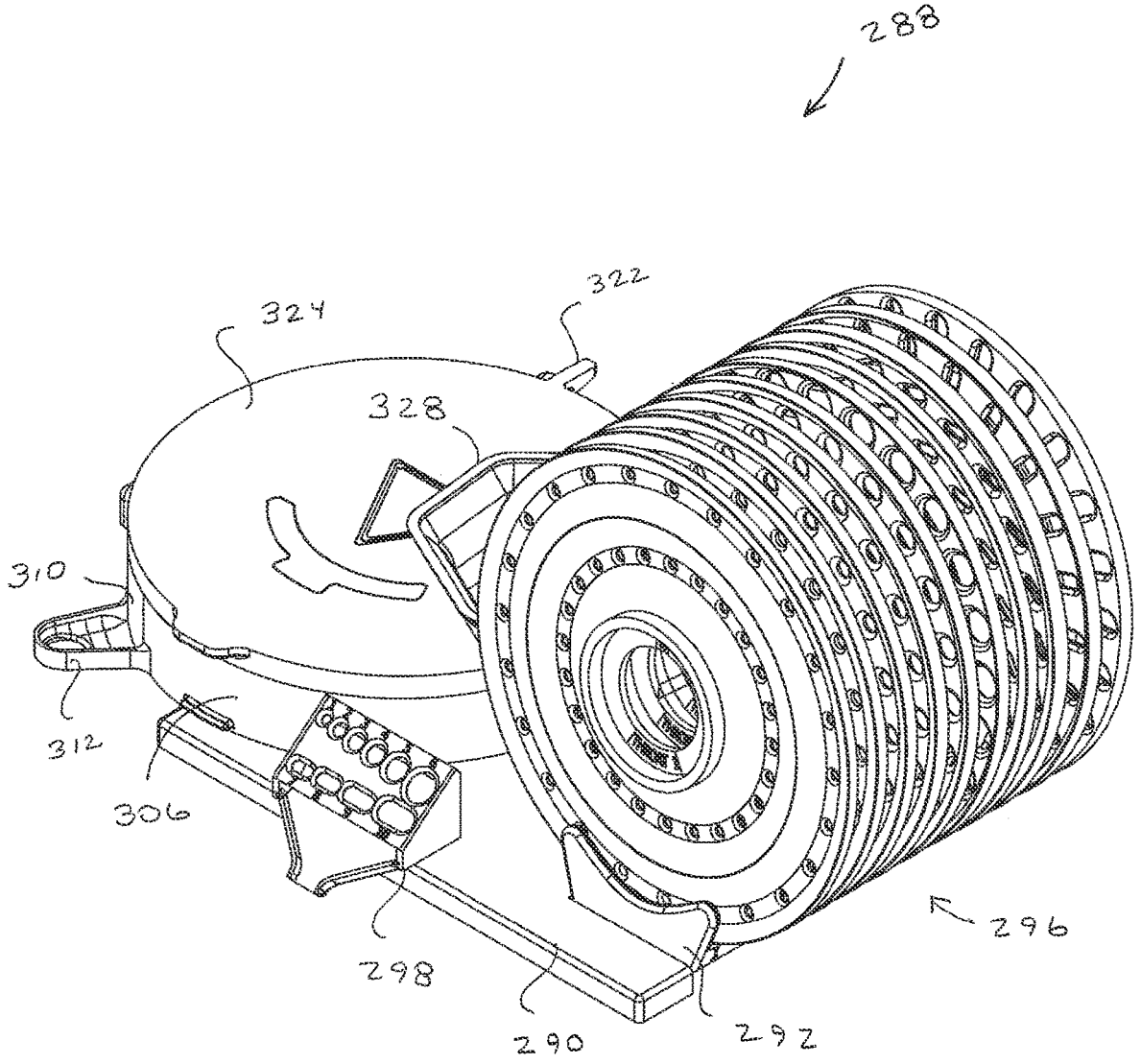
FIG. 83 is a top front right perspective view of a unit dose packaging machine similar to those previously described but with a mechanism suitable for packaging two pills simultaneously, and with the pill disc and pill supporting tray replaced with an alternative dual pill feed apparatus of an alternative arrangement.
Figure 84:
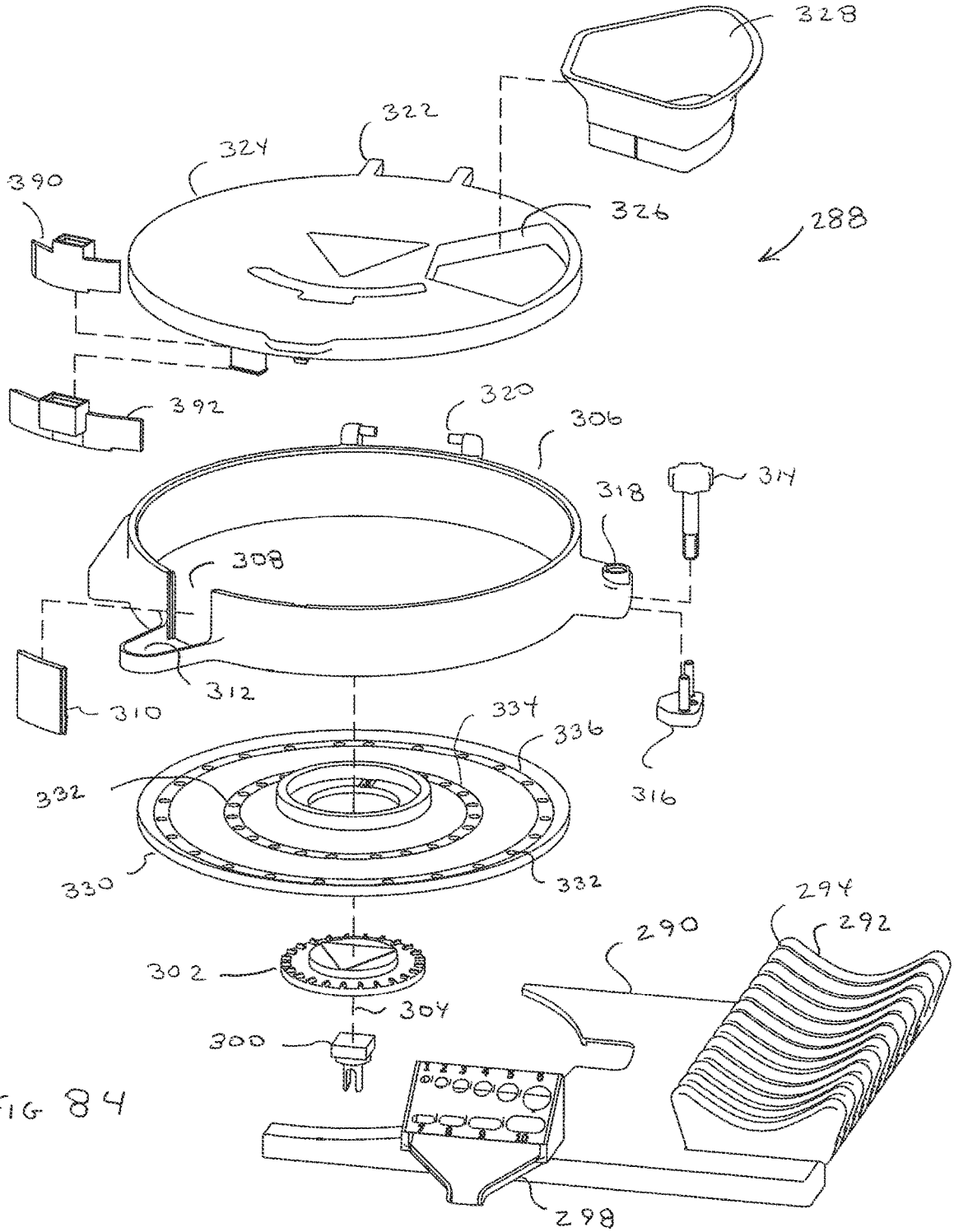
FIG. 84 is an exploded view of the dual pill feed apparatus shown in FIG. 83.

Alternative exemplary arrangements of a pill feed apparatus that utilizes the principles previously described may also be used in connection with packaging machines that package two pills of the same type simultaneously. Such an exemplary pill feed apparatus 288 is shown in FIGS. 83 and 84. The exemplary apparatus includes features similar to previously described pill feed apparatus 30 except as otherwise mentioned.

The exemplary pill feed apparatus includes a deck 290 which is similar to the previously discussed deck 32. Deck 290 has in operative connection therewith disc holders 292 with recesses 294 extending therebetween. The disc holders 292 are configured to hold respective dual feeder discs 296 as later discussed. The exemplary deck 290 further has in connection therewith a pill sizer 298 which may be similar to pill sizer 34 previously discussed. Of course these components are exemplary and in other arrangements other components and arrangements may be used.

The exemplary dual pill feed apparatus 288 also has associated therewith a drive pin 300. The drive pin in this arrangement may be similar to previously described drive pin 68. A drive platter 302 is engaged with the drive pin 300 in the operative position thereof. The drive pin and drive platter are rotatable about an axis 304. The exemplary drive platter 302 includes a central cylindrical projection and torque limiting tapered projections similar to the previously described drive platter. Of course it should be understood that in other arrangements other features which accomplish comparable functions or that provide different features and functions may be used.

The exemplary dual pill feed apparatus further includes a base ring 306. Base ring of this exemplary arrangement extends above the deck 290 and may be similar to base ring 42 of the previously described arrangement. Base ring 306 includes a clean out opening 308 that is closable by an access cover 310 similar to the previously described arrangement. The exemplary base ring further includes an external pill holding pocket 312 that functions similar to the pill holding pocket associated with base ring 42. Base ring 306 also includes suitable mounting components for mounting the pill feed apparatus to the packaging machine. This may include a mechanism including a thumbscrew 314 and a lower clamp 316 that hold the base ring in position by the thumbscrew extending through a mounting opening 318. Of course it should be understood that different types of mounting approaches for the pill feed apparatus may be used depending on the nature of the packaging machine.

Base ring 306 further includes hinge posts 320 which are configured to engage cars 322 of an inserter 324 which is alternatively referred to herein as a cover. Similar to the previously described arrangement the inserter 324 is movably mounted in connection the base ring 306 so that the interior area bounded by the inner wall of the base ring is selectively accessible. Similar to the previously discussed inserter 66, inserter 324 has in mounted relation to an inside surface thereof a plurality of deformable brushes which are operative to engage and position pills within the pill engaging apertures of dual pill feeder discs having various configurations. The exemplary inserter 324 further includes a top opening 326 therein. The top opening is configured to engage a pill receiving funnel 328. Similar to the previously described inserter arrangement, the pill receiving funnel is configured to receive pills that are to be separated and delivered by the feed apparatus one at a time into respective drop openings in the packaging machine.

In addition to the pill engaging brushes that are later described in detail herein, the exemplary inserter includes a pair of diverters 390 and 392. Each of diverters 390 and 392 perform a similar function to diverter 232 previously discussed. Further each diverter is movably mounted vertically on a respective support post which is attached to the inserter. Diverters 390 and 392 are radially aligned with one another and are movable vertically in the operative position. Diverter 390 is disposed radially inward of diverter 392. Each of the diverters is enabled to maintain contacting engagement with an upper surface of the underlying dual pill feeder disc when the inserter and the disc are in the operative positions.

The exemplary dual pill feed apparatus is used in connection with different dual pill feeder discs such as for example dual pill feeder disc 330. The exemplary feeder discs used with the dual pill feed apparatus 288 include features similar to the feeder discs previously described. However the dual pill feeder discs utilized in this exemplary arrangement include pill engaging apertures 332 that are arranged in a pair of axially centered concentric circular portions 334, 336 on the feeder disc. In exemplary arrangements the pill engaging apertures 332 in each of the circular portions are aligned radially. This configuration is used in the exemplary arrangement because the exemplary packaging machine in which the dual pill feed apparatus 288 is utilized includes a plate upper surface 229 which includes a pair of radially aligned drop openings (331, 333) into which pills positioned in the apertures 332 fall downward into the packaging mechanism. In some arrangements this may be similar to the drop openings and packaging mechanisms utilized in the previously described arrangement. However in the exemplary dual pill feed arrangement a pair of pills are enabled to each be individually delivered into the respective packaging mechanisms simultaneously as the dual pill feeder disc moves to a position in which each of a respective pair of apertures are each aligned in overlying relation with one respective drop opening. Of course it should be understood that this configuration is suitable for use with packaging machines that have drop opening configurations of this type, and in other packaging machine arrangements other types of feeder configurations utilizing the principles described herein may be used.

Figure 85:
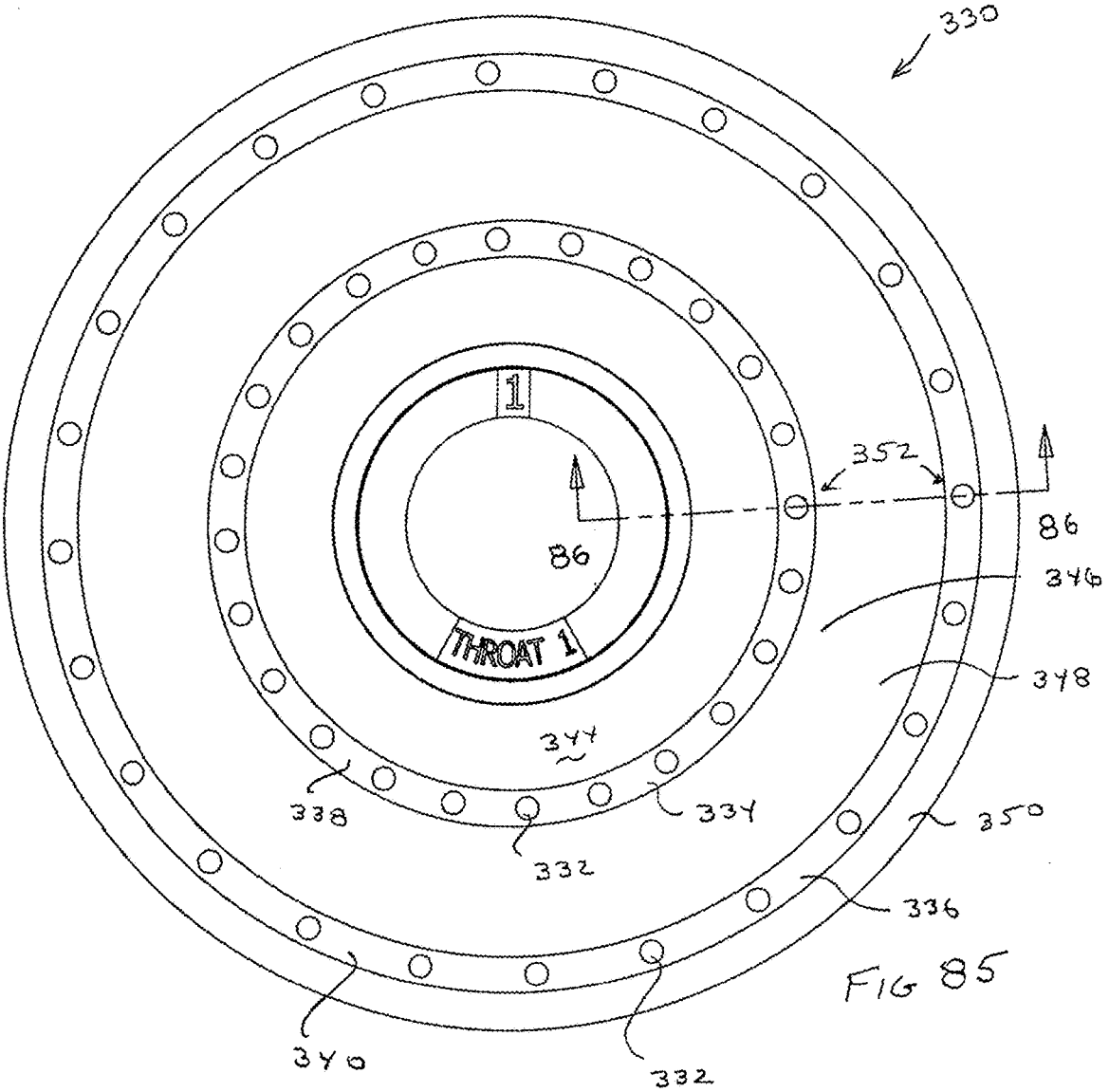
FIG. 85 is a top plan view of an exemplary dual pill feeder disc.
Figure 86:
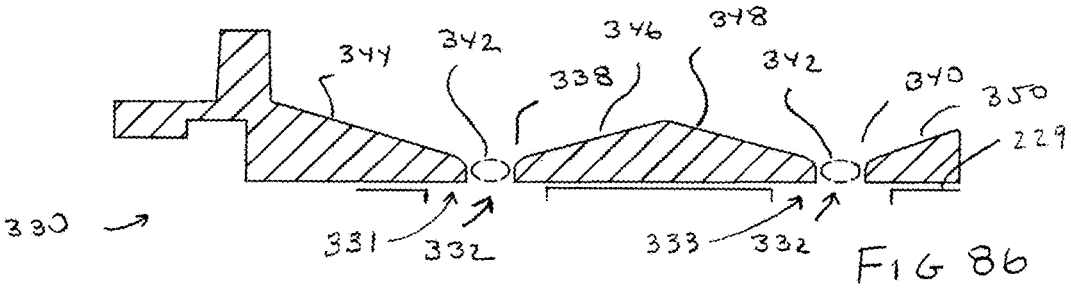
FIG. 86 is a cross-sectional view of the feeder disc shown in FIG. 85 taken along line 86-86.

The exemplary dual pill feeder disc 330 is shown in greater detail in FIGS. 85 and 86. In this exemplary arrangement the pill engaging apertures 332 in the inner circular portion 334 extend through the disc and are positioned in a circular surface portion 338. The pill engaging apertures 332 in the outer circular portion 336 extend through the disc and are positioned in a circular surface portion 340. The exemplary circular surface portions 338, 340 include tapered bounding surfaces which facilitate positioning of a single pill 342 of a designated configuration in each respective pill engaging aperture 332.

The exemplary dual pill feeder disc 330 includes an annular conical portion 344. The annular conical portion 344 has an upper surface that is downwardly and outwardly tapered in radially transverse cross-section toward the inner apertures 332 and circular portion 338. An intermediate inner annular tapered portion 346 is positioned radially outward from the circular surface portion 338. Intermediate inner annular portion 346 in radially transverse cross-section is bounded by an upper surface that is tapered radially inwardly downward toward circular portion 338. This facilitates the movement of pills 342 into respective pill engaging apertures 332 of the inner circular portion 334 in a manner like that later discussed.

The exemplary dual pill feeder disc 330 further includes an intermediate outer annular portion 348. Intermediate outer annular portion 348 in radially transverse cross-section is bounded upwardly by a surface that is tapered outwardly and downward toward the outer circular portion 336 and the outer pill engaging apertures 332 that extend therein. An outer annular tapered portion 350 is positioned radially outward of circular portion 340. In radially transverse cross-section as shown in FIG. 86 outer annular tapered portion 350 is bounded upwardly by a surface that is tapered radially inwardly and downward toward the circular surface portion 340 and the pill engaging apertures 332 therein. This exemplary configuration facilitates the movement of pills 342 into respective pill engaging apertures 332 in the outer circular portion 336 in a manner like that later described.

Of course it should be understood that in the exemplary arrangement as shown in FIGS. 85 and 86 the pill engaging apertures 332 are arranged in radially aligned relation in respective pairs such as pair 352 for example. This radially aligned pair configuration assures that each pill engaging aperture 232 in a respective pair is positioned over a respective drop opening of the packaging machine at the same time as the other aperture 332 of the pair. This assures that each of the two pills are delivered individually into the respective drop openings simultaneously during pill feeding operation of the exemplary arrangement. Of course it should be understood that other feeder disc configurations may be utilized with different packaging machine arrangements.

Figure 87:
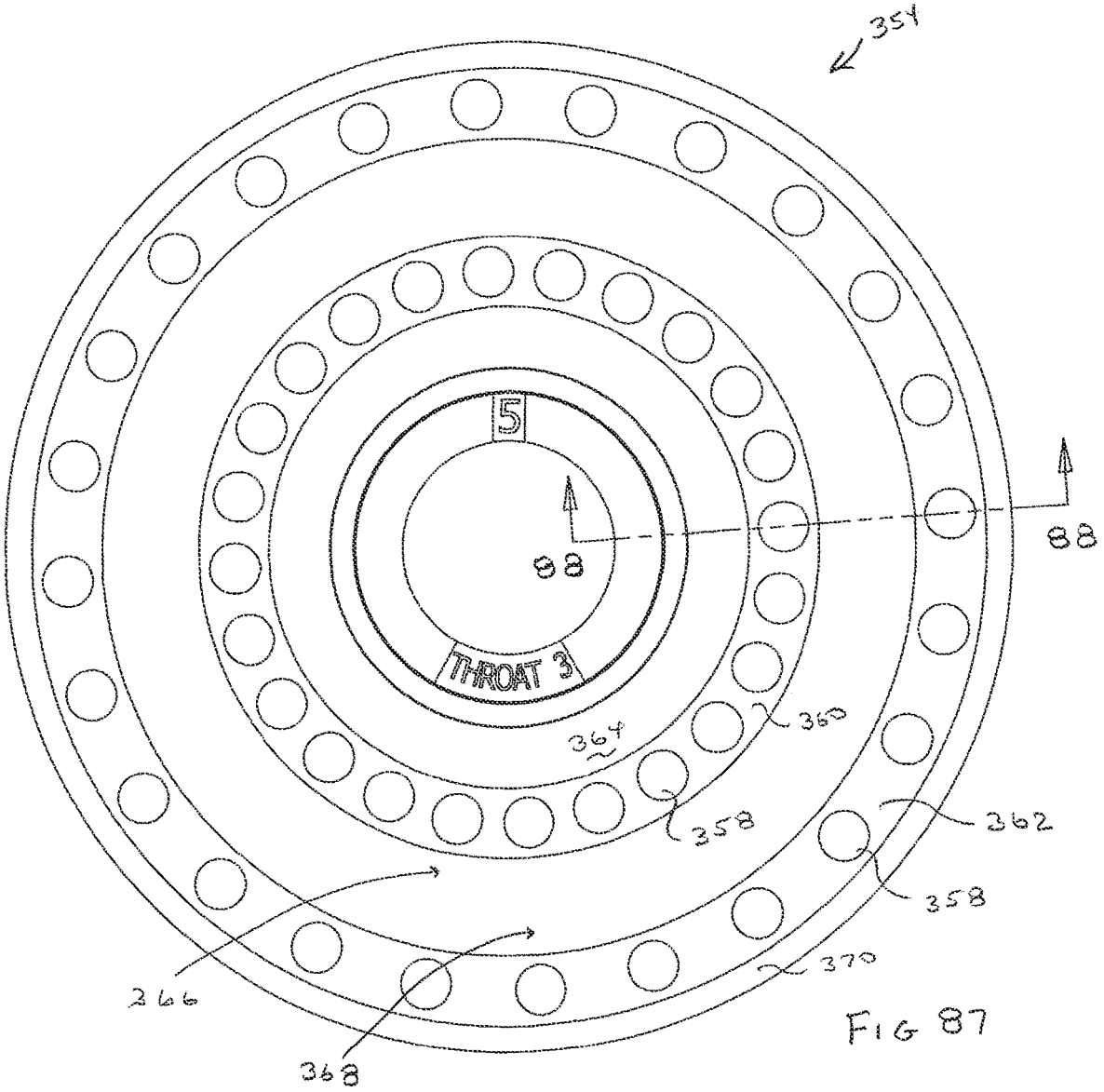
FIG. 87 is a top plan view of an alternative dual pill feeder disc.
Figure 88:
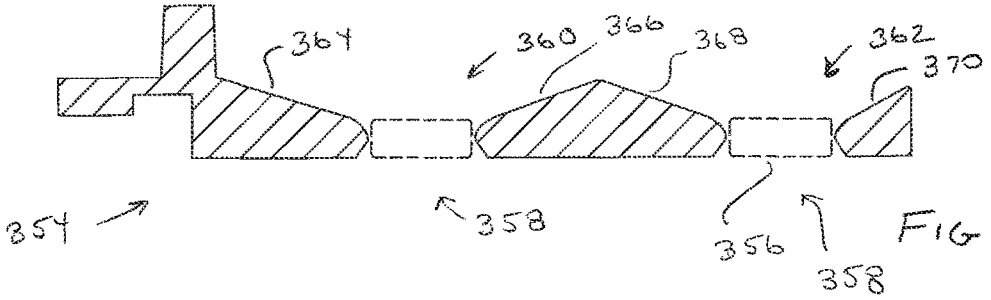
FIG. 88 is a cross-sectional view of the feeder disc shown in FIG. 87 taken along line 88-88.

FIGS. 87 and 88 show an alternative dual pill feeder disc 354. Feeder disc 354 is similar to feeder disc 330 but is configured to hold and deliver pills 356 of a different configuration. Pills 356 are generally cylindrical and have a larger size than pills 342. In this arrangement, dual pill feeder disc 354 has pill engaging apertures 358 positioned in an inner circular portion 360 comprising an inner circle of pill engaging apertures 358, and an outer circular portion 362 comprising an outer circle of pill engaging apertures 358.

Dual pill feeder disc 354 includes an annular radially innermost conical portion 364. Conical portion 364 in transverse radial cross-section as shown in FIG. 88 is bounded upward by a surface that is tapered so that in the operative position the surface thereof is tapered downward toward the pill engaging apertures 358 in the inner circular portion 360. An intermediate inner annular portion 366 is positioned radially outwardly from inner circular portion 360. In transverse cross-section intermediate inner annular portion 366 is bounded upwardly by a surface that is tapered downwardly radially inward toward the pill engaging apertures 358 in inner circular portion 360.

Dual pill feeder disc 354 further includes an intermediate outer annular portion 368. In the operative position and in radially transverse cross-section as shown in FIG. 88, the intermediate outer annular portion 368 is bounded upwardly by a surface that is tapered downwardly with increasing radial proximity to the outer circular portion 362. An outer annular tapered portion 370 is positioned radially outwardly of the outer circular portion 362. In radially transverse cross-section the outer annular tapered portion 370 is bounded upwardly by a surface that is tapered downwardly with increased radial proximity to the outer circular portion 362. As later discussed, this configuration facilitates the engagement of pills 356 in the pill engaging apertures 358 of feeder disc 354 to enable the reliable individual delivery of each pill into the packaging machine.

Figure 89:
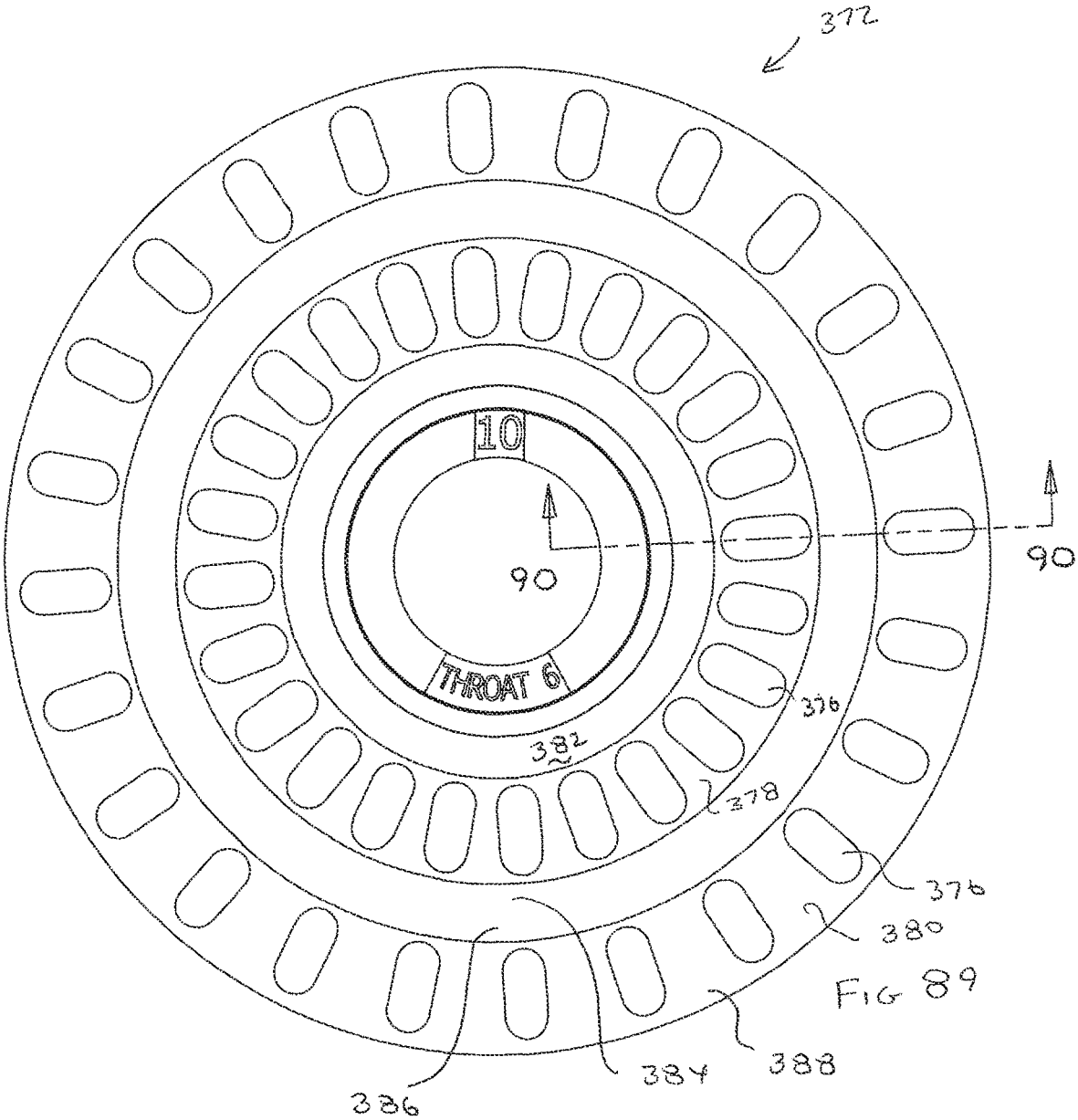
FIG. 89 is a top view of a further alternative dual pill feeder disc.
Figure 90:
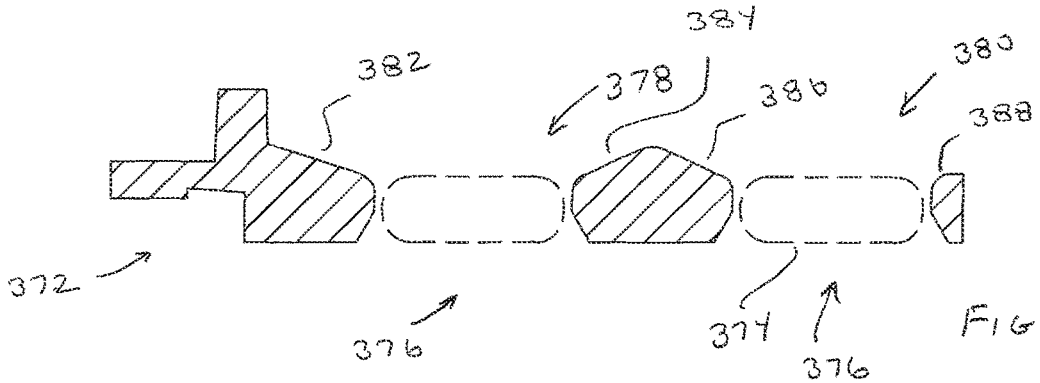
FIG. 90 is a cross-sectional view of the feeder disc shown in FIG. 89 taken along line 90-90.

FIGS. 89 and 90 show a further exemplary dual pill feeder disc 372. Dual pill feeder disc 372 is similar to feeder discs 330 and 354 but is configured for receiving pills 374 having a capsule configuration. In the exemplary arrangement feeder disc 372 includes radially elongated pill engaging apertures 376. The pill engaging apertures 376 extend through the disc and are arranged in an inner circular portion 378 and in an outer circular portion 380.

In radially transverse cross-section and in the operative position as shown in FIG. 90, the dual pill feeder disc 372 includes an annular inner conical portion 382. As shown in FIG. 90 the annular inner conical portion 382 is bounded by an upper surface that is tapered downwardly with proximity to the inner circular portion 378 and the pill engaging apertures 376 therein. Feeder disc 372 further includes an intermediate inner annular portion 384. Intermediate inner annular portion 384 is bounded by an upper surface that is tapered downwardly with radial proximity to the inner circular portion 378 and the pill engaging apertures 376 therein.

Dual pill feeder disc 372 further includes an intermediate outer annular portion 386. Intermediate outer annular portion 386 has an upper surface that is tapered downwardly with radial proximity to outer circular portion 380 and the pill engaging apertures 376 therein. Feeder disc 372 further includes an outer annular tapered portion 388. Outer annular tapered portion 388 has an upper surface that is tapered downward with radial proximity to outer circular portion 380 and the pill engaging apertures 376 therein. As later discussed, this exemplary configuration of the dual pill feeder disc 372 facilitates positioning of pills 374 in the respective pill engaging apertures 376 to cause the pills to be individually delivered into the packaging mechanisms of the packaging machine. Of course this configuration is exemplary and in other arrangements other configurations may be used.

Further it should be understood that the dual pill feeder discs 330, 354 and 372 discussed are examples of numerous dual pill feeder discs which may be used to deliver one pill at a time in two separate locations into a packaging machine. As with the single pill feeder discs previously described, a different feeder disc configuration is used for each pill configuration. However as with the single pill feeder discs, the exemplary inserter, deformable brushes and other structures described herein are suitable for use with each feeding disc and pill configuration.

Figure 91:
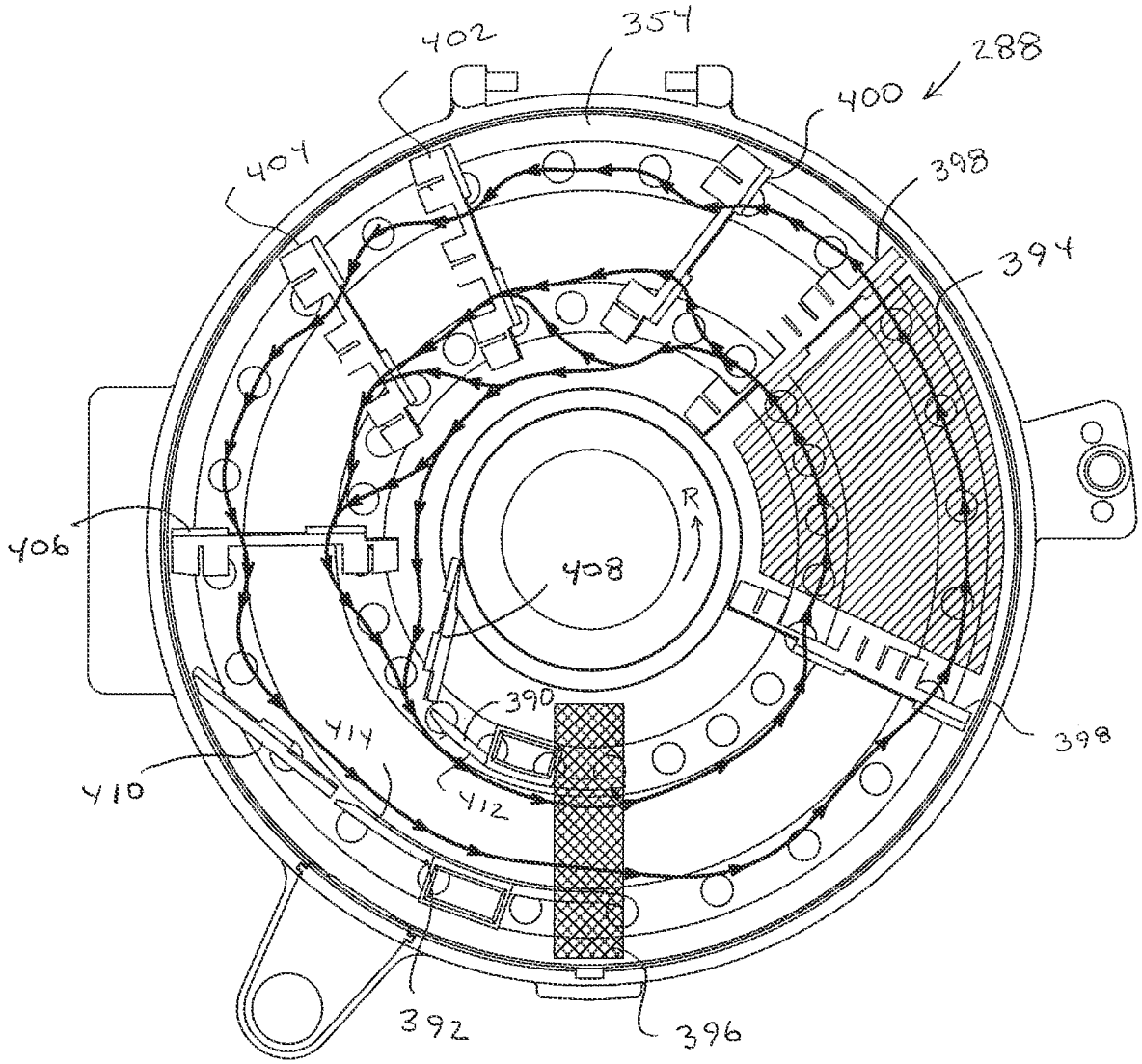
FIG. 91 is a top transparent view of the exemplary dual pill feed apparatus showing the exemplary internal brushes and with arrows showing the paths along which pills move relative to the feeder disc.

FIG. 91 is a top transparent view of the exemplary dual pill feed apparatus 288. FIG. 91 shows the brushes of the exemplary arrangement that are mounted to the inside surface of the inserter 324. In this example the dual pill feeder disc 354 is shown installed in the operative position. In FIG. 91 the shaded area 394 corresponds to the top opening 326 in which pills are received into the interior of the base ring through the funnel 328. The shaded area 396 corresponds to the areas in which the drop openings in a support plate for receiving pills in the packaging mechanisms are located.

A plurality of deformable brushes are in removably mounted relation with the inside face of the inserter. These include brushes 398. Brushes 398 which are shown in greater detail in FIG. 92 are disposed on each angular side of the shaded area 394 into which pills enter the interior area of the base ring. These brushes each extend generally radially in the interior area of the base ring. Brushes 398 are alternatively referred to herein as brushes AA for convenience.

As pills operatively engaged with the upper surface of feeder disc 354 move in the base interior area of the base ring in the direction of Arrow R, the pills, which have moved past brush 398, next encounter brush 400. Brush 400 is shown in greater detail in FIG. 93. The exemplary brush 400 is mounted to extend radially but also so that the radially outward portion is positioned to contact pills angularly in advance of the radially inner portion. Brush 400 is alternatively referred to as brush BB. As the pills move in the interior area in the direction of Arrow R past brush 400 the pills next encounter brush 402. Brush 402 is shown in greater detail in FIG. 94 and is alternatively referred to herein as brush CC. As shown in FIG. 91 brush 402 extends generally radially.

A brush that is next encountered by the pills moving in supported connection with the feeder disc 354, is brush 404. Brush 404 is shown in greater detail in FIG. 95 and is alternatively referred to as brush DD. Brush 404 extends radially but similar to brush 400 has its radially outward portion angularly advanced toward the direction of rotation compared to the radially inner portion. Next encountered by pills moving in the interior area of the base ring is brush 406 which is shown in greater detail in FIG. 96. Brush 406 extends radially and is alternatively referred to herein as brush EE.

A brush 408 extends radially inward from the outer wall of the base ring. Brush 408 which is shown in greater detail in FIG. 97 is alternatively referred to as brush FF. Radially disposed outwardly from brush 408 is a brush 410. Brush 410 which is alternatively referred to as brush GG extends radially inward away from the inner wall of the base ring. As can be appreciated from FIG. 91 the pill engaging surface of brush 410 directs pills to a guiding surface 414 on the outer diverter 392. The pill engaging surface on brush 408 guides pills to a guiding surface 412 on the inner diverter 390.

In this exemplary arrangement after pills move past the diverters 390 and 392 they engage the brush AA which is positioned in advance of the shaded area 394 in which additional pills are received. As with the prior exemplary arrangement this brush AA distributes the pills in the desired manner in advance of the pill receiving area. As shown in FIG. 91 the Arrows P are indicative of the paths along which pills are urged to move through engagement with each of the respective brushes. As shown the brushes are operative to cause the pills to move radially inward and outward relative to each of the pill engaging apertures and in overlying relation thereof. This movement causes one respective pill to be positioned in each respective pill engaging aperture. Further the exemplary arrangement of deformable brushes operates so that when one respective pill is engaged within a pill engaging aperture, the pill is moved by engagement with at least one respective brush so that it is positioned properly within the aperture. Further once a pill is properly positioned within a respective pill engaging aperture, other pills that may vertically overlie the pill positioned in the aperture are moved away from the pill engaging aperture to facilitate the pill in the respective aperture being delivered individually as it falls downward from the respective aperture when the aperture moves into overlying relation with the drop opening.

Further in this exemplary arrangement similar to the previously described brush arrangements, brushes AA through GG may be comprised of one or more deformable resilient plastic strips. Such plastic strips may be separated by spaces to facilitate flexibility. Such brushes also may include the absence of spaces and/or the inclusion of flanged edges to provide enhanced rigidity.

Figure 99:
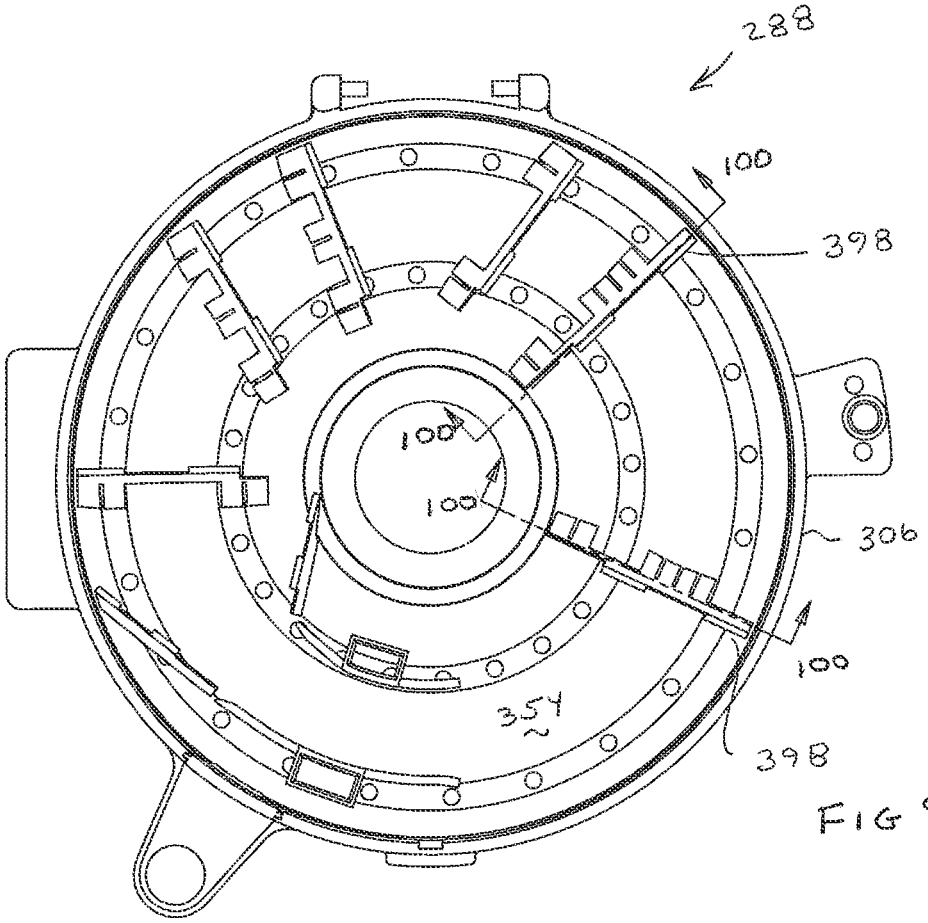
FIG. 99 is a transparent top plan view of the exemplary dual pill feed apparatus.
Figure 100:
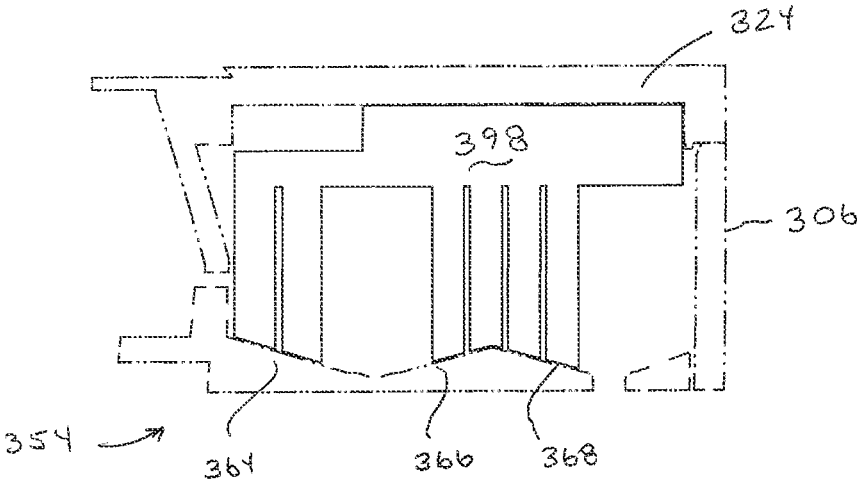
FIG. 100 is a cross-sectional view of the dual pill feed apparatus taken along lines 100-100 in FIG. 99.
Figure 101:
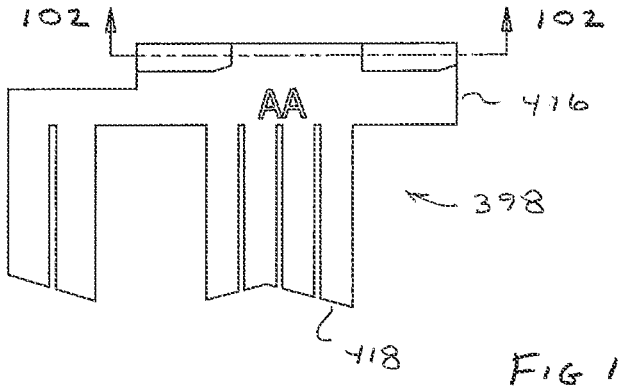
FIG. 101 is a front view of brush AA and a mount portion thereof.
Figure 102:
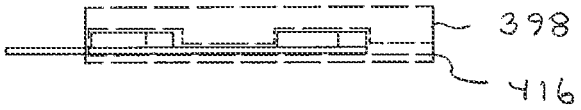
FIG. 102 is a cross-sectional view taken along line 102-102 in FIG. 101.

FIG. 99 shows a top transparent view of the dual pill feed apparatus 288 including the pair of identical brushes 398 which are positioned on each angular side of the base interior area into which pills are introduced to the interior area of the base ring 306. Each brush 398 is releasably attached to the inserter through a mounting portion 416. Brush 398 is further comprised of resilient strips with contact portions at the lower ends thereof. As shown in FIG. 100 the contact portions are in close adjacent relation with the annular inner conical portion 364 of the feeding disc 354 as well as intermediate inner annular portion 366 and intermediate outer annular portion 368 of the feeding disc.

Figure 103:
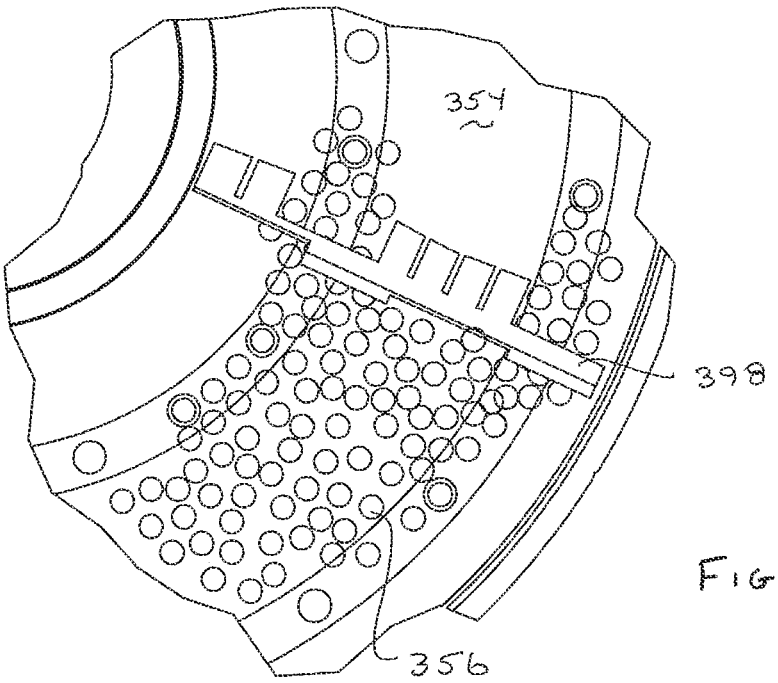
FIG. 103 is a top transparent view of the dual pill feed apparatus showing a plurality of circular pills adjacent to brush AA.
Figure 104:
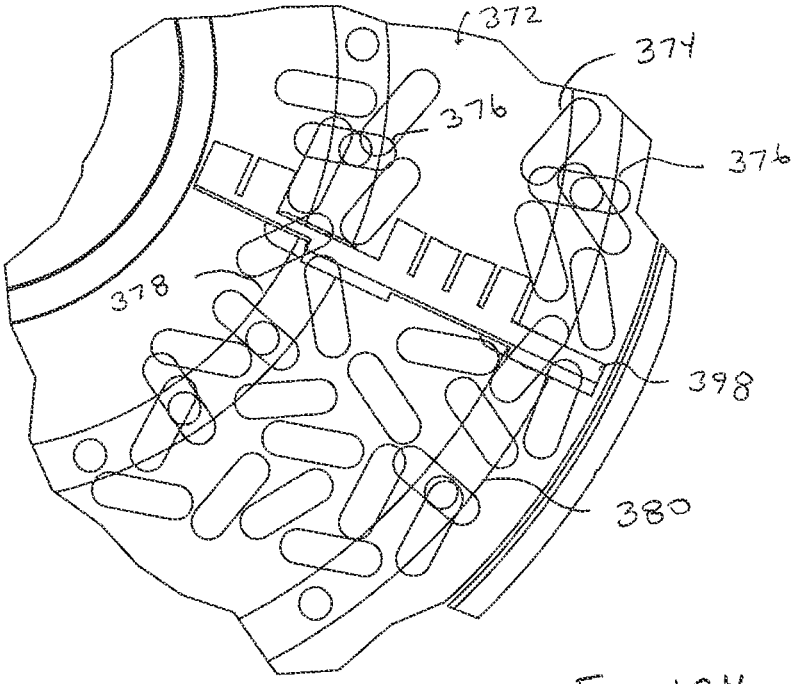
FIG. 104 is a top transparent view of the dual pill feed apparatus showing a plurality of pills in the form of capsules adjacent to brush AA.

As shown in FIG. 103 the exemplary brush 398 operates to engage pills 356 and direct the pills moved by the feeder disc to be in overlying relation of the inner circular portion 360 and the outer circular portion 362 in which the pill engaging apertures 358 are located. Directing the pills into such areas helps to cause pills to be located in such areas and adjacent to the pill engaging apertures. The movement of the pills is a first step towards helping to assure that each pill engaging aperture eventually has a pill positioned in nested relation therein. FIG. 104 further shows the action of brush 398 in connection with alternative dual pill feeder disc 372. Again in this case brush 398 urges the pills 374 to be positioned in overlying relation of the inner circular portion 378 and the outer circular portion 380 in which the pill engaging apertures 376 are located. This helps to position the pills so that they will be engaged in respective apertures. Of course it should be understood that these approaches are exemplary and other arrangements other approaches may be used.

Figure 105:
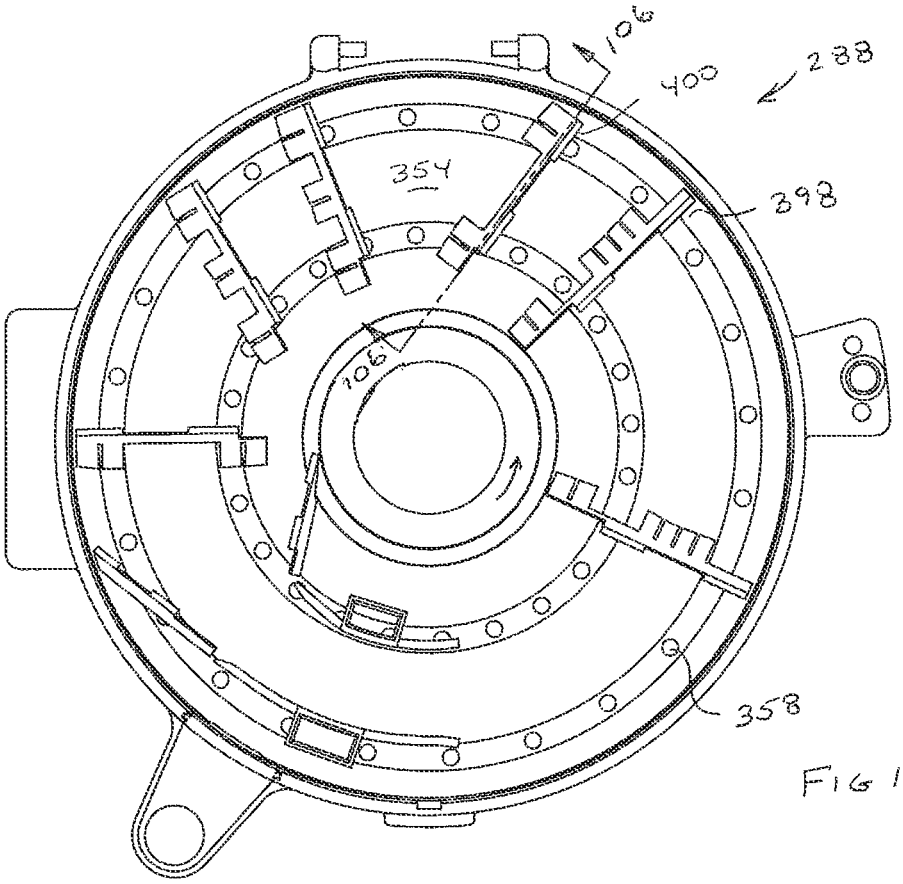
FIG. 105 is a top transparent view of the dual pill feed apparatus.
Figure 106:
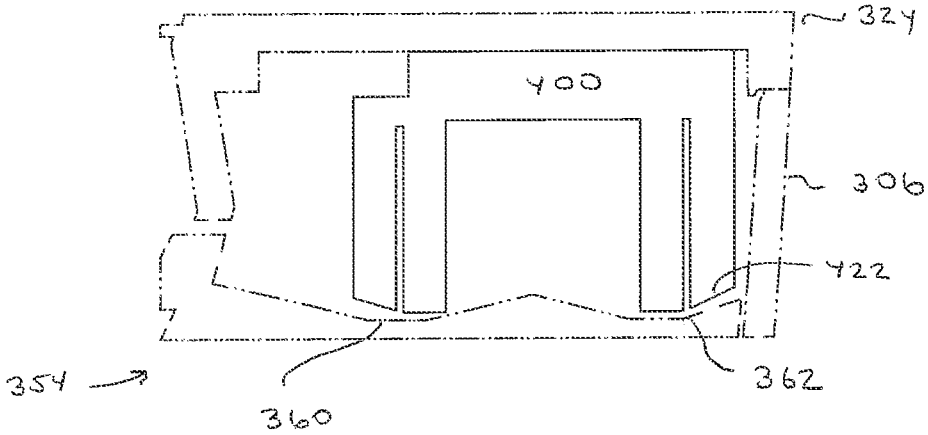
FIG. 106 is a cross-sectional view of the dual pill feed apparatus taken along line 106-106 in FIG. 105.
Figure 107:
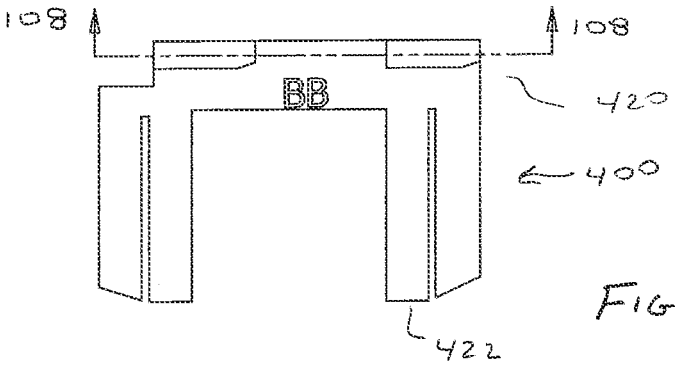
FIG. 107 is a front view of brush BB and the mount portion thereof.
Figure 108:
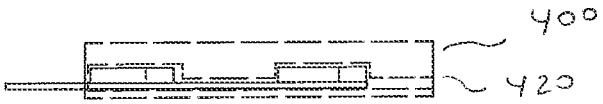
FIG. 108 is a cross-sectional view taken along line 108-108 in FIG. 107.
Figure 111:
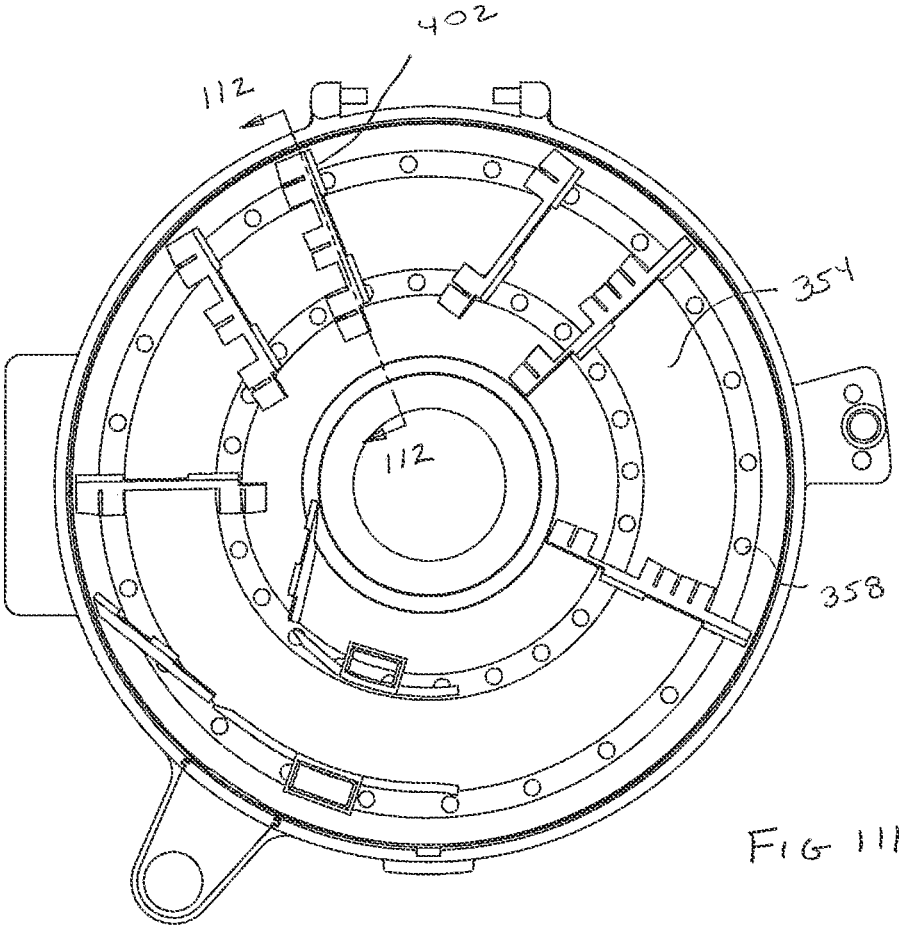
FIG. 111 is a top transparent view of the exemplary dual pill feed apparatus.

FIG. 105 is a top transparent view again showing the pill feed apparatus 288 and the next brush which is encountered by the pills after passing from the area in which pills are added and brush AA, which is brush 400 (brush BB). As shown in FIG. 107 brush 400 includes a mounting portion 420 which enables releasably operatively engaging the brush with the inside face of the inserter. Brush 400 also includes strips which include contact portions 422. As shown in FIG. 106 the contact portions 422 are disposed somewhat above the pill accepting apertures in the inner circular portion 360 and the outer circular portion 362 of the feeder disc 354. In the exemplary arrangement the contact surfaces 422 are operative to engage pills that may be partially within a pill engaging aperture 358 and urges the pill to move to be in positioned aligned nested relation within the aperture. The contact surfaces are further operative in the exemplary arrangement to move other pills that may be adjacent to a pill that is already positioned within a pill engaging aperture away from the pill that is already positioned within the aperture.

As shown in FIG. 110 brush 400 operates to cause the pills 356 that are engaged in pill engaging apertures 358 to be moved so as to be fully downward and positioned in nested relation in the apertures. The contact portions 422 also operate to cause the pills that are not positioned in the apertures to move angularly inward which serves to fill any pill engaging apertures that do not have a pill 356 engaged therein. The contact surfaces further cause the excess pills to be moved in engagement with the pill feeder disc 354 so that the pills move past brush 400. FIG. 109 shows the similar action that is carried out by brush 400 in connection with pill feeder disc 372 and the pills 374 having a capsule configuration.

Figure 112:
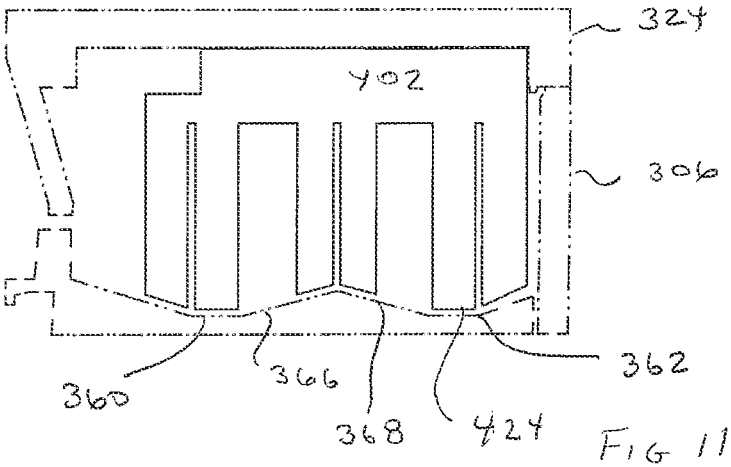
FIG. 112 is a cross-sectional view taken along line 112-112 in FIG. 111.
Figure 113:
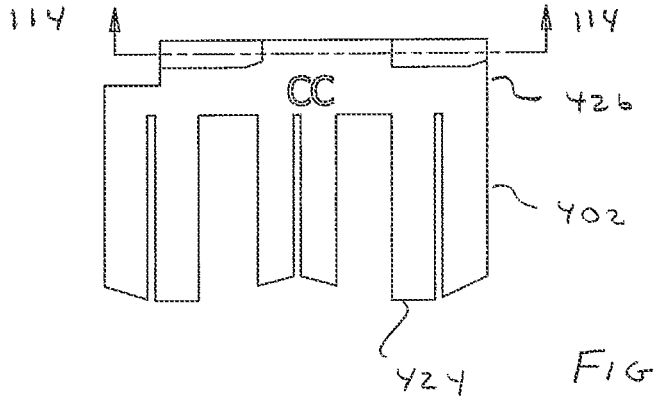
FIG. 113 is a front view of brush CC including the mount portion thereof.
Figure 114:
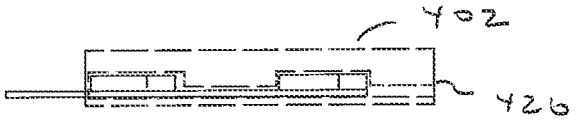
FIG. 114 is a cross-sectional view taken along line 114-114 in FIG. 113.
Figure 117:
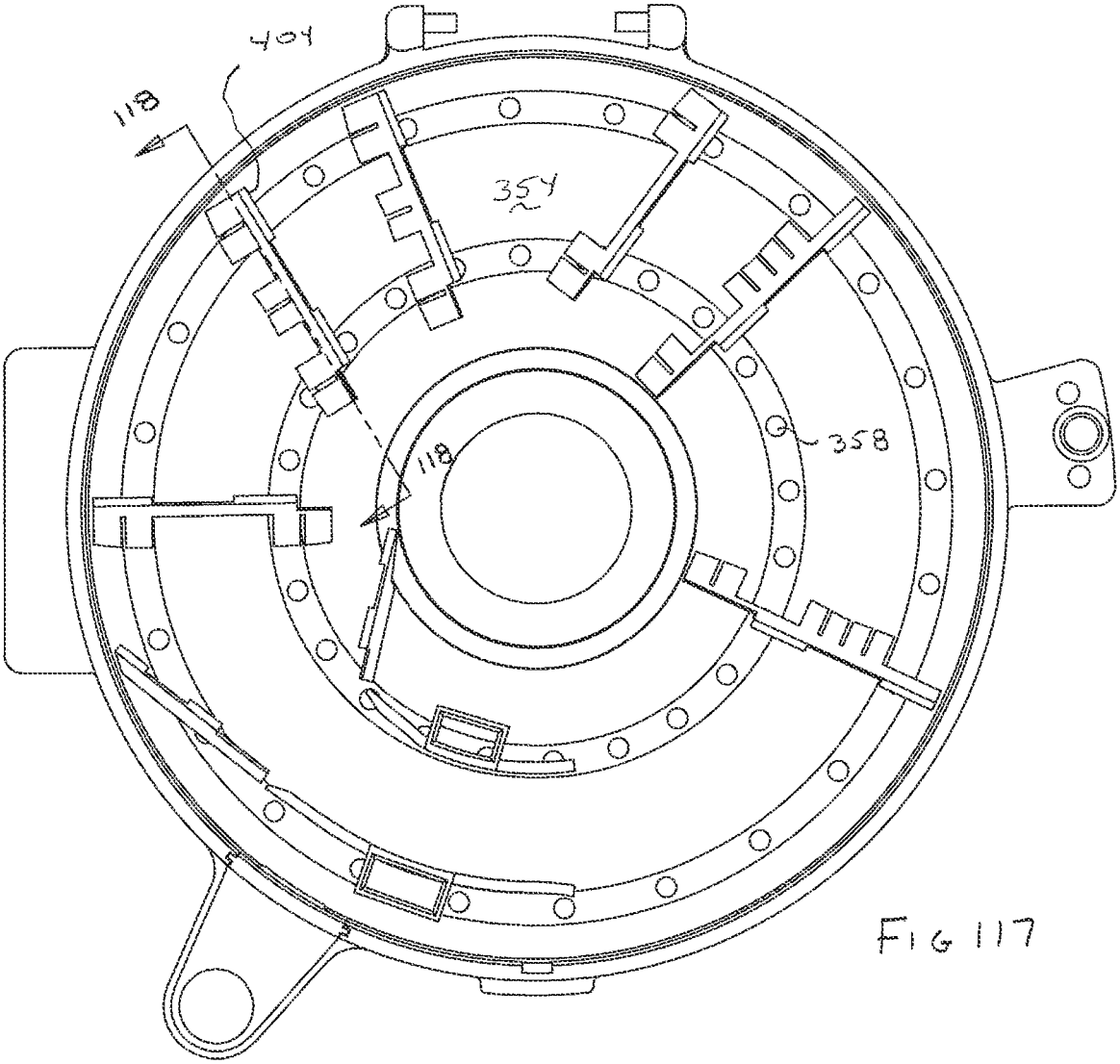
FIG. 117 is a top transparent view of the dual pill feed apparatus.

FIGS. 111 through 116 show the operation of brush 402 (brush CC). As shown in FIG. 112 the exemplary brush 402 includes contact portions 424 which are disposed slightly away from the inner circular portion 360 and the outer circular portion 362 of the feeder disc. The contact portions 424 also engage the area of the disc surface in which the intermediate inner and outer portions 366, 368 are immediately adjacent. Brush 402 is operatively engaged with the inserter via a mounting portion 426. Similar to the other brushes, brush 402 is releasably engageable with the inserter 324.

As represented in FIG. 115 brush 402 further operates to circumferentially sweep the inner circular area 360 and the outer circular area 362. The contact portions 424 operate to help to position a respective pill in a pill engaging aperture 358 while moving other overlying pills away from the pill engaging apertures. Brush 402 further operates to move excess pills onto the intermediate inner annular portion 366 and intermediate outer annular portion 368. FIG. 116 further shows the operation of brush 402 in connection with pill feeder disc 372 and the movement of pills that have a capsule configuration when engaged with the contact portions 426 of the brush.

Figure 118:
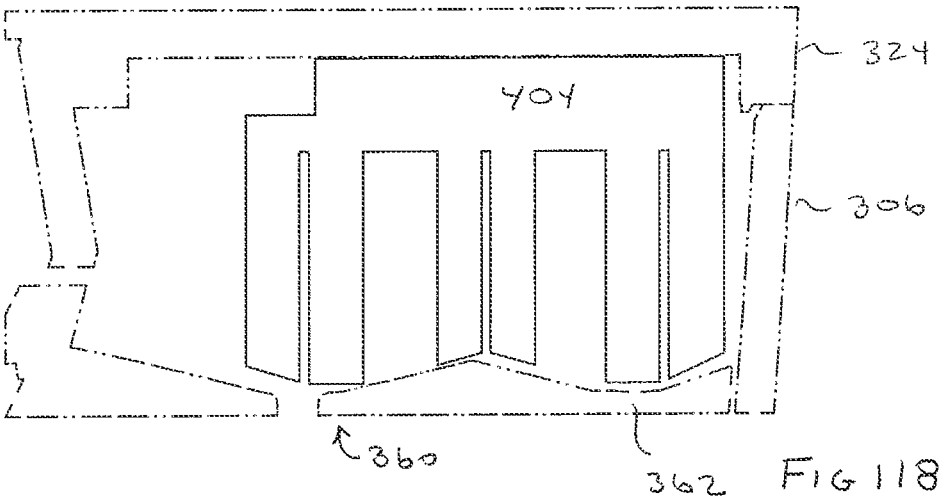
FIG. 118 is a cross-sectional view taken along line 118-118 in FIG. 117.
Figure 119:
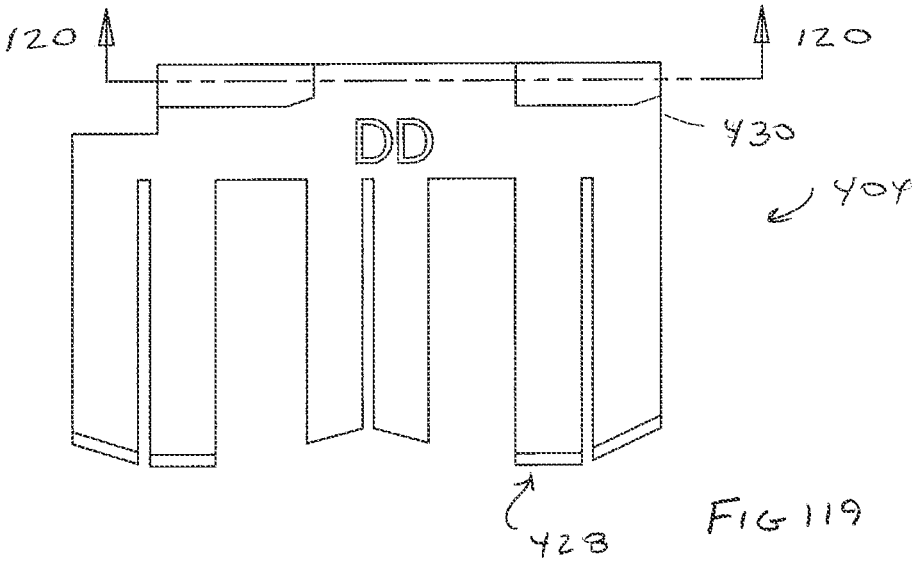
FIG. 119 is a front view of brush DD including the mount portion thereof.
Figure 120:
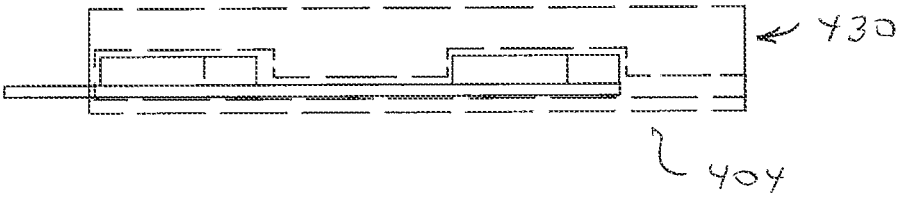

After moving past brush CC the pills next engage brush 404 (brush DD). As represented in FIG. 118 brush 404 includes contact portions 428 that are closely adjacent to the inner circular portion 360 and the outer circular portion 362. Brush 404 further is angled relative to the radial direction so as to transversely move excess pills that are not positioned within a pill engaging aperture 358 in a radially inward direction.

Figure 121:
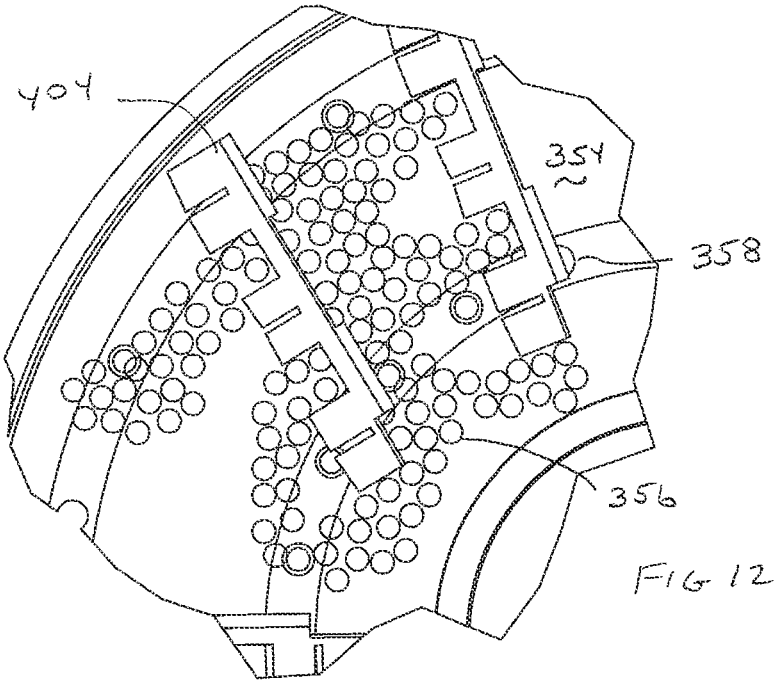
Figure 122:
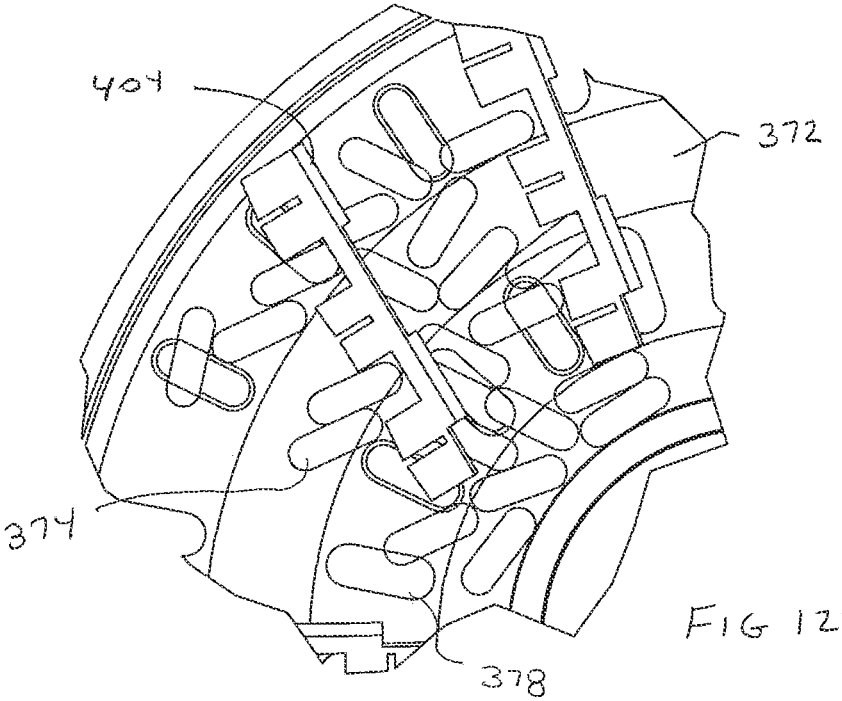

Brush 404 includes a mount portion 430 which enables releasably engaging brush 404 with the inserter 324. As represented in FIG. 121 pills 356 that are engaged with the contact portions of brush 404, are urged to nest and be positioned within the pill engaging apertures 358 while pills that are not positioned within the apertures are moved transversely away from the apertures. This further helps to assure that each pill engaging aperture includes a single pill that is positioned properly by being fully nested therein, and that additional pills are not engaged with the respective aperture. FIG. 122 shows the similar action of brush 404 in operative connection with feeding disc 372. As represented in this Figure the contact portions of brush 404 cause similar movements of pills 374 to assure the presence of a single pill in each pill engaging aperture 378 while minimizing the risk of other pills that are not properly positioned being engaged in a respective aperture.

Figure 123:
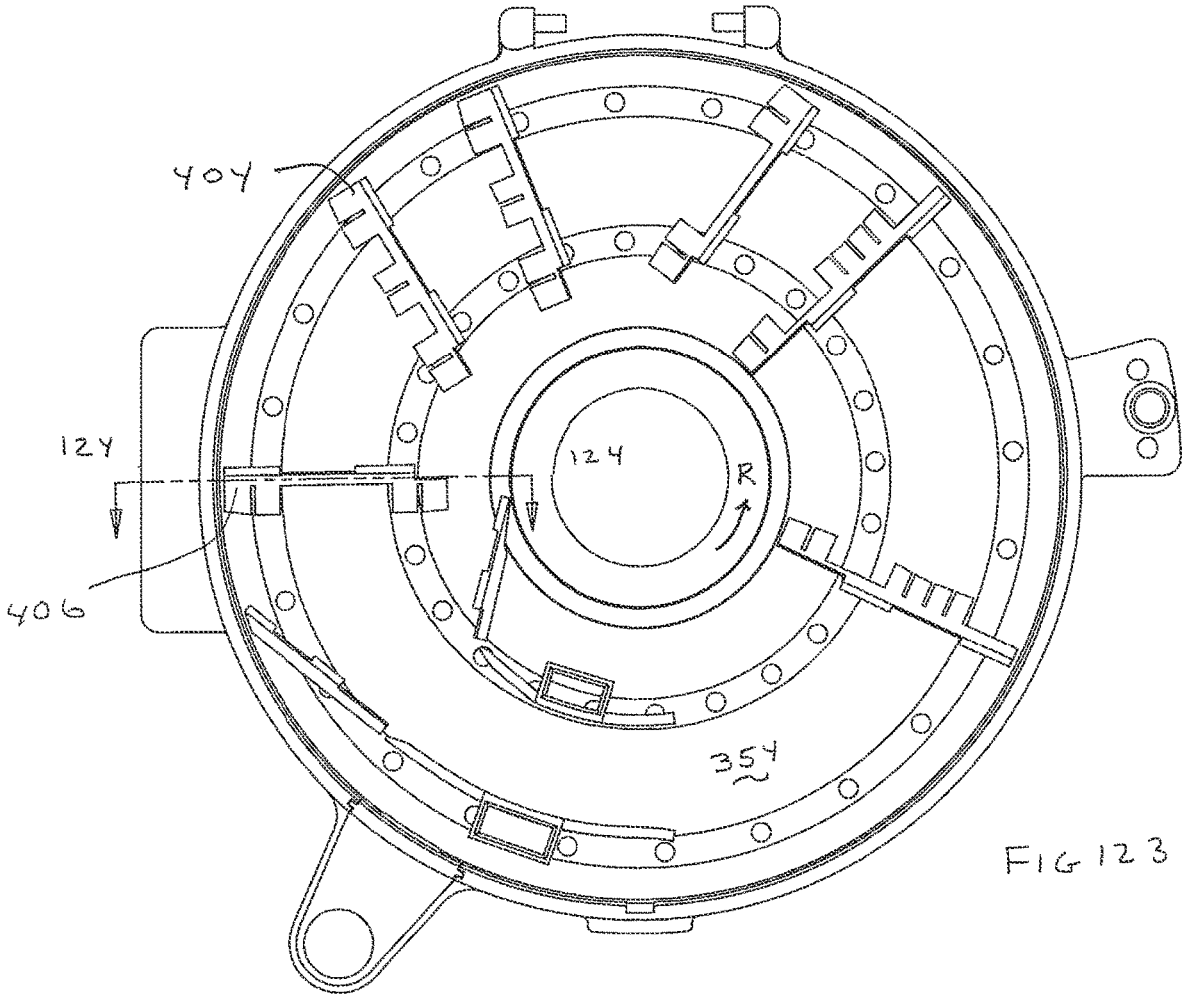
Figure 124:
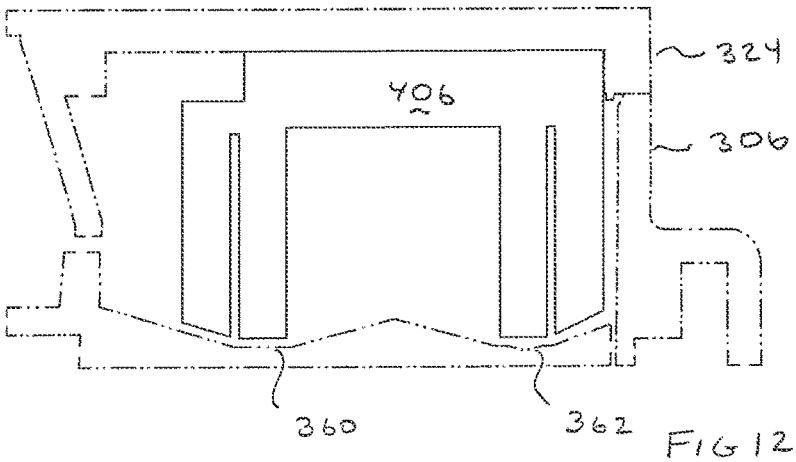
Figure 125:
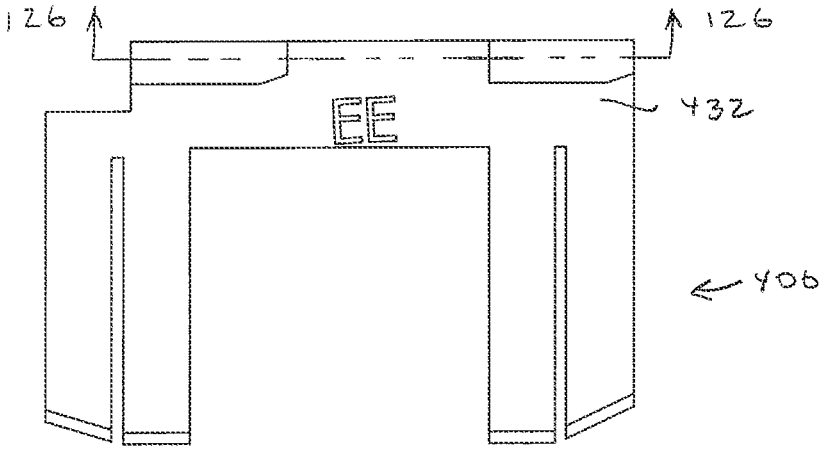
Figure 126:
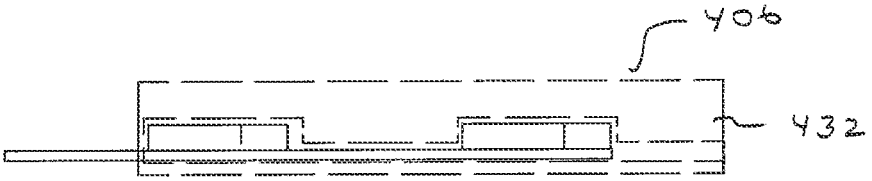

FIG. 123 is a top transparent view showing brush 406 (brush EE) in overlying relation of dual pill feeder disc 354. Brush 406 is encountered by pills that have moved past brush 404. Brush 406 is in removable connection with inserter 324 through a mount portion 432. As shown in FIG. 124, brush 406 includes contact portions 434 that extend in close adjacent relation with the inner circular portion 360 and the outer circular portion 362.

Figure 127:
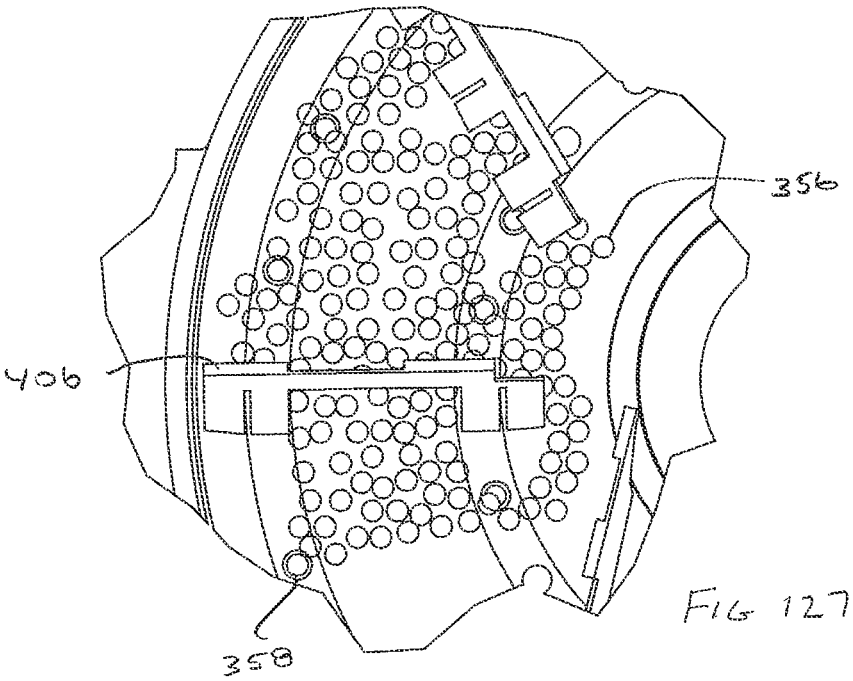
Figure 128:
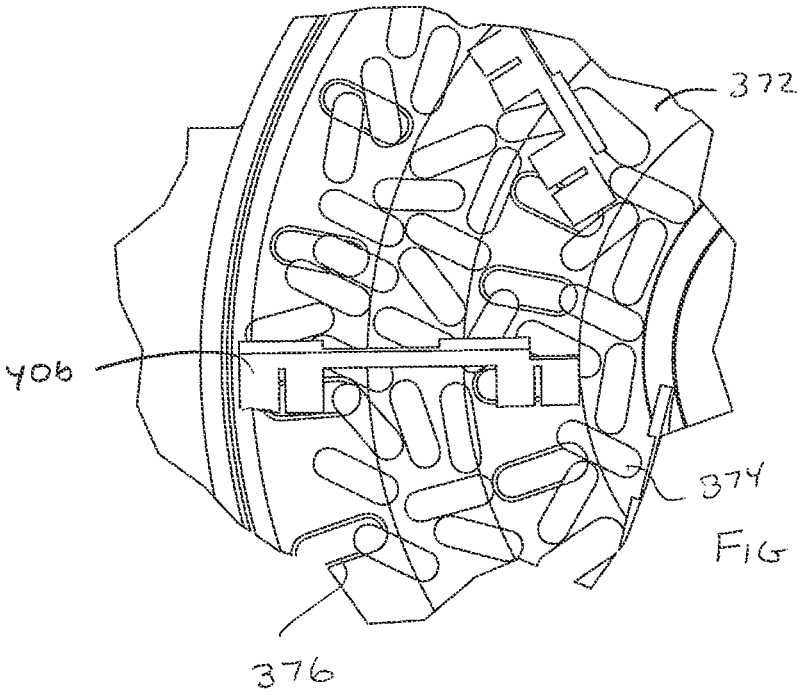

As shown in FIG. 127 brush 406 operates to circumferentially sweep the pills 356 that are positioned in nested relation in the pill engaging apertures 358 to assure that the pills are aligned and properly positioned within the apertures. The contact portions further help to assure that other pills that may be partially engaged with the apertures are moved away from the apertures and directed radially away therefrom. FIG. 128 further shows how brush 406 in operative engagement with pill feeder 372 performs a similar function with regard to pills 374 and apertures 376.

Figure 129:
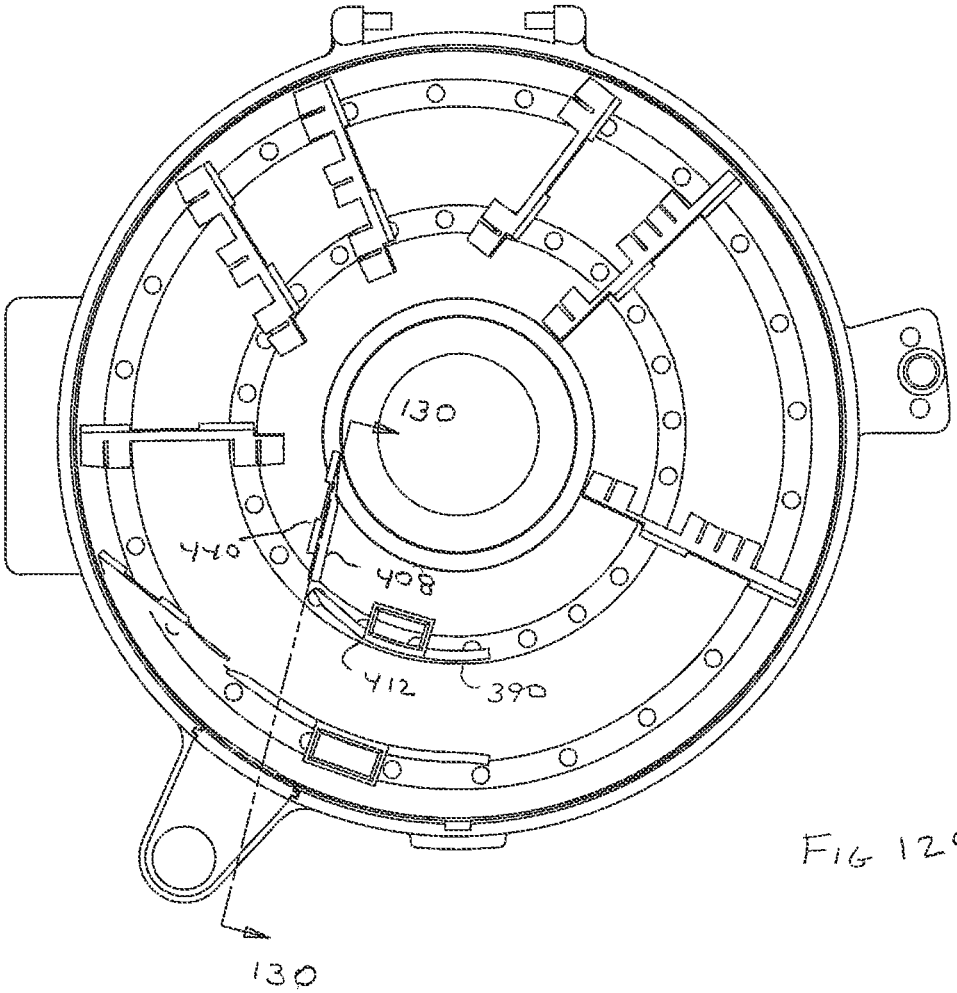
Figure 130:
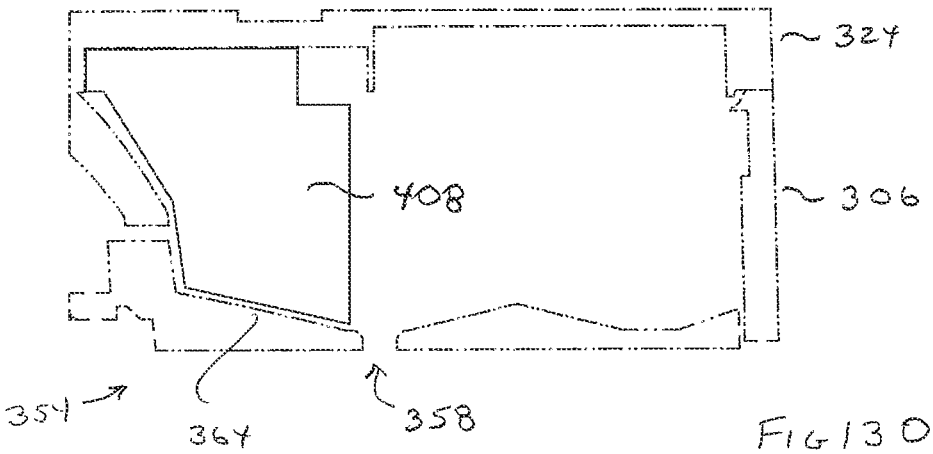

FIG. 129 is a top transparent view showing brush 408 (brush FF). As shown in FIG. 130 brush 408 extends radially outward away from the center of the feeder disc. Brush 408 includes a mount portion 436 through which the brush is releasably engaged with the inserter 324. Brush 408 includes an elongated angled contact portion 438. Contact portion 138 extends in close adjacent relation with the annular inner conical portion 364 of disc 354.

As shown in FIG. 129 and in FIGS. 133 and 134, the pill engaging surface 440 of brush 408 is operative to urge the pills in engagement therewith to move radially outwardly beyond the guiding surface 412 of the inner diverter 390. Thus as shown in FIG. 135 the pills 356 which are not positioned in the pill engaging apertures 358 of the inner circular portion 360, move radially outwardly away from the pill engaging apertures. The excess pills are guided away from the pill engaging apertures by the guiding surface 412 of the inner diverter 390 while pills that are positioned in the pill engaging apertures reach a position in which they are in overlying relation of the inner drop opening and fall downward through the opening and into the packaging mechanism. FIG. 136 shows how the brush 408 performs a similar function with pills configured as capsules in connection with feeder disc 372. Thus this configuration helps to assure that pills engaged in the pill engaging apertures of the inner circular portion 360 are reliably individually delivered one at a time into the drop opening.

FIG. 137 is a top transparent view of the exemplary dual pill feed apparatus including the exemplary brush 410 (brush GG). Similar to the other brushes, brush 410 includes a mount portion 442 that is releasably engaged with the inserter 324. The exemplary brush 410 includes an elongated continuous contact portion 444. Contact portion 444 extends radially inward from the wall bounding the base ring and across the pill engaging apertures 358 in the outer circular portion 362.

Brush 410 includes a pill engaging surface 446 that operates to urge the pills that are not positioned within a pill engaging aperture 358 to move radially inward on the feeder disc 354. The excess pills are moved radially inwardly such that they are moved into engagement with the guiding surface 414 of the outer diverter 392. This configuration helps to assure that the excess pills are moved away from the pills that are positioned in the pill engaging apertures, so that the pills in the apertures are reliably delivered individually into the respective outer drop opening that corresponds to the outer circular portion 362. This operational capability of brush 410 is shown with regard to circular pills in FIG. 143 and with regard to pills having the configuration of capsules in FIG. 144.

FIG. 145 is a top transparent view showing the exemplary inner diverter 390 and the exemplary outer diverter 392. As shown in FIG. 146 the inner diverter 390 is movably mounted in operative connection with the inserter 324. Diverter 390 is movably mounted in guided relation with an inner diverter post 446. Outer diverter 392 is also vertically movable in operative connection with the inserter 324. Outer diverter 392 is movable in guided relation with an outer diverter post 448.

Inner diverter 390 includes an inward surface 450. The inward surface 450 is configured to engage the upper surface of the feeder disc 354 adjacent to the inner circular portion 360. Similarly the outer diverter includes an inward surface 452 that is configured to engage the upper surface of the feeder disc adjacent to the outer circular portion 362. In the exemplary arrangement each of the inner diverter 390 and the outer diverter 392 are biased by gravity into engagement with the surface of the feeder disc. This helps to assure that pills that are not positioned in pill engaging apertures are moved to a position radially between guiding surface 412 of the inner diverter 390 and guiding surface 414 of the outer diverter 392.

The movement of cylindrical pills 356 moved in engagement with feeder disc 354 past the inner diverter 390 and the outer diverter 392 is represented in FIG. 153. As shown, all the pills that are not positioned in the pill engaging apertures 358 are moved radially away from the apertures. This assures that pills are reliably individually delivered from the apertures into the drop openings in area 396. FIG. 154 shows how diverter 390 and 392 operate in a similar manner in connection with feeder disc 372 and with pills 374 which have a capsule configuration. As a result only the pills 374 that are positioned in the pill engaging apertures 376 can reach the drop openings in area 396. All of the excess pills move past the diverters and are then engaged by brush 398 that is encountered by the pills before reaching the area 394 in which additional pills may be added into the interior area of the base ring.

It should be understood that the arrangements of inserters, the deformable brushes, the diverters, the feeder discs and other structures that have been described herein are exemplary. In other arrangements other types and configurations of pill directing, containing, holding, releasing and packaging structures may be utilized.

Thus similar to the previously described exemplary arrangement in which single pills are delivered into a packaging mechanism of a packaging machine, the principles described herein may be utilized to deliver multiple pills concurrently into packaging mechanisms. Further the exemplary arrangements enable the use of the dual pill feed apparatus with many different sizes and configurations of pills. This is accomplished by changing the feeder disc to correspond with the appropriate pill type in a manner like that previously discussed.

Thus the exemplary arrangements described herein achieve improved operation, eliminate difficulties encountered in the use of prior devices and systems, and attain the useful results described herein.

In the foregoing description, certain terms have been used for brevity, clarity and understanding. However no unnecessary limitations are to be implied therefrom because such terms are used for descriptive purposes and are intended to be broadly construed. Moreover the descriptions and illustrations herein are by way of examples and the new and useful features are not limited to the exact features that have been shown and described.

Further it should be understood that features and relationships associated with one described arrangement can be combined with the features and relationships of another arrangement. That is, various features and/or relationships from the various arrangements that have been described can be combined to produce further arrangements, and the new and useful scope of the disclosure is not limited only to the arrangements that have been shown and described herein.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

We claim:

1. Apparatus comprising:

a base ring, wherein the base ring includes
- a generally circular annular internal wall,
- wherein the annular internal wall
  - extends in centered relation about an axis, and
  - bounds a base interior area,
- a base ring opening through which the base interior area is accessible from above the base ring, a feeder disc, wherein the feeder disc
- is rotatable about the axis within the base interior area below the base ring opening,
- includes a plurality of pill engaging apertures, wherein
  - each pill engaging aperture extends vertically through the feeder disc in an axially centered annular portion,
  - is angularly spaced from each other pill engaging aperture, and
  - is configured to have only one respective pill positioned within the respective pill engaging aperture,
- wherein during rotation of the feeder disc each one respective pill within a respective pill engaging aperture is moved while being vertically supported within the respective pill engaging aperture by operative engagement with a plate upper surface of a support plate that extends below the feeder disc,
- wherein the plate upper surface includes a drop opening, wherein the drop opening is configured to enable one respective pill in a respective pill engaging aperture to drop individually into the drop opening when the respective pill engaging aperture is in overlying relation with the drop opening during rotation of the feeder disc, a cover, wherein the cover includes a top opening that is configured to enable pills to pass through the cover to the base interior area, and except for the top opening is configured to fully close the base ring opening, a plurality of deformable brushes, wherein each of the brushes is in fixed operative supported connection with the cover, extends vertically downward in the base interior area, is configured to engage pills in the base interior area, wherein rotation of the feeder disc is operative to cause a plurality of pills within the base interior area to be moved by operative engagement with the feeder disc and the plurality of brushes so that one respective pill is caused to be positioned in each respective pill engaging aperture as the feeder disc rotates, and the one respective pill in the respective pill engaging aperture to drop individually into the drop opening when the respective pill engaging aperture is positioned in overlying relation with the drop opening.

2. The apparatus according to claim 1, and further comprising:

a packaging machine, wherein the packaging machine is in operative connection with the drop opening, wherein the packaging machine is operative to cause each pill that individually drops into the drop opening to be included in a unit dose package.

3. The apparatus according to claim 1 wherein the feeder disc is removably positionable in the base interior area, is removable from and positionable in the base ring interior area through the base ring opening, and further comprising:

a plurality of further feeder discs, wherein each further feeder disc is removably positionable in the base interior area, is removable from and positionable in the base interior area through the base ring opening, when positioned in the base interior area is rotatable about the axis below the base ring opening, includes a plurality of further pill engaging apertures, wherein each further pill engaging aperture extends vertically through the respective further feeder disc in a further axially centered annular portion, is angularly spaced from each other further pill engaging aperture in the respective further axially centered annular portion, is configured to have only one respective further pill within the respective further pill engaging aperture, wherein each of the respective further pills that is postionable in each further pill engaging aperture is of a different configuration than the pills, and of a different configuration than each of the respective further pills that are positionable in the respective pill engaging apertures of each respective further feeder disc, wherein without changing a position of any of the plurality of brushes that are each in fixed operative connection with an inside face of the cover, from when respective pills are moved into respective pill engaging apertures through rotation of the feeder disc, rotation of each respective further feeder disc is operative to cause a plurality of respective further pills that are positionable in the pill engaging apertures of the respective further feeder disc to be moved in engagement with the further feeder disc and the plurality of brushes so that one respective further pill is positioned in each respective further pill engaging aperture, and the one respective further pill in the respective further pill engaging aperture to be moved with the further feeder disc and to drop individually into the drop opening when the respective further pill engaging aperture is in overlying relation of the drop opening.

4. The apparatus according to claim 1 wherein the cover is movably mounted in operative connection with the base ring through a hinge, wherein the cover is movable to alternatively selectively open and bound the base ring opening and to correspondingly cause the plurality of brushes to be selectively positioned either outside or within the base interior area.

5. The apparatus according to claim 1 wherein the feeder disc further includes a tapered annular inner portion, wherein the tapered annular inner portion is axially centered, extends continuously for 360° on the feeder disc, is positioned radially inward of the pill engaging apertures, and is upwardly bounded by an annular inner portion surface that is tapered toward the pill engaging apertures.

6. The apparatus according to claim 1 wherein the feeder disc further includes a tapered annular outer portion, wherein the tapered annular outer portion is axially centered, extends continuously for 360° on the feeder disc, is positioned radially outward of the pill engaging apertures, and is upwardly bounded by a tapered annular outer portion surface that is tapered toward the pill engaging apertures.

7. The apparatus according to claim 1 wherein the feeder disc further includes a tapered annular inner portion, wherein the tapered annular inner portion is axially centered, extends continuously for 360° on the feeder disc, is positioned radially inward of the pill engaging apertures, and is upwardly bounded by an annular inner portion surface that is tapered toward the pill engaging apertures, a tapered annular outer portion, wherein the tapered annular outer portion is axially centered, extends continuously for 360° on the feeder disc, is positioned radially outward of the pill engaging apertures, and is upwardly bounded by a tapered annular outer portion surface that is tapered toward the pill engaging apertures.

8. The apparatus according to claim 1 wherein the feeder disc includes an axially centered upward extending annular feeder disc projection, wherein the annular feeder disc projection is configured to contain pills in the base interior area radially between the annular feeder disc projection and the annular internal wall.

9. The apparatus according to claim 1 wherein the cover includes an axially centered downward extending annular skirt projection, wherein the annular skirt projection extends 360° and is configured to contain pills in the base interior area radially between the annular skirt projection and the annular internal wall.

10. The apparatus according to claim 1 wherein the feeder disc includes an axially centered upward extending annular feeder disc projection, wherein the cover includes a downward extending annular skirt projection that extends 360°, wherein the annular skirt projection and the annular feeder disc projection are configured to contain pills in the base interior area radially between each of the annular feeder disc projection and the annular skirt projection, and the annular internal wall.

11. The apparatus according to claim 1 wherein the cover is movably mounted on the base ring, wherein the cover is movable between an open cover position and a closed cover position, wherein in the closed cover position the cover closes the base ring opening except for the top opening, and in the open cover position the cover is disposed away from the base ring opening, and further comprising:

a diverter, wherein the diverter is in operative supported connection with the cover, is configured only in the closed cover position to cause pills other than a respective pill positioned in a respective pill engaging aperture and in overlying relation of the drop opening, to be positioned on the feeder disc away from the respective pill engaging aperture.

12. The apparatus according to claim 1 wherein the cover is movably mounted on the base ring, wherein the cover is movable between an open cover position and a closed cover position, wherein in the closed cover position the cover closes the base ring opening except for the top opening, and in the open cover position the cover is disposed away from the base ring opening, and further comprising:

a diverter, wherein the diverter includes a pill guiding face, is movably mounted in operative supported connection with the cover, wherein only in the closed cover position the pill guiding face is vertically movable in engaged relation with the feeder disc, wherein only in the closed cover position the pill guiding face is configured to engage and cause pills other than a respective pill positioned in a respective pill engaging aperture and in overlying relation of the drop opening to be positioned on the feeder disc away from the respective pill engaging aperture.

13. The apparatus according to claim 1 wherein the feeder disc is rotatable in a rotational direction within the base interior area, wherein the top opening in the cover is disposed in the rotational direction away from the drop opening.

14. The apparatus according to claim 1 and further comprising:

a rotational drive platter, wherein the rotational drive platter, is rotatable in a rotational direction about the axis, extends below and in engaged contacting relation with a lower face of the feeder disc, and rotates to cause rotation of the feeder disc and is rotationally movable relative to the feeder disc responsive to the feeder disc encountering resistance to rotation in the rotational direction.

15. The apparatus according to claim 1 wherein the feeder disc includes one of an axially centered interengaging projection or recess, and further comprising:

a rotational drive platter, wherein the rotational drive platter, is rotatable about the axis, includes the other of the axially centered interengaging projection or recess, extends below and in engaged contacting relation with a lower face of the feeder disc, and rotates in a rotational direction to cause rotation of the feeder disc and is rotationally movable relative to the feeder disc responsive to the feeder disc encountering resistance to rotation in the rotational direction, wherein while the drive platter and feeder disc relatively rotationally move the interengaging projection and recess cause each of the feeder disc and the drive platter to each remain axially centered.

16. The apparatus according to claim 1 and further comprising:

a rotational drive platter, wherein the rotational drive platter, is rotatable about the axis, includes a plurality of either projections or recesses, wherein the projections or recesses extend vertically and are radially disposed away from and uniformly angularly spaced about the axis, wherein each projection or recess is configured to releasably engage a respective recess or projection that extends vertically on a lower face of the feeder disc wherein drive platter rotation is operative to cause rotation of the feeder disc in a rotational direction, wherein during drive platter rotation the feeder disc is relatively movable rotationally and vertically relative to the drive platter responsive to the feeder disc encountering resistance to rotation in the rotational direction.

17. The apparatus according to claim 1 and further comprising:

a frangible drive pin, wherein the frangible drive pin is configured to operatively rotatably connect the feeder disc and a drive, wherein the drive pin is configured to break responsive to the feeder disc encountering resistance to rotation.

18. The apparatus according to claim 1 and further comprising:

a rotational drive platter, wherein the rotational drive platter, is rotatable about the axis, extends below and in engaged contacting relation with a lower face of the feeder disc, and rotates to cause rotation of the feeder disc in a rotational direction and is rotationally movable relative to the feeder disc responsive to the feeder disc encountering resistance to rotation in the rotational direction, a frangible drive pin, wherein the frangible drive pin includes a head, wherein the head is releasably engageable with the drive platter, is configured to operatively rotationally connect a drive and the drive platter, wherein the drive pin is configured to break responsive to the drive platter encountering resistance to rotation.

19. The apparatus according to claim 1 and further comprising:

a rotational drive platter, wherein the rotational drive platter, is rotatable about the axis, extends below and in engaged contacting relation with a lower face of the feeder disc, and rotates to cause rotation of the feeder disc in a rotational direction and is rotationally movable relative to the feeder disc responsive to the feeder disc encountering resistance to rotation in the rotational direction, a frangible drive pin, wherein the frangible drive pin includes a head, wherein the head is releasably engageable with the drive platter, is configured to operatively rotationally connect a radially extending rotatable drive post and the drive platter, wherein the drive pin includes a pair of radially disposed apart legs, wherein the legs are configured to receive the drive post in intermediate relation of the legs, wherein at least one of the legs is configured to break responsive to the drive platter encountering resistance to rotation.

20. The apparatus according to claim 1 wherein each of the plurality of brushes has a respective upper end that is in fixed operatively attached connection with an inside face of the cover, wherein at least one of the brushes is configured to direct pills in the base interior area radially toward the pill engaging apertures, wherein one respective pill is caused to be positioned in each respective pill engaging aperture during each full rotation of the feeder disc.

21. The apparatus according to claim 1 wherein the feeder disc is rotatable in a rotational direction, wherein each of the plurality of brushes has a respective upper end that is in fixed operatively attached connection with an inside face of the cover, wherein at least one brush is configured to direct pills in the base interior area radially outward toward the pill engaging apertures, and wherein at least one other brush that is disposed in the rotational direction from the at least one brush that is configured to direct pills radially outward toward the pill engaging apertures, is configured to direct pills in the base interior area radially inward and away from the pill engaging apertures.

22. The apparatus according to claim 1 wherein the feeder disc is rotatable in a rotational direction, wherein the top opening in the cover is disposed in the rotational direction away from the drop opening, wherein each of the plurality of brushes has a respective upper end that is in fixed operatively attached connection with an inside face of the cover, wherein at least one brush that is disposed in the rotational direction away from the top opening is configured to direct pills in the base interior area radially outward toward the pill engaging apertures, and wherein at least one further brush that is disposed in the rotational direction away from the at least one brush configured to direct pills radially outward toward the pill engaging apertures and that is disposed in the rotational direction ahead of the drop opening, is configured to direct pills in the base interior area radially inward away from the pill engaging apertures.

23. The apparatus according to claim 1 wherein feeder disc is bounded radially outwardly by an annular disc edge, wherein the annular disc edge is disposed radially inwardly from the annular internal wall by no more than a radial distance, wherein the radial distance is less than a smallest dimension of each pill, whereby no pills may extend radially between the annular disc edge and the annular internal wall.

24. The apparatus according to claim 1 wherein the base ring includes a cleanout opening sized for removal of pills from the base interior area through the cleanout opening, wherein the cleanout opening extends vertically below the cover, and radially through the base ring and the annular internal wall, a cleanout opening access cover, wherein the cleanout opening access cover is configured to selectively open and close the cleanout opening.

25. The apparatus according to claim 1 and further comprising:

a deck, wherein the base ring is configured to extend above the deck, wherein the deck includes a plurality of disposed recesses, wherein each recess is configured to releasably hold a respective further feeder disc, wherein each further feeder disc is usable in the apparatus in place of the feeder disc, and is not usable when positioned in a respective recess, wherein each further feeder disc has the same external shape as the feeder disc that is positioned within the base interior area.

26. The apparatus according to claim 1 and further comprising:

a plurality of further feeder discs, wherein each respective further feeder disc is usable in the apparatus in place of the feeder disc, and includes a plurality of respective further pill engaging apertures each configured to have one respective further pill of a different configuration from the pills, positionable in the apertures of the feeder disc and the respective further pills that are positionable in the respective further pill engaging apertures of each respective other further feeder disc, positioned in the respective pill engaging apertures of the respective further feeder disc, wherein each respective further feeder disc includes thereon respective disc indicia indicative of the configuration of the respective of further pills that are configured to be positioned in the respective further pill engaging apertures of the respective further feeder disc when the respective further feeder disc is used in place of the feeder disc.

27. The apparatus according to claim 1 wherein the feeder disc further includes a further plurality of further pill engaging apertures, wherein each further pill engaging aperture extends vertically in a further axially centered annular portion, wherein the further axially centered annular portion is radially disposed from the axially centered annular portion, is angularly spaced from each other further pill engaging aperture in the further axially centered annular portion, and is configured to have only one respective pill positioned within the respective further pill engaging aperture, wherein during rotation of the feeder disc each one respective pill positioned within a respective further pill engaging aperture is moved while being vertically supported within the respective further pill engaging aperture by operative engagement with the plate upper surface, and wherein the plate upper surface includes a further drop opening, wherein the further drop opening is radially disposed from the drop opening and is configured to enable one respective pill in a respective further pill engaging aperture to drop individually into the further drop opening when the respective further pill engaging aperture is in vertically overlying relation with the further drop opening during rotation of the feeder disc.

28. Apparatus comprising:

a base, including a base interior area therein, wherein the base interior area is bounded horizontally by a generally circular annular internal base wall, wherein the annular internal base wall extends in centered relation relative to an axis, is bounded vertically upward by a cover, and is bounded vertically downward by a feeder disc, wherein the feeder disc is rotatable about the axis in the base interior area, includes a plurality of pill engaging apertures, wherein each pill engaging aperture extends vertically through an axially centered annular portion of the feeder disc, is angularly spaced from each other pill engaging aperture in the annular portion, and is configured to have only one respective pill positioned within the respective pill engaging aperture, a plurality of deformable brushes, wherein each of the brushes has an upper end that is in immovable fixed operative connection with an inside face of the cover, extends below the cover and vertically downward in the base interior area, and has a lower end that is configured to engage a plurality of pills within the base interior area, wherein each of the plurality of pills have the same pill configuration, is in operative supported connection with the feeder disc, and is caused to move within the base interior area responsive to rotation of the feeder disc, wherein rotation of the feeder disc is operative to cause the plurality of pills within the base interior area to be moved responsive to operative engagement with the feeder disc and the plurality of brushes such that only one respective pill is caused to be positioned in each respective pill engaging aperture responsive to each feeder disc rotation, and the one respective pill that is positioned in the respective pill engaging aperture upon each feeder disc rotation, to drop individually into a drop opening upon completion of the respective feeder disc rotation, when the respective pill engaging aperture is positioned in vertically overlying relation with the drop opening.

29. The apparatus according to claim 28 wherein the cover is movably mounted relative to the base, wherein the cover is selectively movable between a closed position in which the cover vertically upwardly bounds the base interior area, and an open position in which the cover is at least partially disposed away from the base interior area and the base interior area is accessible from outside the base, wherein in the closed position of the cover the feeder disc in the base interior area is manually inaccessible and in the open position of the cover the feeder disc is enabled to be manually removed from the base interior area and replaced with a further feeder disc, wherein the further feeder disc is the same as the feeder disc except that the further feeder disc includes a plurality of further pill engaging apertures, wherein each of the further pill engaging apertures is configured to have one respective further pill of a different configuration than the pills positioned therein, wherein with the further feeder disc within the base interior area and the cover in the closed position, and without changing a respective position of any of the brushes from the respective brush positions which operate to cause a respective pill to be positioned in a respective pill engaging aperture of the feeder disc responsive to rotation of the feeder disc, rotation of the further feeder disc is operative to cause a plurality of further pills within the base interior area to be moved responsive to operative engagement with the further feeder disc and the plurality of brushes such that only one respective further pill is positioned in each respective further pill engaging aperture responsive to each further feeder disc rotation, and one respective further pill that is positioned in the respective further pill engaging aperture upon each feeder disc rotation, to drop individually into the drop opening upon completion of the respective further feeder disc rotation, when the respective further pill engaging aperture is positioned in vertically overlying relation of the drop opening.

30. Apparatus comprising:

a base ring, wherein a generally circular annular wall that is in centered relation with an axis horizontally bounds a base interior area within the base ring, a cover, wherein the cover is movably mounted in operative connection with the base ring, and is movable between a closed position in which the cover bounds vertically upward the base interior area, and an open position in which the cover is disposed at least partially away from the base interior area and the base interior area is accessible from outside the base interior area, a feeder disc, wherein the feeder disc is removably positionable within the base interior area, in an operative position of the feeder disc bounds vertically downward the base interior area, is rotatable about the axis within the base interior area, includes a plurality of pill engaging apertures, wherein each pill engaging aperture is positioned in an axially centered annular portion of the feeder disc, extends vertically through the axially centered annular portion, is angularly spaced from each other pill engaging aperture, and is configured to hold only one respective pill positioned within the respective pill engaging aperture, a plurality of deformable brushes, wherein each of the plurality of brushes is in operative fixed connection with the cover and in the closed position of the cover extends vertically in the base interior area, wherein rotation of the feeder disc and the plurality of brushes which are rotationally stationary in the closed position of the cover are operative at least in part to cause a plurality of pills positioned within the base interior area to be moved by operative engagement with the feeder disc and plurality of brushes such that only one respective pill is positioned in each respective pill engaging aperture when the respective pill engaging aperture moves into vertically overlying relation with a drop opening, wherein the respective pill drops from the respective pill engaging aperture individually into the drop opening.

31. Apparatus comprising:

a base ring, wherein the base ring includes a generally circular annular internal wall, wherein the annular internal wall extends in centered relation about an axis, and bounds a base interior area, a base ring opening through which the base interior area is accessible from above the base ring, a feeder disc, wherein the feeder disc is rotatable in a rotational direction about the axis within the base interior area below the base ring opening, includes a lower face, wherein the lower face includes a plurality of either disc projections or disc recesses, wherein the disc projections or disc recesses extend vertically on the lower face, includes a plurality of pill engaging apertures, wherein each pill engaging aperture extends vertically through the feeder disc in an axially centered annular portion, is angularly spaced from each other pill engaging aperture, and is configured to have only one respective pill positioned within the respective pill engaging aperture, wherein during rotation of the feeder disc each one respective pill within a respective pill engaging aperture is moved while being vertically supported within the respective pill engaging aperture by operative engagement with a plate upper surface of a support plate that extends below the feeder disc, wherein the plate upper surface includes a drop opening, wherein the drop opening is configured to enable one respective pill in a respective pill engaging aperture to drop individually into the drop opening when the respective pill engaging aperture is in overlying relation with the drop opening during rotation of the feeder disc, a rotational drive platter, wherein the rotational drive platter, is rotatable about the axis, includes a plurality of either platter projections or platter recesses, wherein the platter projections or platter recesses extend vertically and are radially disposed away from and uniformly angularly spaced about the axis, wherein each platter projection or platter recess is configured to releasably engage a respective disc recess or disc projection on the lower face of the feeder disc, whereby the feeder disc is rotatable in engagement with the drive platter, wherein the drive platter is rotatable in the rotational direction, and wherein at least one of each platter projection or platter recess is bounded in a direction transverse to the rotational direction by a respective tapered face surface, wherein the tapered face surfaces are operative to cause the feeder disc to move vertically away from the drive platter responsive to the feeder disc encountering resistance to movement in the rotational direction, a cover, wherein the cover is configured to cover at least a portion of the base ring opening, a plurality of deformable brushes, wherein each of the brushes is in fixed operative supported connection with the cover, extends vertically downward in the base interior area, is configured to engage pills in the base interior area, wherein rotation of the feeder disc in the rotational direction is operative to cause a plurality of pills within the base interior area to be moved by operative engagement with the feeder disc and the plurality of brushes so that one respective pill is caused to be positioned in each respective pill engaging aperture as the feeder disc rotates, and the one respective pill in the respective pill engaging aperture to drop individually into the drop opening when the respective pill engaging aperture is positioned in overlying relation with the drop opening.

32. Apparatus comprising:

a base ring, wherein the base ring includes a generally circular annular internal wall, wherein the annular internal wall extends in centered relation about an axis, and bounds a base interior area, a base ring opening through which the base interior area is accessible from above the base ring, a cleanout opening, wherein the cleanout opening extends vertically below the base ring opening, and radially through the base ring and the annular internal wall, a pill pocket configured to have at least one pill therein, wherein the pill pocket extends externally on the base ring, and radially outward from the cleanout opening, a cleanout opening access cover, wherein the cleanout opening access cover is configured to selectively open and close the cleanout opening, whereby in the open condition of the cleanout opening, pills are movable from the base interior area through the cleanout opening and into the pill pocket, a feeder disc, wherein the feeder disc is rotatable about the axis within the base interior area below the base ring opening, includes a plurality of pill engaging apertures, wherein each pill engaging aperture extends vertically through the feeder disc in an axially centered annular portion, is angularly spaced from each other pill engaging aperture, and is configured to have only one respective pill positioned within the respective pill engaging aperture, wherein during rotation of the feeder disc each one respective pill within a respective pill engaging aperture is moved while being vertically supported within the respective pill engaging aperture by operative engagement with a plate upper surface of a support plate that extends below the feeder disc, wherein the plate upper surface includes a drop opening, wherein the drop opening is configured to enable one respective pill in a respective pill engaging aperture to drop individually into the drop opening when the respective pill engaging aperture is in overlying relation with the drop opening during rotation of the feeder disc, a cover, wherein the cover is configured to cover at least a portion of the base ring opening, wherein the cleanout opening extends vertically below the cover, a plurality of deformable brushes, wherein each of the brushes is in fixed operative supported connection with the cover, extends vertically downward in the base interior area, is configured to engage pills in the base interior area, wherein rotation of the feeder disc is operative to cause a plurality of pills within the base interior area to be moved by operative engagement with the feeder disc and the plurality of brushes so that one respective pill is caused to be positioned in each respective pill engaging aperture as the feeder disc rotates, and the one respective pill in the respective pill engaging aperture to drop individually into the drop opening when the respective pill engaging aperture is positioned in overlying relation with the drop opening.

33. Apparatus comprising:

a base ring, wherein the base ring includes a generally circular annular internal wall, wherein the annular internal wall extends in centered relation about an axis, and bounds a base interior area, a base ring opening through which the base interior area is accessible from above the base ring, a feeder disc, wherein the feeder disc is rotatable about the axis within the base interior area below the base ring opening, includes a plurality of pill engaging apertures, wherein each pill engaging aperture extends vertically through the feeder disc in an axially centered annular portion, is angularly spaced from each other pill engaging aperture, and is configured to have only one respective pill positioned within the respective pill engaging aperture, wherein during rotation of the feeder disc each one respective pill within a respective pill engaging aperture is moved while being vertically supported within the respective pill engaging aperture by operative engagement with a plate upper surface of a support plate that extends below the feeder disc, wherein the plate upper surface includes a drop opening, wherein the drop opening is configured to enable one respective pill in a respective pill engaging aperture to drop individually into the drop opening when the respective pill engaging aperture is in overlying relation with the drop opening during rotation of the feeder disc, a cover, wherein the cover is configured to cover at least a portion of the base ring opening, a plurality of deformable brushes, wherein each of the brushes is in fixed operative supported connection with the cover, extends vertically downward in the base interior area, is configured to engage pills in the base interior area, wherein rotation of the feeder disc is operative to cause a plurality of pills within the base interior area to be moved by operative engagement with the feeder disc and the plurality of brushes so that one respective pill is caused to be positioned in each respective pill engaging aperture as the feeder disc rotates, and the one respective pill in the respective pill engaging aperture to drop individually into the drop opening when the respective pill engaging aperture is positioned in overlying relation with the drop opening, and further comprising:

a plurality of further feeder discs, wherein each respective further feeder disc includes a plurality of respective pill engaging apertures each configured to have respective pills of a different configuration from the feeder disc and each other further feeder disc, positioned in the respective pill engaging apertures of the respective further feeder disc, wherein the feeder disc and each respective further feeder disc includes thereon respective disc indicia indicative of the configuration of the respective pills that are configured to be positioned in the respective pill engaging apertures of the respective feeder disc, a deck, wherein the deck includes a plate, wherein the plate is in operatively supported connection with the deck, wherein the plate includes a plurality of openings through the plate, wherein each respective opening corresponds to one respective pill configuration, wherein a respective pill having the one respective configuration is the largest pill that will pass through the respective opening, wherein each respective opening has respective plate indicia adjacent thereto, wherein the plate indicia adjacent to a respective opening has a corresponding relationship to the disc indicia on the respective feeder disc or further feeder disc that is used with the respective pill having the configuration that is the largest pill that will pass through the respective opening.

34. Apparatus comprising:

a base ring, wherein the base ring includes a generally circular annular internal wall, wherein the annular internal wall extends in centered relation about an axis, and bounds a base interior area, a base ring opening through which the base interior area is accessible from above the base ring, a feeder disc, wherein the feeder disc is rotatable about the axis within the base interior area below the base ring opening, includes a plurality of pill engaging apertures, wherein each pill engaging aperture extends vertically through the feeder disc in an axially centered annular portion, is angularly spaced from each other pill engaging aperture, and is configured to have only one respective pill positioned within the respective pill engaging aperture, wherein during rotation of the feeder disc each one respective pill within a respective pill engaging aperture is moved while being vertically supported within the respective pill engaging aperture by operative engagement with a plate upper surface of a support plate that extends below the feeder disc, wherein the plate upper surface includes a drop opening, wherein the drop opening is configured to enable one respective pill in a respective pill engaging aperture to drop individually into the drop opening when the respective pill engaging aperture is in overlying relation with the drop opening during rotation of the feeder disc, a cover, wherein the cover is configured to cover at least a portion of the base ring opening, wherein the base ring, the feeder disc and the cover are configured to be installed in operatively attached connection with a packaging machine in place of a removed tray and rotatable pill disc of the machine, a plurality of deformable brushes, wherein each of the brushes is in fixed operative supported connection with the cover, extends vertically downward in the base interior area, is configured to engage pills in the base interior area, wherein rotation of the feeder disc is operative to cause a plurality of pills within the base interior area to be moved by operative engagement with the feeder disc and the plurality of brushes so that one respective pill is caused to be positioned in each respective pill engaging aperture as the feeder disc rotates, and the one respective pill in the respective pill engaging aperture to drop individually into the drop opening when the respective pill engaging aperture is positioned in overlying relation with the drop opening.

* * * * *